US012644260B2

(12) United States Patent
Sinn et al.

(10) Patent No.: US 12,644,260 B2
(45) Date of Patent: Jun. 2, 2026

(54) PULLBACK SHROUD RETENTION SYSTEM FOR A WORK TOOL

(71) Applicant: CATERPILLAR INC., Peoria, IL (US)

(72) Inventors: Eric Thomas Sinn, Tremont, IL (US); Douglas Charles Serrurier, Morton, IL (US); Corey Michael Wells, East Peoria, IL (US); Kevin Spahn, Washington, IL (US); Jerome Alexander Sendon, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 392 days.

(21) Appl. No.: 18/510,804

(22) Filed: Nov. 16, 2023

(65) Prior Publication Data

US 2025/0109576 A1 Apr. 3, 2025

Related U.S. Application Data

(60) Provisional application No. 63/587,206, filed on Oct. 2, 2023.

(51) Int. Cl.
*E02F 9/28* (2006.01)

(52) U.S. Cl.
CPC ..... *E02F 9/2833* (2013.01); *E02F 9/2816* (2013.01); *E02F 9/2883* (2013.01)

(58) Field of Classification Search
CPC ..... E02F 9/2833; E02F 9/2816; E02F 9/2883; E02F 9/2825; E02F 9/2841; E02F 9/2858; E02F 9/2808; E02F 9/28
See application file for complete search history.

(56) References Cited

U.S. PATENT DOCUMENTS

| | | | | |
|---|---|---|---|---|
| 5,452,529 | A * | 9/1995 | Neuenfeldt | E02F 9/2825 37/395 |
| 7,219,454 | B2 * | 5/2007 | Maher | E02F 9/2833 37/456 |
| 7,472,503 | B2 | 1/2009 | Maher | |
| 9,540,796 | B2 * | 1/2017 | Dallard | E02F 9/2841 |
| 9,909,285 | B2 * | 3/2018 | Bjerke | E02F 3/40 |
| 9,938,695 | B2 * | 4/2018 | Bjerke | E02F 9/2816 |

(Continued)

FOREIGN PATENT DOCUMENTS

| | | |
|---|---|---|
| AU | 2011221349 A1 | 3/2012 |
| WO | 2022120412 | 6/2022 |
| WO | 2022120412 A1 | 6/2022 |

*Primary Examiner* — Christopher J Sebesta
*Assistant Examiner* — Blake E Scoville

(57) ABSTRACT

A shroud retention system has a boss attached to a work tool and a retention block attached to the boss. The shroud retention system has a plunger block connected to and slidably movable relative to the retention block. The boss, the retention block, and the plunger block are slidably receivable in a shroud including a retainer slot. The shroud retention system has a retainer plate disposed in the retainer slot and configured to engage with the plunger block. The shroud retention system has a shim with a shim front face engaging the retention block and a shim rear face engaging a shroud inner wall. The shroud retention system has a retention fastener that passes through a thru hole in each of the plunger block, the retainer plate, and the shim and engages with a lock nut in the retention block to attach the shroud to the work tool.

20 Claims, 36 Drawing Sheets

(56) References Cited

U.S. PATENT DOCUMENTS

| | | | | |
|---|---|---|---|---|
| 10,947,704 | B2 * | 3/2021 | Bjerke | E02F 9/2833 |
| 11,162,247 | B2 | 11/2021 | Martinez Mane et al. | |
| 11,365,529 | B2 * | 6/2022 | Bjerke | E02F 9/2858 |
| 2017/0073939 | A1 | 3/2017 | Bjerke et al. | |
| 2020/0141093 | A1 * | 5/2020 | Bjerke | E02F 9/2841 |
| 2020/0157782 | A1 | 5/2020 | Bjerke | |
| 2021/0230845 | A1 | 7/2021 | Bjerke | |
| 2023/0064096 | A1 | 3/2023 | Tan et al. | |
| 2023/0383502 | A1 * | 11/2023 | Serrurier | E02F 9/2825 |

* cited by examiner

PULLBACK SHROUD RETENTION SYSTEM FOR A WORK TOOL

CROSS-REFERENCE TO RELATED APPLICATION

This application is based on and claims benefit of priority to U.S. Provisional Patent Application No. 63/587,206, filed Oct. 2, 2023, the entire contents of which are incorporated herein by reference.

TECHNICAL FIELD

The present disclosure relates generally to a shroud retention system and, more particularly, to a pullback shroud retention system for a work tool.

BACKGROUND

Earth-working machines, such as excavators, shovels, and wheel loaders, include ground engaging work tools that engage with and/or move a variety of earthen materials. These work tools often have one or more cutting tools or tooth assemblies mounted to an edge of the work tool, for example, to a lip of a bucket. The exposed portions of the work tool edge between adjacent tooth assemblies come into contact with the ground or the earthen materials and are subjected to extreme abrasion and impacts that cause them to wear. To prolong the useful life of the work tools, wear members or shrouds are attached to the work tools between adjacent tooth assemblies to protect the exposed portions of the work tool edge.

Although the wear members protect the edge of the work tool, the wear members are still subject to severe abrasion and may need periodic repair or replacement. Removal and/or replacement of a wear member may require disassembly of the wear members from the edge of the work tool, and assembly of a repaired or a new wear member on the work tool. The machine must be taken out of service to perform such replacement or repair. The time required to disassemble and reassemble a wear member may be dictated by the mechanism used to retain the wear member on the work tool. It is desirable to have a retention system that allows for quick assembly and disassembly at a worksite to allow the machine to be returned to service as quickly as possible.

U.S. Pat. No. 7,472,503 of Maher, issued on Jan. 6, 2009 ("the '503 patent"), and discloses a resilient connection system for attaching a wear member to an excavating lip structure. In particular, the '503 patent discloses a ground engaging tool that is attached to a portion of the lip plate of a mechanical digging device. A lug is welded to the lip plate. The ground engaging tool includes a front portion and an attachment portion extending from the front portion. The attachment portion includes a recess that allows the attachment portion to be slid over the lug. The attachment portion also includes a rectangular slot extending through an upper face of the attachment portion. The '503 patent discloses that a stabilizing member is located within the slot and a clamping member is positioned between the lug and the stabilizing member. The clamping member includes a resilient portion such as a compression spring. Further, the '503 patent discloses that a compressive force supplied to the resilient portion restricts the movement of the second member relative to the lug.

Although the '503 patent discloses a wear member retention system, the disclosed retention system may not allow the wear member to be firmly attached to the lip plate. For example, degradation in the spring constant of the resilient portion during use of the wear member may cause the connection between the wear member and the lip plate to become loose. As a result, the wear member may be subjected to lateral sideways movement and/or vertical movements in a direction perpendicular to the face of the lip plate during use of the work tool. Such movements may make use of the working tool inefficient during ground engaging operations. Additionally, such movement of the wear member relative to the lip plate may cause additional wear of and/or damage to the various mating components. Although it may be possible to tighten the connection between the wear member and the lip plate of the '503 patent, such tightening operations may require the machine to be taken out of service. This, in turn, may make use of the wear member of the '503 patent cumbersome and/or may contribute to increased cost for performing the ground engaging operations.

The shroud retention system of the present disclosure solves one or more of the problems set forth above and/or other problems of the prior art.

SUMMARY

In one aspect, the present disclosure is directed to a shroud retention system for a work tool. The shroud retention system may include a boss attached to the work tool. Further, the shroud retention system may include a retention block attached to the boss. The retention block may include a lock nut. The shroud retention system may include a plunger block connected to the retention block and configured to slidably move relative to the retention block. The boss, the retention block, and the plunger block may be slidably receivable in a shroud including a retainer slot. The shroud retention system may include a retainer plate disposed in the retainer slot and configured to engage with the plunger block. The shroud retention system may also include a shim having a shim front face configured to engage with the retention block and a shim rear face configured to engage with a shroud inner wall. Each of the plunger block, the retainer plate, and the shim may include a thru hole. The shroud retention system may include a retention fastener configured to pass through the thru hole in each of the plunger block, the retainer plate, and the shim and engage with the lock nut to attach the shroud to the work tool.

In another aspect, the present disclosure is directed to a shroud assembly. The shroud assembly may include a work tool including a base edge. The shroud assembly may also include a shroud configured to be attached to the base edge. The shroud may include a tip and an attachment portion extending from the tip. The attachment portion may include a longitudinal channel and a slot extending transverse to the longitudinal channel. The shroud assembly may include a boss attached to the base edge and a retention block attached to the boss. The retention block may include a lock nut. The shroud assembly may include a plunger block connected to the retention block and configured to slidably move relative to the retention block. The boss, the retention block, and the plunger block may be slidably receivable in the longitudinal channel of the shroud. The shroud assembly may also include a retainer plate disposed in the slot and configured to abut on the plunger block. Further, the shroud assembly may include a shim having a front face configured to abut on the retainer and a shroud contact rear face configured to engage with a shroud inner wall of the shroud. Each of the plunger block, the retainer plate, and the shim may include a thru hole. The shroud assembly may also include a retention bolt configured to pass through the thru hole in each of the plunger block, the retainer plate, and the shim. The retention bolt may be further configured to threadingly engage with the lock nut to attach the shroud to the work tool.

In yet another aspect, the present disclosure is direct to a method of attaching a shroud to a work tool. The method may include attaching a boss to an upper surface of the work tool. The method may also include slidably attaching a retention block to the boss, the retention block including a blind hole configured to retain a lock nut. The method may further include slidably inserting a plunger of a plunger block into a portion of the blind hole of the retainer, the plunger block including a plunger thru hole. The method may include sliding the shroud on to the work tool, the shroud including a longitudinal channel configured to slidingly receive the boss, the retention block, and the plunger block, the shroud including a slot extending transverse to the longitudinal channel. Further, the method may include positioning the shroud on the work tool such that the slot is disposed between the plunger block and a shroud distal end. The method may include inserting a shim into the longitudinal channel via the slot, the shim including a shim thru hole and pushing the shim such that the shim is separated from the plunger block by a gap. The method may include inserting a retainer plate into the gap within the longitudinal channel via the slot, the retainer plate including a retainer plate thru hole. Further, the method may include inserting a retention bolt through the shim thru hole, the retainer plate thru hole, and the plunger thru hole such that a threaded portion of the retention bolt engages with the lock nut in the retention block. The method may include rotating the retention bolt such that an end face of the retention bolt abuts on a blind hole base of the blind hole in the retention block. In addition, the method may include continuing to rotate the retention bolt, causing the plunger block, the retainer plate, and the shim to slidably move away from the retention block and further causing a shroud contact rear face of the shim to engage with a shroud internal wall.

DETAILED DESCRIPTION

Figure 1:
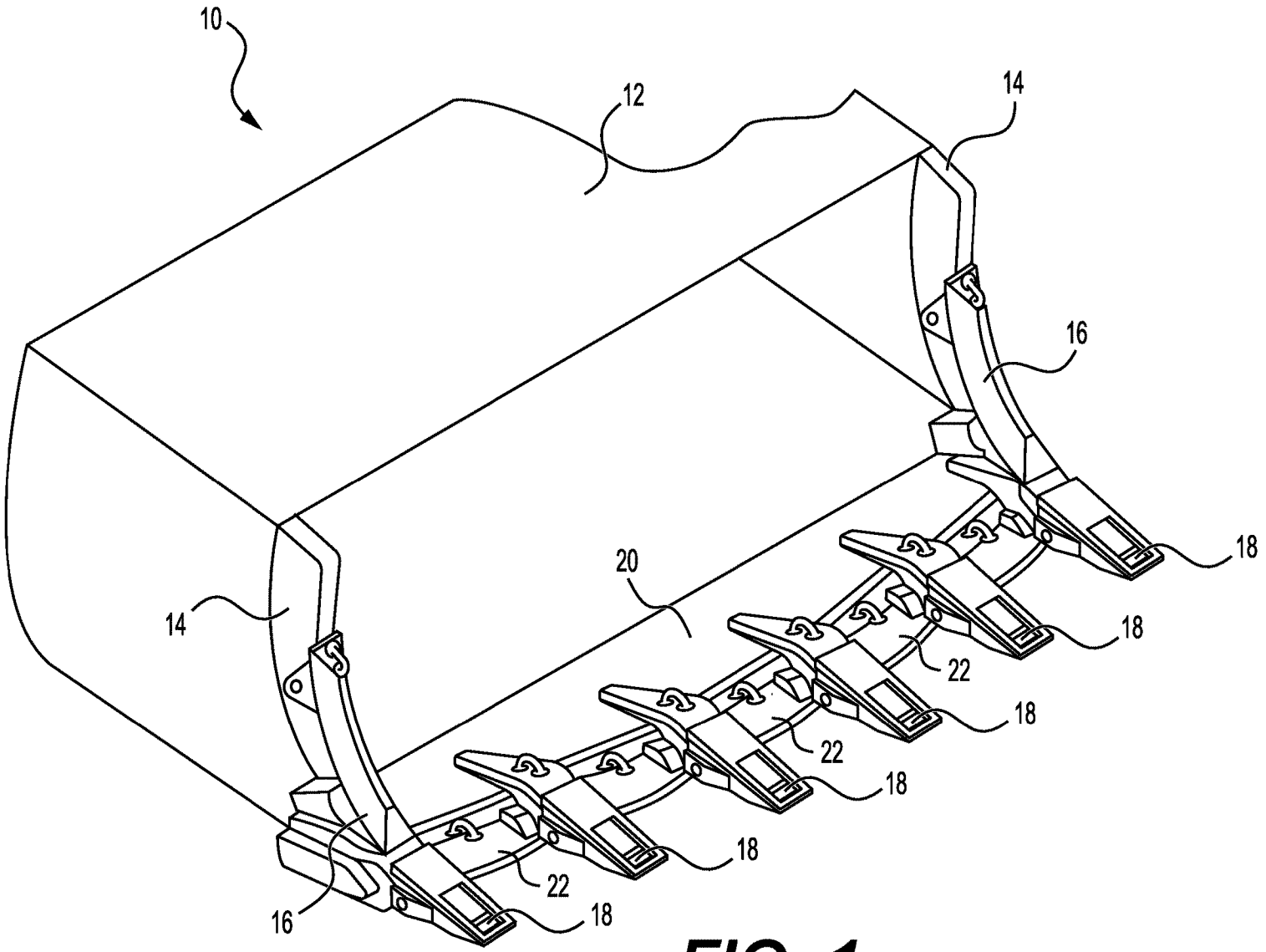
FIG. 1 is an illustration of an exemplary work tool.

FIG. 1 illustrates an exemplary work tool 10 for a machine (not shown). Work tool 10 may embody any device used to perform a task assigned to the machine. For example, work tool 10 may be a bucket 12 (shown in FIG. 1), a blade, a shovel, a crusher, a grapple, a ripper, or any other material moving device known in the art. Bucket 12 may include a pair of oppositely-disposed arms 14 on which corresponding corner guards 16 may be mounted. Bucket 12 may also include a plurality of ground-engaging tip assemblies 18 mounted along base edge 20 with shrouds 22 (or edge protector assemblies) interposed between the tip assemblies 18 and secured along base edge 20 of bucket 12. Each shroud 22 may be configured to protect base edge 20 from abrasion and wear by reducing or preventing contact of an exposed portion of base edge 20 with earthen materials.

For the purposes of this disclosure, attention will be focused on attachment of shroud 22 to base edge 20 of work tool 10. It is contemplated, however, that the attachment methods and structures presented in this disclosure may be equally utilized with tool assemblies, other wear components, and/or with any other wear components known in the art.

Figure 2:
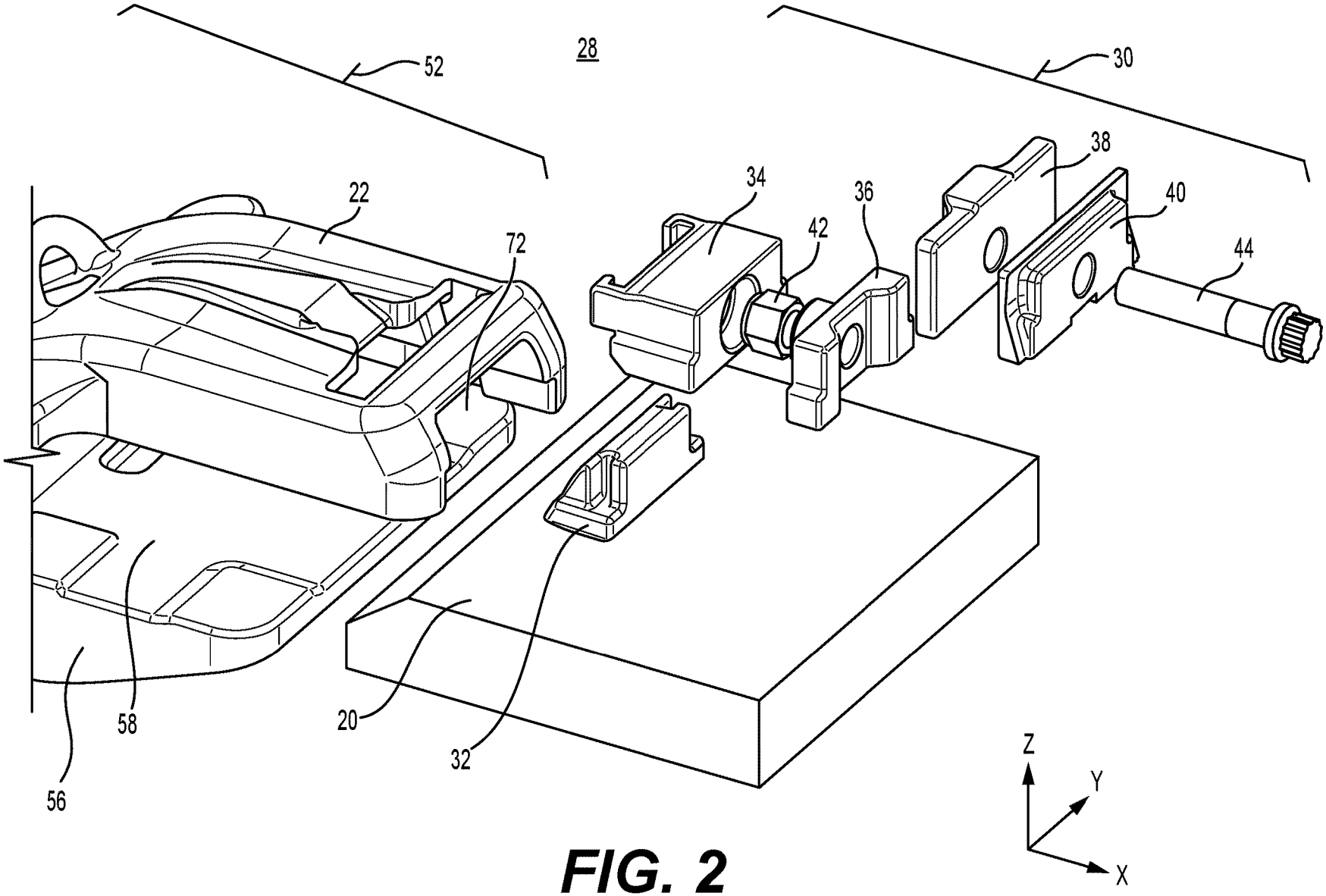
FIG. 2 is an exploded perspective view of an exemplary shroud assembly for the work tool of FIG. 1.

FIG. 2 illustrates an exemplary exploded perspective view of shroud assembly 28 including shroud 22 and shroud retention system 30 for attaching shroud 22 to base edge 20 of work tool 10. Shroud retention system 30 may include boss 32, retention block 34, plunger block 36, retainer plate 38, shim 40, lock nut 42, and retention fastener 44. Shroud 22 may be generally U-shaped and may include shroud tip 50 (see FIG. 4), attachment portion 52, upper leg 54 (see FIG. 4), and lower leg 56. Upper and lower legs 54 and 56 may be spaced apart from each other to form opening 58 that may be large enough to receive base edge 20 of work tool 10.

Figure 3:
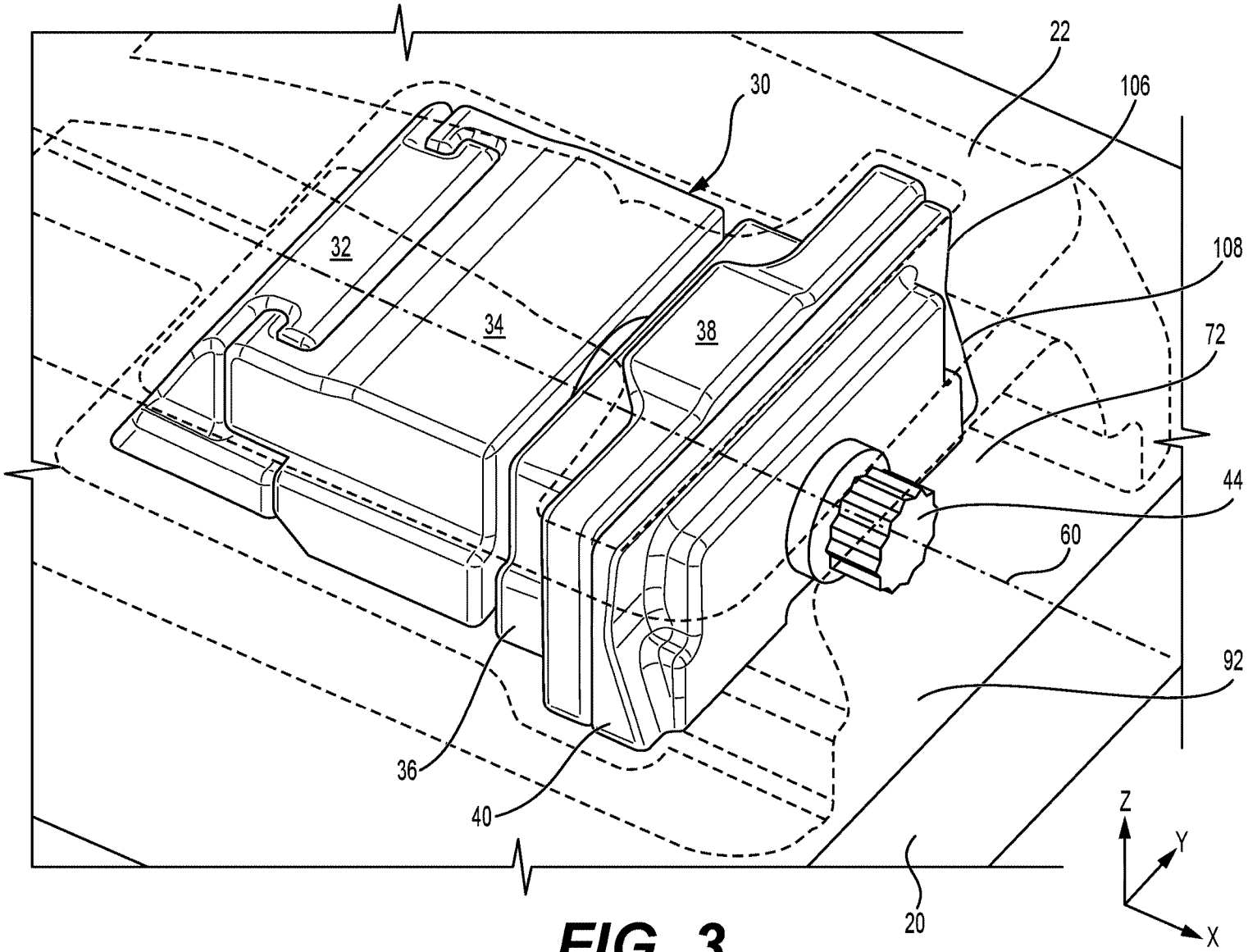
FIG. 3 is an illustration of an exemplary shroud assembly of FIG. 2.

FIG. 3 illustrates a perspective view of shroud assembly 28 including an exemplary shroud 22 assembled to base edge 20 of work tool 10 (see FIG. 1), using shroud retention system 30. Shroud 22 is illustrated in dashed lines in FIG. 3 to show shroud retention system 30 in its assembled configuration. As illustrated in FIG. 3, shroud 22, and the various components of shroud retention system 30, such as boss 32, retention block 34, plunger block 36, retainer plate 38, shim 40, lock nut 42 (not see in FIG. 3), and retention bolt 44 are aligned along longitudinal axis 60 of shroud retention system 30.

Figure 4:
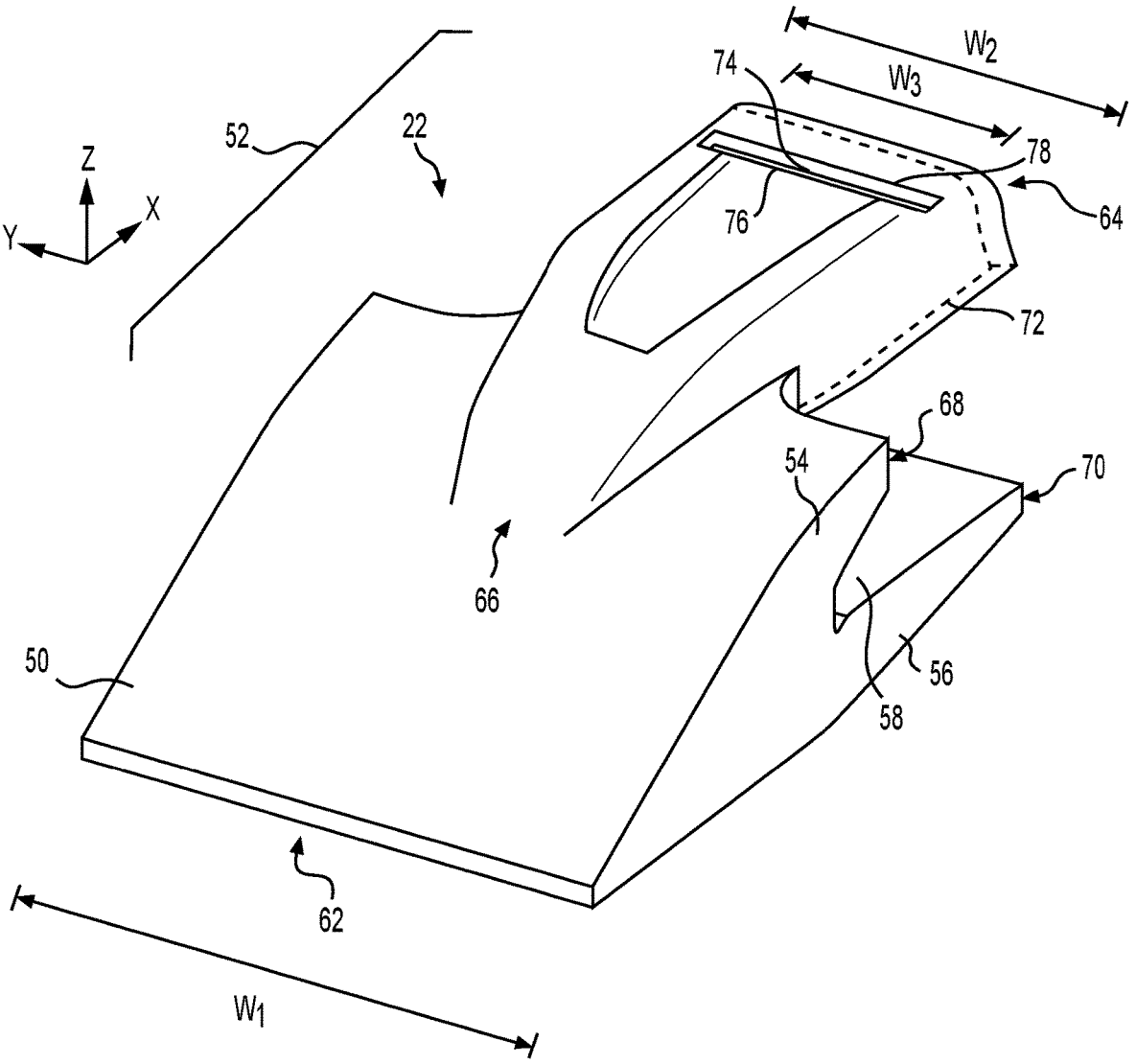
FIG. 4 is a perspective view of an exemplary shroud for the shroud retention system of FIG. 2.

FIG. 4 illustrates a perspective view of an exemplary shroud 22, which may extend from adjacent shroud proximal end 62 at the front of shroud 22 to adjacent shroud distal end 64 at the rear of shroud 22. Shroud 22 may include shroud tip 50 and attachment portion 52. Shroud tip 50 may extend from adjacent shroud proximal end 62 to adjacent tip end 66. Shroud tip 50 may be generally wedge shaped with a thickness adjacent shroud proximal end 62, which may be smaller than a thickness of shroud tip 50 adjacent tip end 66. Upper leg 54 of shroud 22 may extend from tip end 66 to upper leg distal end 68, which may be disposed between tip end 66 and shroud distal end 64. Lower leg 56 of shroud 22 may extend from tip end 66 to lower leg distal end 70, which may be disposed between tip end 66 and shroud distal end 64. Upper leg 54 may be spaced apart from lower leg 56, forming opening 58 between upper and lower legs 54, 56. Upper and lower legs 54, 56 may be wedge shaped. For example, a thickness of upper leg 54 adjacent tip end 66 may be larger than a thickness of upper leg 54 adjacent upper leg distal end 68. Likewise, a thickness of lower leg 56 adjacent tip end 66 may be larger than a thickness of lower leg 56 adjacent lower leg distal end 70. Shroud tip 50, upper leg 54, and lower leg 56 may each have a width "$W_1$" in the transverse or "Y" direction that may be generally perpendicular to longitudinal axis 60 (see FIG. 3) and the X direction (e.g., front to rear direction).

Attachment portion 52 may be attached to shroud tip 50. In one exemplary embodiment as illustrated in FIG. 4, attachment portion 52 may be attached to upper leg 54 and may extend from adjacent tip end 66 to shroud distal end 64. Attachment portion 52 may have a width "$W_2$," in the Y direction, adjacent shroud distal end 64. In one exemplary embodiment as illustrated in FIG. 4, width $W_2$ may be smaller than width $W_1$. Attachment portion 52 may include longitudinal channel 72 (see dashed lines, see FIGS. 2, 3), which may extend from adjacent tip end 66 to shroud distal end 64. Longitudinal channel 72 of shroud 22 may have a generally inverted C-shape and may be configured to slidably receive one or more of boss 32, retention block 34, plunger block 36, and shim 40. Attachment portion 52 may include slot 74 extending transverse to longitudinal channel 72. Slot 74 may be disposed adjacent shroud distal end 64 across a width of attachment portion 52 and may be configured to receive retainer plate 38 and/or shim 40. In one exemplary embodiment as illustrated in FIG. 3, slot 74 may have a generally rectangular shape and may be disposed nearer to shroud distal end 64 compared to tip end 66. Slot 74 may have a front edge 76 separated from a rear edge 78. Slot 74 may have a width "$W_3$," along the Y direction, which may be smaller than a width $W_2$ of attachment portion 52. Width $W_3$ and the gap between front edge 76 and rear edge 78 of slot 74 may be selected to allow retainer plate 38 and shim 40 to pass through slot 74 into longitudinal channel 72.

Figure 5:
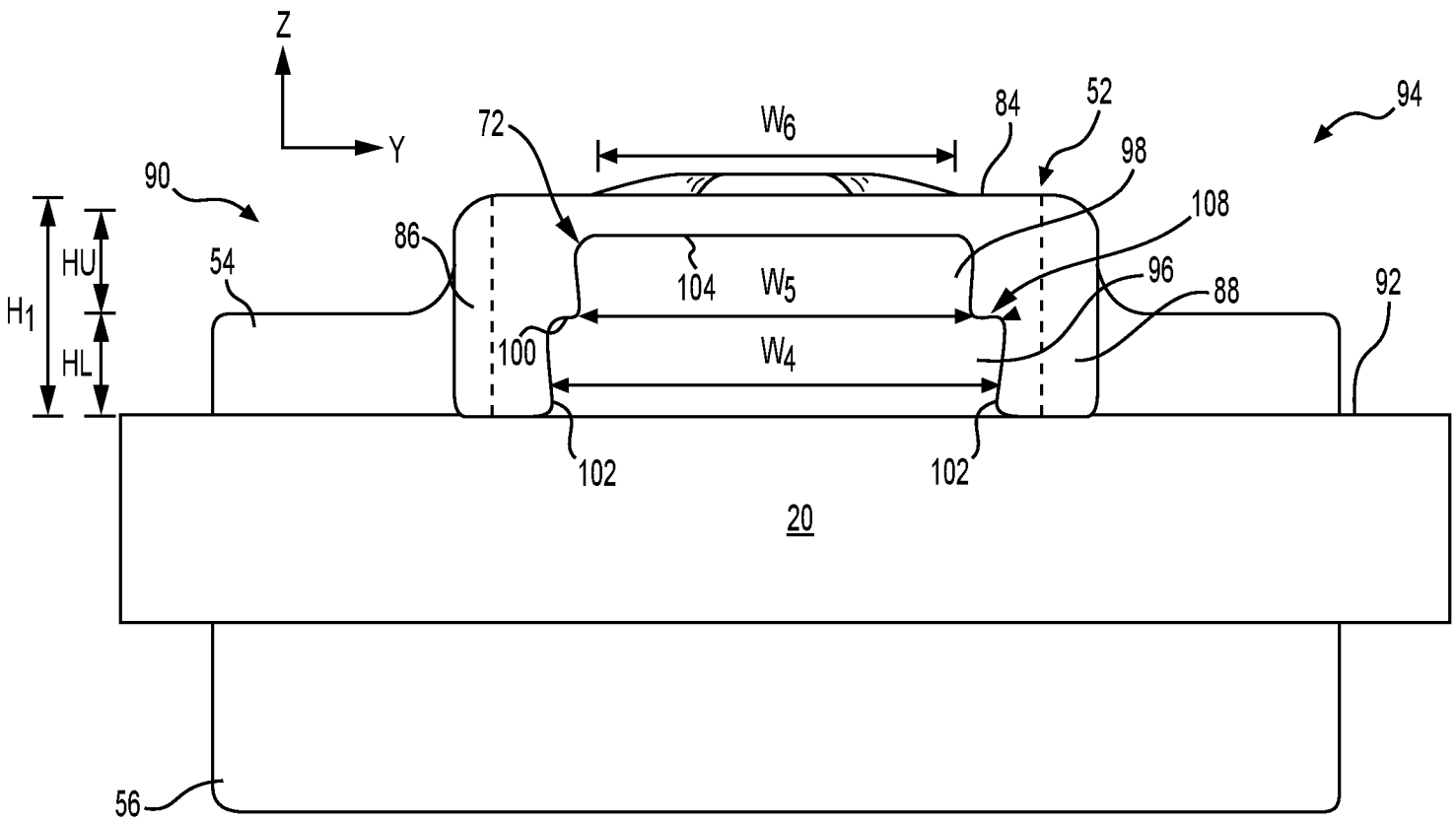
FIG. 5 is rear view of the exemplary shroud of FIG. 3.

FIG. 5 illustrates a rear view of shroud 22 (e.g., in the negative X direction looking from shroud distal end 64 towards shroud proximal end 62 along longitudinal axis 60). As illustrated in FIG. 5, longitudinal channel 72 of attachment portion 52 may have a generally inverted C-shape having top wall 84, first leg 86, and second leg 88. First leg 86 may extend from top wall 84 towards base edge 20 of work tool 10 (in a −Z direction). First leg 86 may be disposed on first side 90 (e.g., right side relative to front-rear direction +X) of longitudinal channel 72 and may extend from top wall 84 to adjacent upper surface 92 of base edge 20. Second leg 88 may extend from top wall 84 towards base edge 20 of work tool 10. Second leg 88 may be disposed opposite first leg 86 on second side 94 (e.g., left side relative to front-rear direction +X). Second leg 88 may extend from top wall 84 to adjacent upper surface 92 of base edge 20. Longitudinal channel 72 may have a height "$H_1$," in the "Z" direction that may be generally perpendicular to the X and Y directions and to longitudinal axis 60. Longitudinal channel 72 may include lower recess 96 and upper recess 98, both of which together may form Longitudinal channel 72. Lower recess 96 may extend from adjacent upper surface 92 of base edge 20 to lower recess upper wall 100. Lower recess 96 may have a height "HL," in the Z direction that may be smaller than height $H_1$ of Longitudinal channel 72. Lower recess 96 may have a width "$W_4$," in the Y direction extending between lower recess side walls 102, adjacent upper surface 92 and a width "$W_5$" adjacent lower recess upper wall 100. In one exemplary embodiment as illustrated in FIG. 5, width $W_5$ may be smaller than width $W_4$ giving lower recess 96 a generally inverted trapezoidal or dovetail shape. It is contemplated, however, that lower recess 96 may have other shapes, for example, rectangular, trapezoidal, or any other shape.

Upper recess 98 may extend from lower recess upper wall 100 to channel inner wall 104. Upper recess 98 may have a height "HU" that may be smaller than height $H_1$ of longitudinal channel 72. Further, heights HL and HU may be equal or unequal. Upper recess 98 may have a width "$W_6$" adjacent top wall 84. In one exemplary embodiment as illustrated in FIG. 5, width $W_6$ may be larger than width $W_5$ giving upper recess 98 a generally inverted trapezoidal or dovetail shape. It is contemplated, however, that upper recess 98 may have other shapes, for example, rectangular, trapezoidal, or any other shape. Lower and upper recesses 96, 98 of longitudinal channel 72 may be configured to slidably receive one or more of boss 32, retention block 34, plunger block 36, and/or shim 40.

Figure 6:
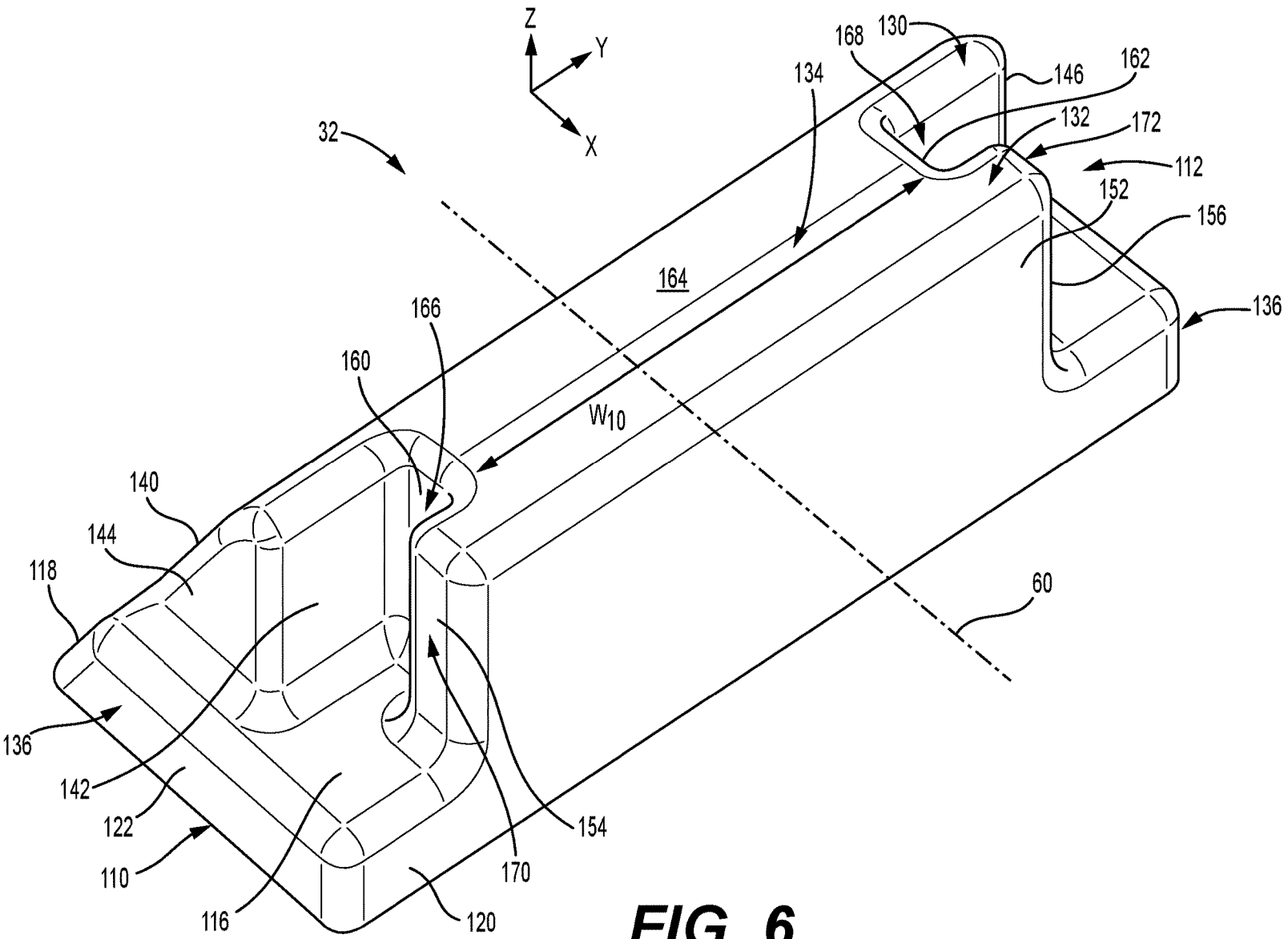
FIG. 6 is a perspective view of an exemplary boss for the shroud retention system of FIG. 2.
Figure 7:
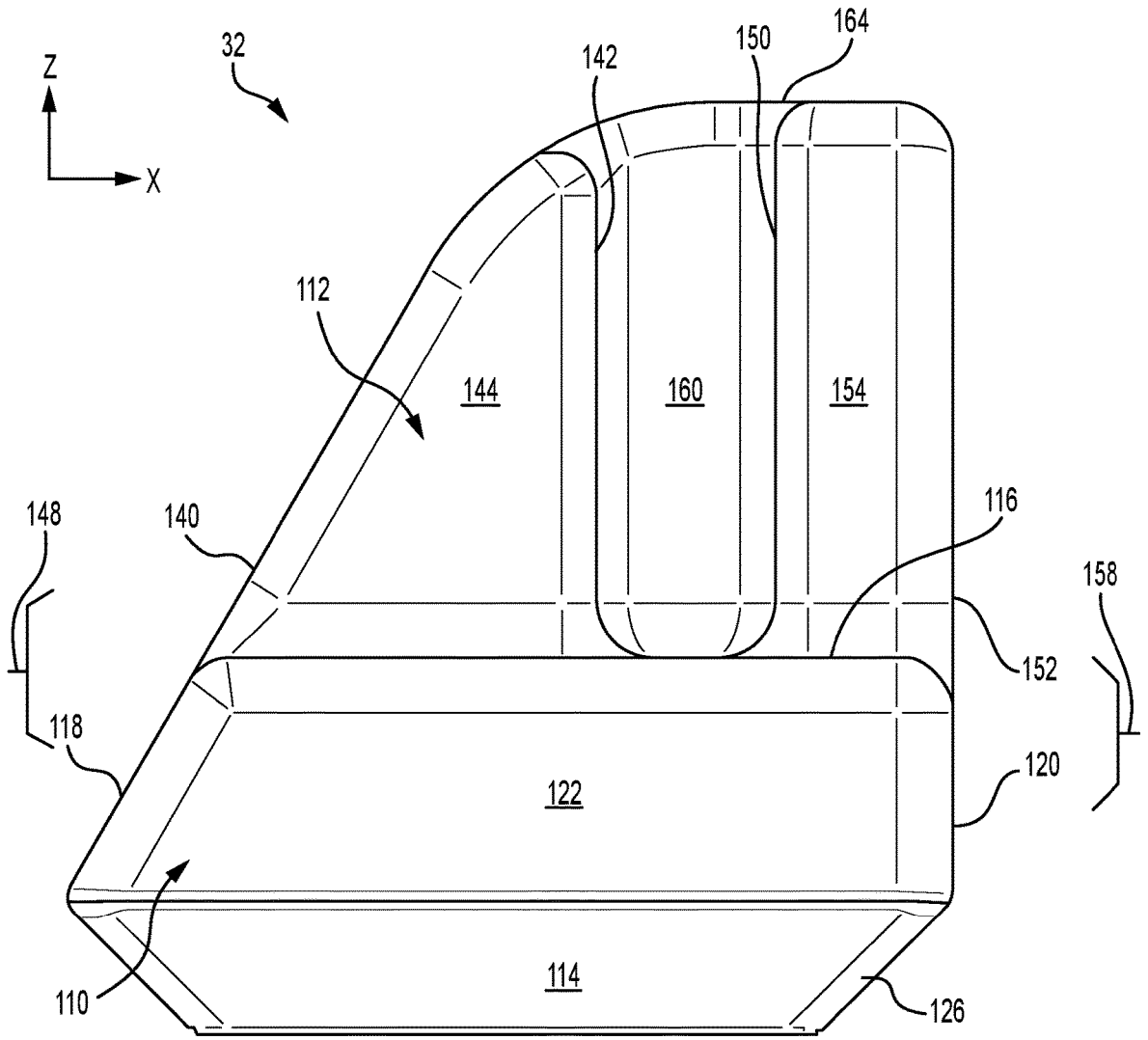
FIG. 7 is a side view of the exemplary boss of FIG. 6.
Figure 8:
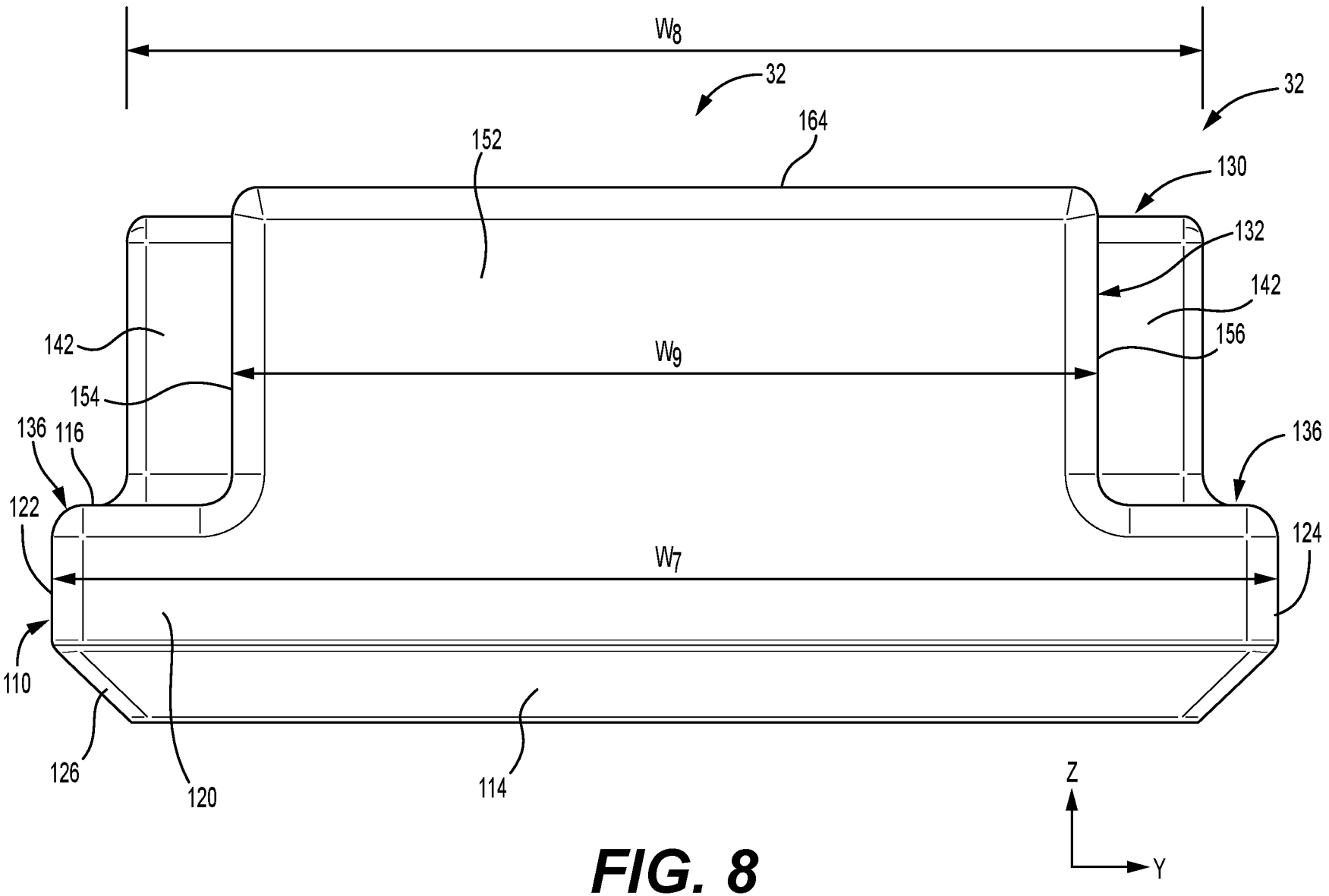
FIG. 8 is a rear view of the exemplary boss of FIG. 6.

FIGS. 6-8 illustrate various views of an exemplary disclosed boss 32. For example, FIG. 6 illustrates a perspective view, FIG. 7 illustrates a side elevation view, and FIG. 8 illustrates a rear view of boss 32. As illustrated in FIG. 6, boss 32 may include boss base plate 110 and boss body 112 projecting in a height direction (e.g., +Z direction) from boss base plate 110. Boss base plate 110 may be defined by bottom face 114 (see FIG. 7), top face 116, front face 118 (see also FIG. 7), rear face 120, and side faces 122 and 124 (see FIG. 8). Faces 114, 116, 118, 120, 122, and 124 may each be a generally flat face. Top face 116 may be spaced apart from bottom face 114 in a vertical or height direction (e.g., along the Z direction). Bottom face 114 and top face 116 may be oriented generally parallel to each other and to longitudinal axis 60. In one exemplary embodiment, as illustrated in FIGS. 7 and 8, boss base plate 110 may include weld groove 126 disposed around a perimeter of bottom face 114. Weld groove 126 may allow boss 32 to be welded to upper surface 92 (see FIG. 5) of base edge 20 (see FIG. 5) using a groove weld that may help improve weldability and weld quality to ensure that boss 32 may be firmly affixed to base edge 20. Front face 118 and rear face 120 may be spaced apart from each other along longitudinal axis 60 (or along the X direction). Front face 118 and rear face 120 may each be connected to bottom face 114 and top face 116, and may each extend from bottom face 114 to top face 116. In one exemplary embodiment as illustrated in FIGS. 6 and 7, rear face 120 may be generally perpendicular to longitudinal axis 60 whereas front face 118 may be generally inclined relative to longitudinal axis 60 and rear face 120. Side faces 122 and 124 may be spaced apart from each other in the width direction (or along the Y direction) and may be oriented generally parallel to each other and to longitudinal axis 60. Side face 122 and 124 may extend from bottom face 114 to top face 116, and from front face 118 to rear face 120. Side faces 122 and 124 may each be connected to bottom face 114, top face 116, front face 118, and rear face 120. It is to be understood that terms like "bottom," "top," "front," "rear," or "side" indicate relative directions and should not be interpreted as requiring a particular direction relative to, for example, a gravitational direction. It is also to be understood that terms like "generally" and "about" should be interpreted as encompassing commonly understood design, material, and manufacturing tolerances. Thus, for example, the terms "perpendicular" or "generally perpendicular" should be interpreted to encompass angles ranging between 90°±5°, the terms parallel or "generally parallel" should be interpreted to encompass angles ranging between 0°±5°, and the term generally inclined should be interpreted to encompass angles different from 0°±5° and 90°±5°.

As illustrated in FIG. 6, boss body 112 may project in a height direction (e.g., +Z direction) from top face 116 of boss base plate 110. Boss body 112 may include boss front block 130, boss rear block 132, and boss central block 134, each of which may project upwards in a vertical or height direction (e.g., +Z direction) from top face 116 of boss base plate 110. Each of boss front block 130, boss rear block 132, and boss central block 134 may be symmetrically positioned about longitudinal axis 60. That is, respective widths of each of boss front block 130, boss rear block 132, and boss central block 134 disposed on either side of longitudinal axis 60 in the transverse directions (e.g., +Y and −Y directions) may be about equal. Each of boss front block 130, boss rear block 132, and boss central block 134 may have a width in the Y direction that may be smaller than a width of boss base plate 110 in the Y direction such that boss base plate 110 may include boss rails 136 adjacent to side faces 122 and 124. For example, as illustrated in FIG. 8, boss base plate 110 may have a width "$W_7$" in the Y direction, boss front block 130 may have a width "$W_8$" in the Y direction, and boss rear block 132 may have a width "$W_9$" in the Y direction. As also illustrated in FIG. 8, width $W_8$ of boss front block 130 and width $W_9$ of boss rear block 132 may both be smaller than width $W_7$ of boss base plate 110. In one exemplary embodiment as illustrated in FIG. 8, width $W_8$ of boss front block 130 and width $W_9$ of boss rear block 132 may be unequal. In some exemplary embodiments, width $W_8$ of boss front block 130 and width $W_9$ of boss rear block 132 may be about equal. Boss rails 136 may have a same thickness as boss base plate 110 and may be configured to be slidingly received in lower recess 96 of shroud 22 (see FIG. 5) such that top face 116 of boss base plate 110 may engage with, abut on, or be disposed adjacent to lower recess upper wall 100 (see FIG. 5) and side faces 122 and 124 may engage with, abut on, or be disposed adjacent to lower recess side walls 102 (see FIG. 5).

As illustrated in FIGS. 6 and 7, boss front block 130 may include front face 140, rear face 142, and side faces 144, 146. Front face 140 of boss front block 130 may be generally inclined relative to longitudinal axis 60 and may be generally coplanar with front face 118 of boss base plate 110. Thus, as illustrated in FIG. 7, boss 32 may have planar front face 148 formed of front face 118 of boss base plate 110 and front face 140 of boss front block 130. Rear face 142 may be spaced apart from front face 140 of boss front block 130 and may be disposed generally perpendicular to longitudinal axis 60 and top face 116 of boss base plate 110. Side faces 144 and 146 of boss front block 130 may be spaced apart from each other in the width (or Y direction) and may extend from front face 140 to rear face 142. Side faces 144 and 146 may each be connected to top face 116 of boss base plate 110, to front and rear faces 140 and 142 of boss front block 130, and to top face 164 of boss body 112.

As illustrated in FIGS. 6 and 7, boss rear block 132 may include front face 150, rear face 152, and side faces 154 and 156. Front face 150 of boss rear block 132 may be disposed generally perpendicular to longitudinal axis 60 and top face 116 of boss base plate 110. Front face 150 of boss rear block 132 may be spaced apart from rear face 142 of boss front block 130 along longitudinal axis 60 (or in the X direction). Rear face 152 of boss rear block 132 may be disposed generally perpendicular to longitudinal axis 60 and top face 116 of boss base plate 110. Rear face 152 of boss rear block 132 may also be generally coplanar with rear face 120 of boss base plate 110. Thus, as illustrated in FIG. 7, boss 32 may have planar rear face 158 formed of rear face 120 of boss base plate 110 and rear face 152 of boss rear block 132. Side faces 154 and 156 may be spaced apart from each other in the width (or Y direction) and may extend from front face 150 to rear face 152. Side faces 154 and 156 may each be connected to top face 116 of boss base plate 110, to front and rear faces 150 and 152 of boss front block 130, and to top face 164 of boss body 112.

As also illustrated in FIGS. 6 and 7, boss central block 134 may extend from rear face 142 of boss front block 130 to front face 150 of boss rear block 132. Boss central block may include side faces 160 and 162 extending between rear face 142 of boss front block 130 and front face 150 of boss rear block 132. Side faces 160 and 162 may be connected to rear face 142 of boss front block 130, front face 150 of boss rear block 132, top face 116 of boss base plate 110, and top face 164 of boss body 112. Top face 164 of boss body 112 may form a common top face for each of boss front block 130, boss rear block 132, and boss central block 134. As shown in FIG. 6, boss central block 134 may have a width "$W_{10}$" that may be smaller than width $W_7$ (see FIG. 8) of boss base plate 110. Referring to FIGS. 6 and 8, in some exemplary embodiments, width $W_{10}$ of boss central block 134 may also be smaller than both width $W_8$ of boss front block 130 and width $W_9$ of boss rear block 132. Thus, as illustrated in FIG. 6, boss front block 130, boss rear block 132 and boss central block 134 may form channels 166 and 168 that may extend from top face 164 of boss body 112 to top face 116 of boss base plate 110. As also illustrated in FIG. 6, channel 166 may defined by rear face 142 of boss front block 130, side face 160 of boss central block 134, and front face 150 of boss rear block 132. Similarly, channel 168 may be defined by rear face 142 of boss front block 130, side face 162 of boss central block 134, and front face 150 of boss rear block 132. Channels 166 and 168 may define vertical rails 170 and 172, respectively, on boss rear block 132. Like channels 166 and 168, vertical rails 170 and 172 may extend from top face 116 of boss base plate 110 to top face 164 of boss body.

In one exemplary embodiment as illustrated in FIG. 6, channels 166 and 168 may be C-shaped with rear face 142 of boss front block 130 being spaced apart from and oriented generally parallel to front face 150 of boss rear block 132. In some exemplary embodiments, however, portions of rear face 142 of boss front block 130 and front face 150 of boss rear block 132 disposed adjacent to side faces 160 and 162 may be inclined relative to each other such that channels 166 and 168 may have shapes that may be different from a C-shape or a U-shape. For example, in some embodiments, channels 166 and 168 may have a dovetail shape.

Figure 30:
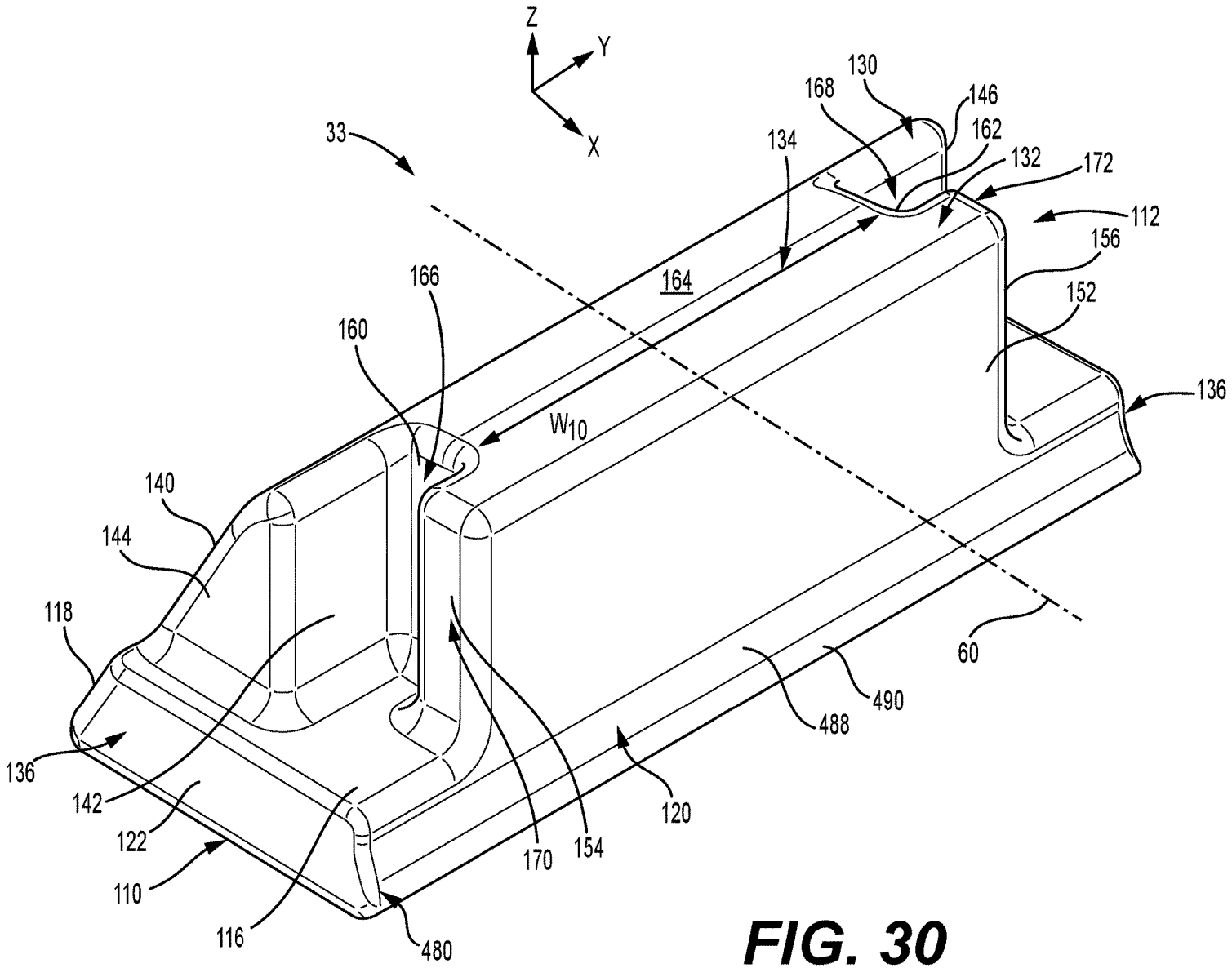
FIG. 30 is a perspective view of another exemplary boss for the shroud retention system of FIG. 2.
Figure 31:
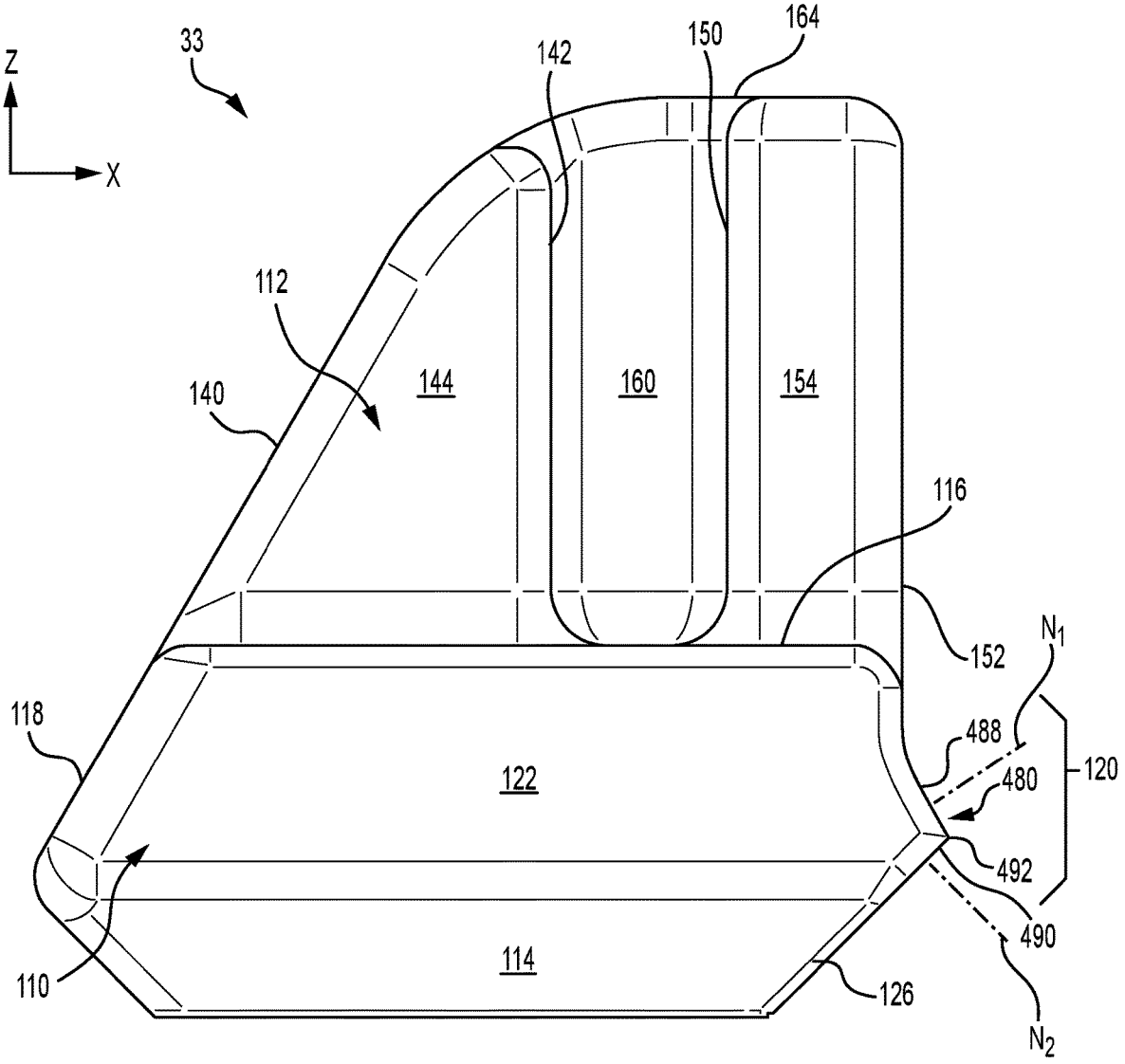
FIG. 31 is a side view of the exemplary boss of FIG. 30.

FIG. 30 illustrates a perspective view of another exemplary boss 33 for shroud retention system 30. FIG. 31 illustrates a side view of exemplary boss 33 of FIG. 30. Many of the features of boss 33 illustrated in FIGS. 30 and 31 are similar to the features of boss 32 as illustrated and described above with respect to FIGS. 6-8. Accordingly, a description of those features will not be repeated here, rather only features that are different in boss 33 of FIGS. 30-31 compared to boss 32 of FIGS. 6-8 are described below.

Like boss 32 of FIGS. 6-7, boss 33 of FIGS. 30-31 may include boss base plate 110 and boss body 112 projecting in a height direction (e.g., +Z direction) from boss base plate 110. Boss base plate 110 may be defined by bottom face 114 (see e.g., FIG. 31), top face 116 (see e.g., FIGS. 30 and 31), front face 118 (see e.g., FIGS. 30 and 31), rear face 120 (see e.g., FIGS. 30 and 31), and side faces 122 and 124 (see e.g., FIG. 30). Faces 114, 116, 118, 122, and 124 may each be a generally flat face. Unlike rear face 120 of boss 32 of FIGS. 6-8, rear face 120 of boss 33 of FIGS. 30-31 may not be a flat face. Rather rear face 120 of boss 33 of FIGS. 30-31 may include a wedge-shaped extension 480 that may extend along a width $W_7$ (see FIG. 8) of boss base plate 110. Extension 480 may include surfaces 488 and 490 that may converge at edge 492 (see FIG. 31). Each of surfaces 488 and 490 may be inclined relative to longitudinal axis 60 and relative to both bottom face 114 and top face 116 of boss base plate 110. Thus, for example, as illustrated in FIG. 31, a normal or perpendicular "$N_1$" extending from surface 488 may be inclined at a positive acute angle relative to direction X and longitudinal axis 60. Similarly, a normal or perpendicular "$N_2$" extending from surface 490 (see FIG. 31) may be inclined at a negative acute angle relative to direction X and longitudinal axis 60. One or more of surfaces 488 and 490 may be a flat surface or may be curved. For example, in some exemplary embodiments, one or both of surfaces 488 and 490 may be concave or convex relative to their respective normal $N_1$ and $N_2$. Extension 480 may allow for a smoother transition of surfaces from a weld included in weld groove 126 and rear face 120 of boss base plate 110.

Figure 9:
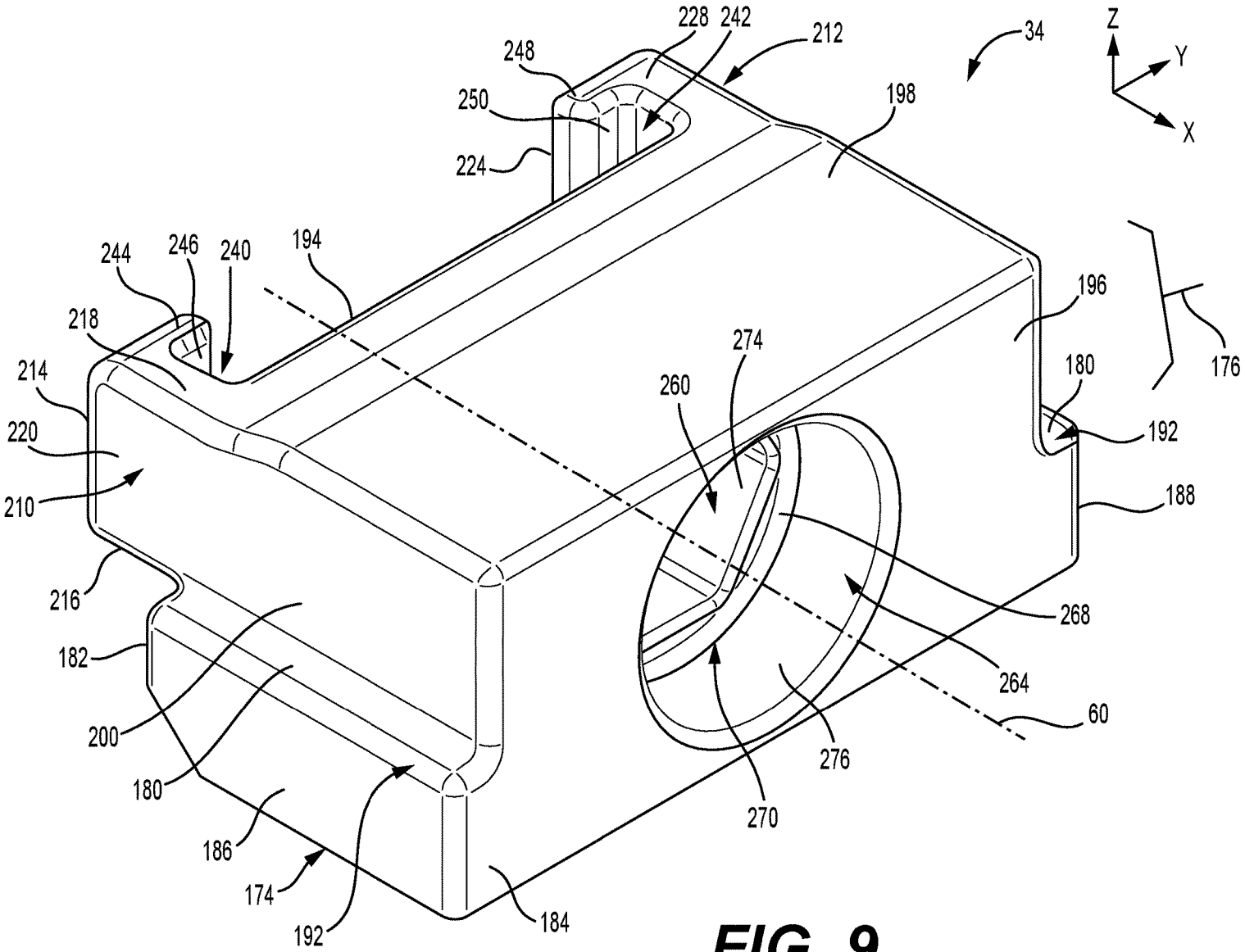
FIG. 9 is a perspective view of an exemplary retention block for the shroud retention system of FIG. 2.
Figure 10:
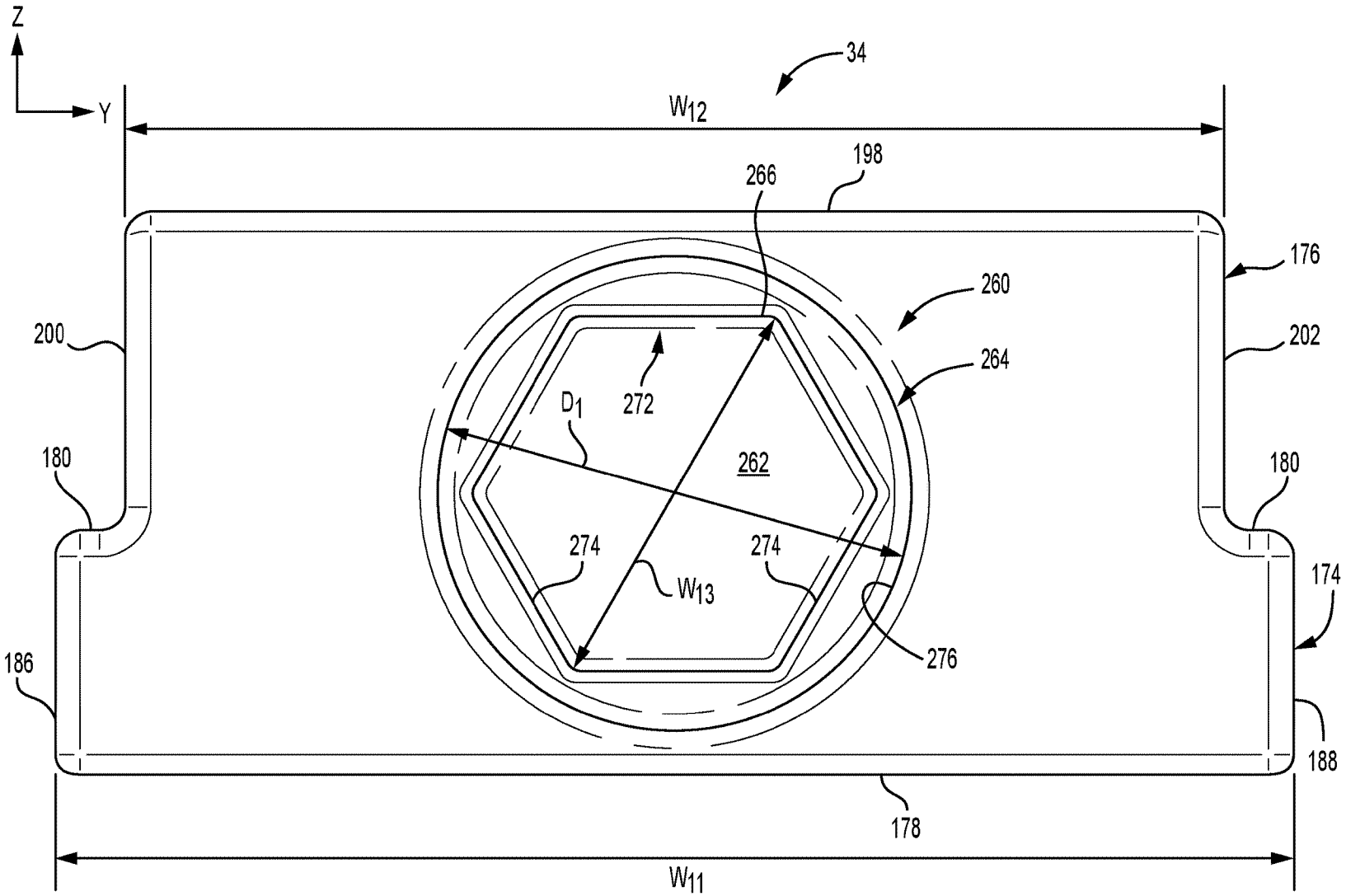
FIG. 10 is a rear elevation view of the exemplary retention block of FIG. 9.
Figure 11:
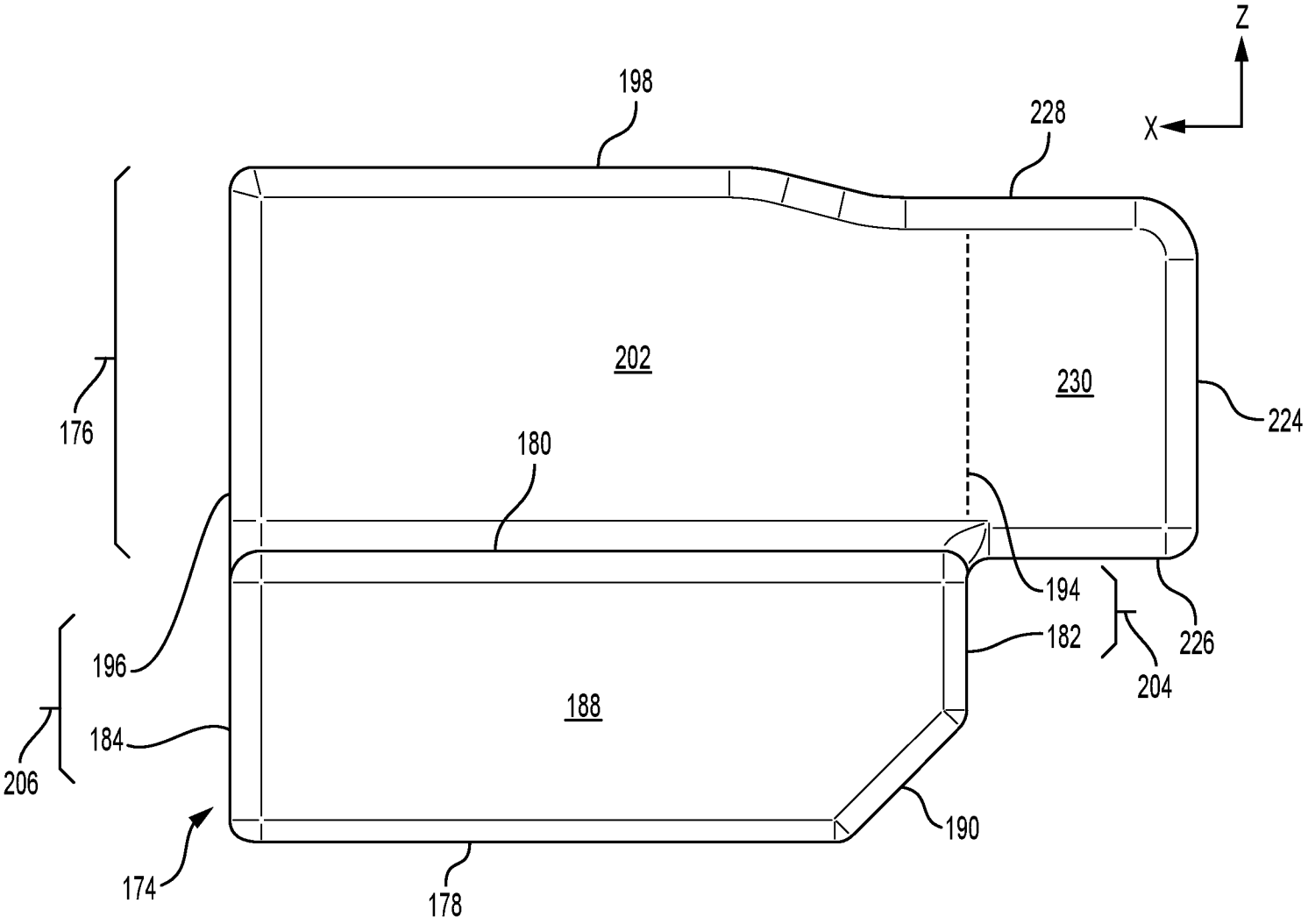
FIG. 11 is a side elevation view of the exemplary retention block of FIG. 9.

FIGS. 9-11 illustrate various views of an exemplary disclosed retention block 34. For example, FIG. 9 illustrates a perspective view, FIG. 10 illustrates a rear elevation view, and FIG. 11 illustrates a side elevation view (looking in the negative Y direction) of retention block 34. As illustrated in FIG. 9, retention block 34 may include retention block base plate 174 and retention block body 176 that may project in a height direction (e.g., +Z direction) from retention block base plate 174. Retention block base plate 174 may be defined by bottom face 178 (see FIGS. 10 and 11), top face 180, front face 182, rear face 184, and side faces 186 and 188 (see FIGS. 10 and 11). Faces 178, 180, 182, 184, 186, and 188 may each be a generally flat face. Top face 180 may be spaced apart from bottom face 178 in the height direction (or along the +Z direction). Bottom face 178 and top face 180 may be oriented generally parallel to each other and to longitudinal axis 60. Front face 182 and rear face 184 may be spaced apart from each other along longitudinal axis 60 (or along the X direction) and may be oriented generally perpendicular to longitudinal axis 60, bottom face 178, and top face 180. Rear face 184 may be connected to bottom face 178 and top face 180 and may extend from bottom face 178 to top face 180. In one exemplary embodiment as illustrated in FIGS. 9 and 11, rear face 184 may be generally perpendicular to longitudinal axis 60. Front face 182 may be connected to top face 180 and may extend from top face 180 towards bottom face 178. Retention block base plate 174 may include cutout face 190 that may extend to and be connected to bottom face 178. Cutout face 190 may also be connected to front face 182 and may be inclined relative to longitudinal axis 60 and relative to both bottom face 178 and front face 182. and rear face 120. Cutout face 190 may help ensure that neither bottom face 178 nor front face 182 of retention block base plate 174 may interfere with one or more groove welds disposed at the intersection of bottom face 114 and rear face 120 of boss base plate 110 (see FIG. 7) when retention block 34 is connected to boss 32. Side faces 186 and 188 may be spaced apart from each other in the width direction (or along the Y direction) and may be oriented generally parallel to each other and to longitudinal axis 60. Side faces 186 and 188 may extend from bottom face 178 to top face 180, and from front face 182 (and cutout face 190) to rear face 184. Side faces 186 and 188 may each be connected to bottom face 178 and top face 180.

As illustrated in FIG. 9, retention block body 176 may project upwards in a vertical or height direction Z from top face 180 of retention block base plate 174. Retention block body 176 may be symmetrically positioned about longitudinal axis 60. That is, widths of retention block body 176 disposed on either side of longitudinal axis 60 in the transverse directions (e.g., +Y and −Y directions) may be about equal. Retention block body 176 may have a width in the Y direction that may be smaller than a width of retention block base plate 174 in the Y direction such that retention block base plate 174 may include retention block rails 192 adjacent to side faces 182 and 184. For example, as illustrated in FIG. 10, retention block base plate 174 may have a width "$W_{11}$" in the Y direction and retention block base plate 176 may have a width "$W_{12}$" in the Y direction. As also illustrated in FIG. 10, width $W_{12}$ of retention block base plate 174 may be smaller than width $W_{11}$ of retention block base plate 174. Retention block rails 192 may have a same thickness about equal to that of retention block base plate 174 and may be configured to be slidingly received in lower recess 96 of shroud 22 (see FIG. 5) such that top face 180 of retention block base plate 174 may engage with, abut on, or be disposed adjacent to lower recess upper wall 100 (see FIG. 5) and side faces 182 and 184 may engage with, abut on, or be disposed adjacent to lower recess side walls 102 (see FIG. 5).

As illustrated in FIGS. 9 and 10, retention block body 176 may include front face 194, rear face 196, top face 198, and side faces 200 and 202. As illustrated in FIG. 11, front face 194 of retention block body may be generally coplanar with front face 182 of retention block base plate 174. Retention block 34 may have a retention block front face 204 formed of front face 182 of retention block base plate 174 and front face 194 of retention block body 176. In an assembled configuration of shroud retention system 30, retention block front face 204 may be configured to abut on rear face 158 of boss 32. Returning to FIG. 9, rear face 196 may be spaced apart from front face 194 and may be disposed generally perpendicular to longitudinal axis 60, top face 180 of retention block base plate 174, and top face 198 of retention block body 176. Rear face 196 of retention block body 176 may be generally coplanar with rear face 184 of retention block base plate 174. Thus, as illustrated in FIG. 11, retention block 34 may have a retention block rear face 206 formed of rear face 184 of retention block base plate 174 and rear face 196 of retention block body 176. As illustrated in FIG. 10, side faces 200 and 202 of retention block body 176 may be spaced apart from each other in the width (or Y direction) and may each be connected to top face 180 of boss base plate 170, and to top face 198 of retention block body 176.

Returning to FIG. 9, retention block 34 may include legs 210 and 212. Each of legs 210 and 212 may project from front face 194 of retention block body 176 (or retention block front face 204 of retention block 34) in a direction from rear face 196 of retention block body 176 (or retention block rear face 206 of retention block 34) towards the front face 194 of retention block body 176 (or retention block front face 204 of retention block 34) (e.g. −X direction or generally parallel to longitudinal axis 60). Leg 210 may be defined by front face 214, bottom face 216, top face 218, and side face 220. Bottom face 216 of leg 210 may be spaced apart vertically (e.g., in the +Z direction) relative to bottom face 178 (see FIG. 10) of retention block base plate 174. Top face 218 of leg 210 may be generally coplanar or generally parallel to top face 198 of retention block body 176. Side face 220 of leg 210 may be generally coplanar with side face 200 of retention block body 176. Similarly, leg 212 may be defined by front face 224, a bottom face 226 (see FIG. 11), top face 228, and side face 230 (see FIG. 11). As illustrated in FIG. 11, bottom face 226 of leg 212 may be spaced apart vertically (e.g., in the +Z direction) relative to bottom face 178 of retention block base plate 174. Top face 228 of leg 212 may be generally coplanar or generally parallel to top face 198 of retention block body 176. Side face 230 (see FIG. 11) of leg 212 may be generally coplanar with side face 202 (see FIG. 11) of retention block body 176.

Returning to FIG. 9, leg 210 may include channel 240 that may extend from bottom face 216 of leg 210 to top face 218 of leg 210 in a generally vertical direction (e.g. +Z direction). Channel 240 may be generally U-shaped and may define rail 244 that may have an inner face 246 disposed spaced apart from front face 194 of retention block base plate 174. Similarly, leg 212 may include channel 242 that may extend from bottom face 226 (see FIG. 11) of leg 212 to top face 228 (see FIG. 11) of leg 212 in a generally vertical direction (e.g. +Z direction). Channel 242 may be generally U-shaped and may define rail 248 that may have an inner face 250 disposed spaced apart from front face 194 of retention block body 176. Retention block 34 may be attached to boss 32. For example, rails 244 and 248 of legs 210 and 212, respectively, may be configured to be selectively received in channels 166 and 168, respectively, of boss 32.

Retention block 34 may include blind hole 260 that may extend from retention block rear face 206 (see FIG. 11) in a direction (e.g., −X direction) towards retention block front face 204 (see FIG. 11) into retention block 34. Blind hole 260 may be symmetrically disposed on retention block rear face 206 of retention block 34 so as to be concentric about longitudinal axis 60. Blind hole 260 may include blind hole base 262 (see FIG. 10) that may be disposed between retention block front face 204 and retention block rear face 206 of retention block 34. Blind hole base 262 may be generally planar and may be disposed generally perpendicular to longitudinal axis 60. Blind hole 260 may include counterbore 264 and nut retention portion 266. Counterbore 264 may extend from retention block rear face 206 (see FIG. 11) of retention block 34 in a direction (e.g., −X direction) towards retention block front face 204 (see FIG. 11) into retention block 34 to counterbore base 268 disposed at counterbore end 270 located between retention block front face 204 and blind hole base 262. Counterbore 264 may have an inner diameter that may be larger than a maximum inner width of nut retention portion 266 of blind hole 260. Nut retention portion 266 of blind hole 260 may be configured to slidably receive lock nut 42. Nut retention portion 266 may extend from counterbore end 270 to blind hole base 262. Nut retention portion 266 may have a generally polygonal shape. In one exemplary embodiment as illustrated in FIGS. 9 and 10, nut retention portion 266 may have a generally hexagonal shape that may be configured to engage with an outer face of lock nut 42 (see FIG. 2). For example, inner face 272 of blind hole 260 in nut retention portion 266 may include a plurality of generally planar faces 274 (e.g., 6 planar faces for a hexagonal shape). In contrast, inner surface 276 of counterbore 264 may have a generally cylindrical shape. As illustrated in FIG. 10, diameter "$D_1$" of inner surface 276 of counterbore 264 may be larger than a maximum width "$W_{13}$" between diametrically opposing vertices of nut retention portion 266.

As will be explained below, retention block 34 may be assembled to boss 33 (of FIGS. 30-31) in a manner similar to the assembly of retention block 34 with boss 32 (of FIGS. 6-8). However, unlike with boss 32, retention block front face 204 (see FIG. 11) may be configured to abut on rear face 152 of boss rear block 132 (see FIGS. 30-31), whereas cutout face 190 (see FIG. 11) may be configured to abut on surface 488 of extension 480 of boss 33 (see FIGS. 30-31).

Figure 12:
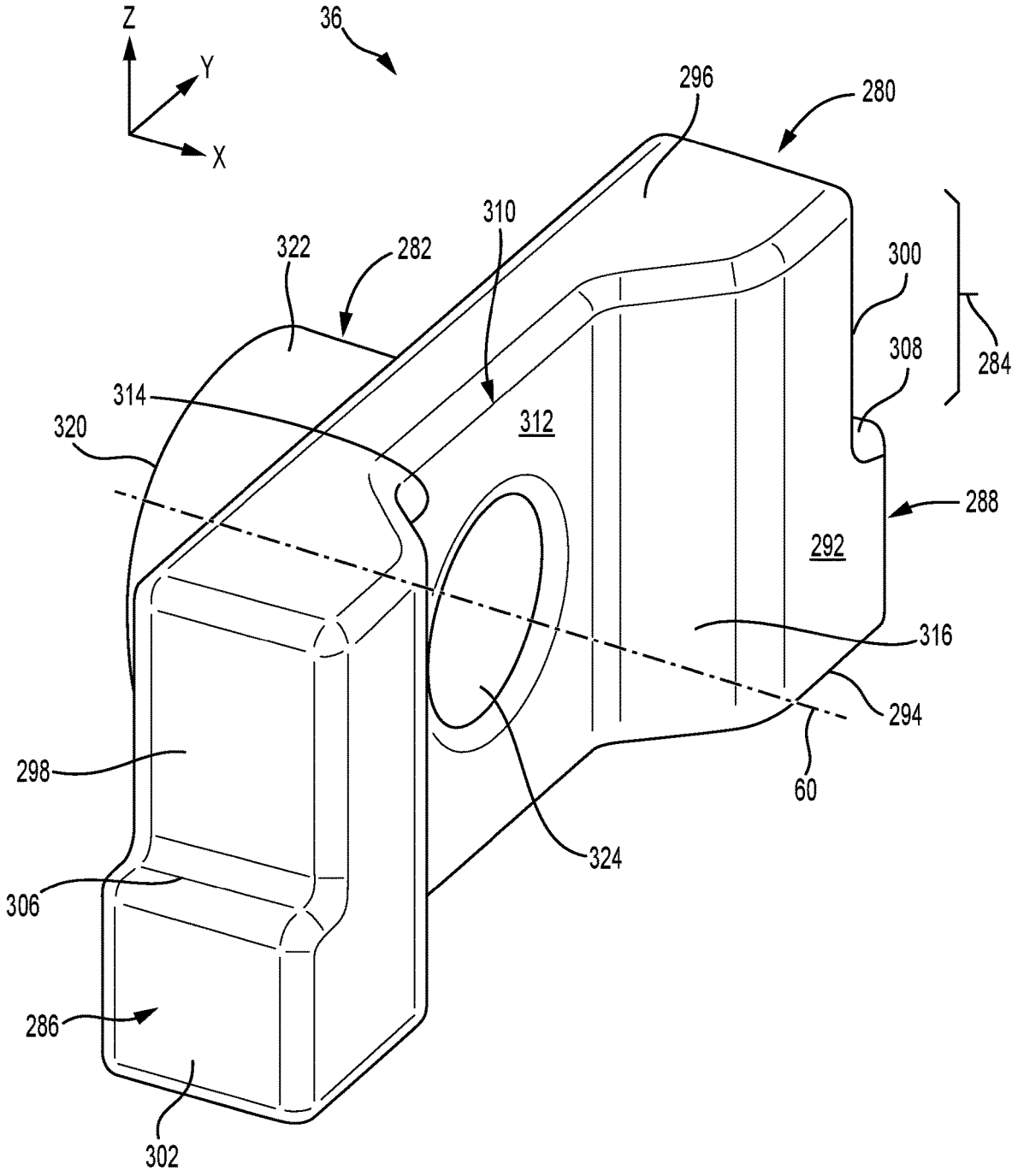
FIG. 12 is a perspective view of an exemplary plunger block for the shroud retention system of FIG. 2.
Figure 13:
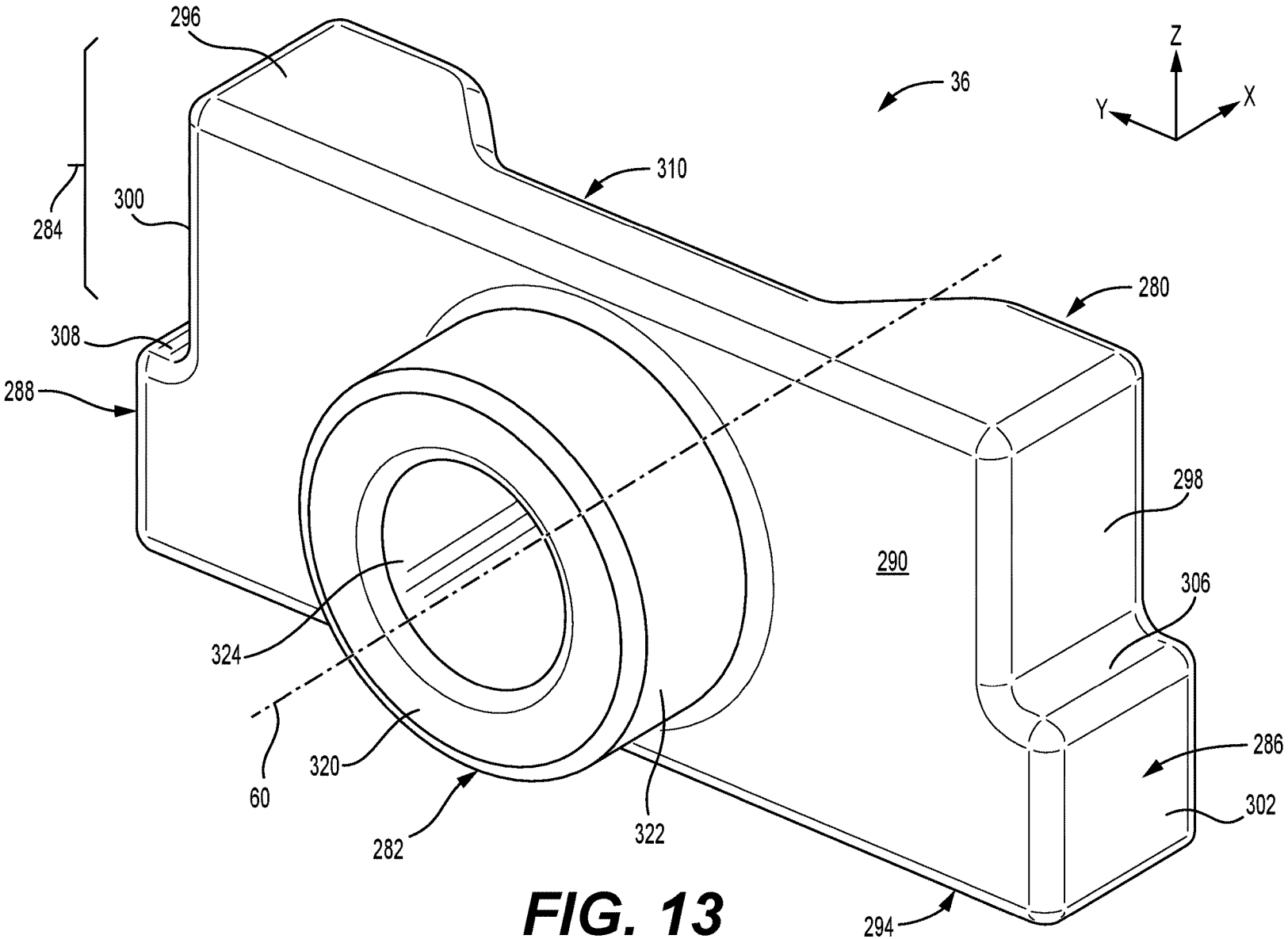
FIG. 13 is another perspective view of the exemplary plunger block of FIG. 12.
Figure 14:
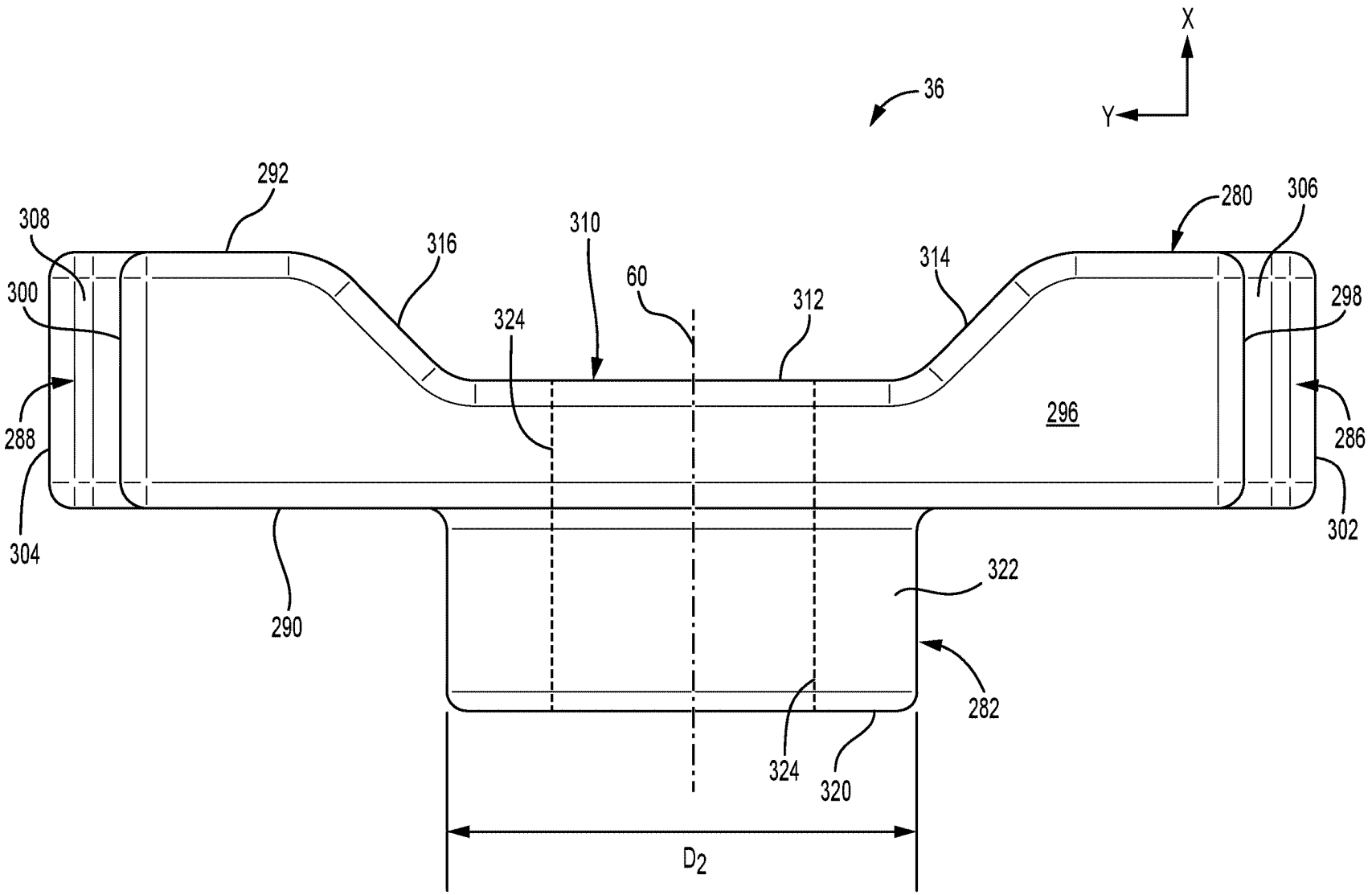
FIG. 14 is a top plan view of the exemplary plunger block of FIG. 12.

FIGS. 12-14 illustrate various views of an exemplary disclosed plunger block 36. For example, FIGS. 12 and 13 illustrate perspective views and FIG. 14 illustrates top plan view (looking in the −Z direction) of plunger block 36. Plunger block 36 may include plunger plate 280 and plunger 282. Plunger plate 280 may include plunger plate body 284 and plunger rails 286 and 288. Plunger plate body 284 may include plunger plate front face 290 (see FIG. 13) and plunger plate rear face 292 (see FIG. 12) disposed opposite plunger plate front face 290. Plunger plate rear face 292 may be spaced apart from plunger plate front face 290 in a direction parallel to longitudinal axis 60 (e.g., X direction). Plunger plate body 284 may include plunger plate bottom face 294 (see FIG. 13) that may extend between and may be connected to plunger plate front face 290 and plunger plate rear face 292. Plunger plate bottom face 294 may be configured to abut on upper surface 92 (see FIGS. 3 and 5) of base edge 20 of work tool 10 (see FIG. 3). Plunger plate body 284 may include plunger plate top face 296 that may extend between and may be connected to plunger plate front face 290 and plunger plate rear face 292. Plunger plate top face 296 may be disposed opposite plunger plate bottom face 294. Plunger plate rear face 292 may be disposed generally orthogonal to plunger plate bottom face 294, plunger plate top face 296, and longitudinal axis 60.

Plunger plate body 284 may include plunger plate side walls 298 and 300. Plunger plate side walls 298 and 300 each may extend between and may be connected to plunger plate top face 296 and plunger rails 286 and 288, respectively. Plunger plate side walls 298 and 300 each may also extend between and may be connected to plunger plate front face 290 and plunger plate rear face 292. Plunger plate side walls 298 and 300 may be disposed generally orthogonal to plunger plate front face 290, plunger plate rear face 292, plunger plate bottom face 294, and plunger plate top face 296.

Plunger rail 286 may extend outward from plunger plate body 284 in a direction orthogonal to plunger plate side wall 298 (e.g., in −Y direction) to plunger rail side face 302 that may be generally parallel to and spaced apart from plunger plate side wall 298. Similarly, rail 288 may extend outward from plunger plate body 284 in a direction orthogonal to plunger plate side wall 300 (e.g., in +Y direction) to plunger rail side face 304 (see FIG. 14) that may be generally parallel to and spaced apart from plunger plate side wall 300. Plunger rails 286 and 288 may be configured to be slidingly received in lower recess 96 of shroud 22 (see FIG. 5) such that top faces 306 and 308 of plunger rails 286 and 288, respectively, may engage with, abut on, or be disposed adjacent to lower recess upper wall 100 (see FIG. 5) and plunger rail side faces 302 and 304 may engage with, abut on, or be disposed adjacent to lower recess side walls 102 (see FIG. 5).

Plunger plate 280 may include plunger plate channel 310 that may extend from plunger plate top face 296 to plunger plate bottom face 294 (see FIG. 13). In one exemplary embodiment as illustrated in FIG. 12, plunger plate channel 310 may have a generally uniform trapezoidal cross-section in a plane perpendicular to the Z direction. As illustrated in FIGS. 12 and 14, plunger plate channel 310 may include plunger plate channel base 312 and plunger plate channel sidewalls 314 and 316. In one exemplary embodiment as illustrated in FIGS. 12 and 14, plunger plate channel base 312 may be disposed between plunger plate front face 290 and plunger plate rear face 292 and may be generally perpendicular to longitudinal axis 60. Plunger plate channel sidewalls 314 and 316 may extend between plunger plate channel base 312 and plunger plate rear face 292. As illustrated in FIGS. 12-14, plunger plate channel sidewalls 314 and 316 may be generally inclined relative to plunger plate channel base 312, plunger plate rear face 292, and longitudinal axis 60. The angles of inclination of plunger plate channel sidewalls 314 and 316 relative to, for example, longitudinal axis 60 may be equal or unequal. As also illustrated in FIGS. 12-14, a thickness of plunger plate 280 between plunger plate front face 290 and plunger plate channel base 312 may be smaller than a thickness of plunger plate 280 between plunger plate front face 290 and plunger plate rear face 292.

Plunger 282 may extend outward from plunger plate front face 290 (see FIGS. 13, 14) in a direction from plunger plate rear face 292 towards plunger plate front face 290 (e.g., in −X direction). Plunger 282 may include plunger front face 320 that may be disposed generally parallel to and spaced apart from plunger plate front face 290. Plunger 282 may also have a generally cylindrical outer surface 322 extending from plunger plate front face 290 to plunger front face 320. Plunger outer surface 322 may have a diameter $D_2$ that may be smaller than diameter $D_1$ (see FIG. 10) of counterbore 264 such that plunger 282 may be slidingly received in counterbore 264. Thus, plunger block 36 may be slidably connected to retention block 34 and may be configured to slidably move relative to retention block 34 when plunger 282 slidingly moves within counterbore 264 of retention block 34.

Figure 32:
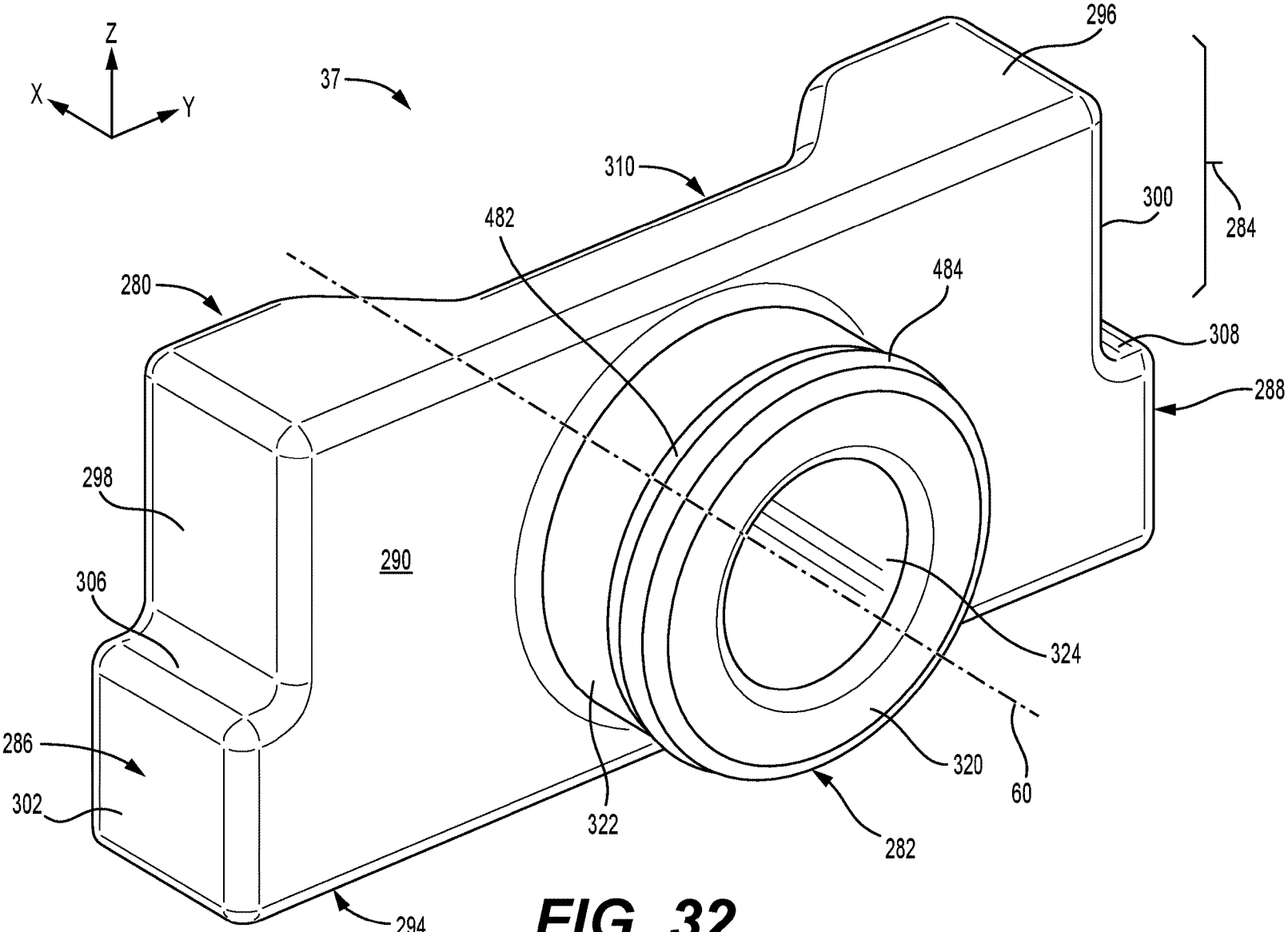
FIG. 32 is a perspective view of another exemplary plunger block for the shroud retention system of FIG. 2.
Figure 33:
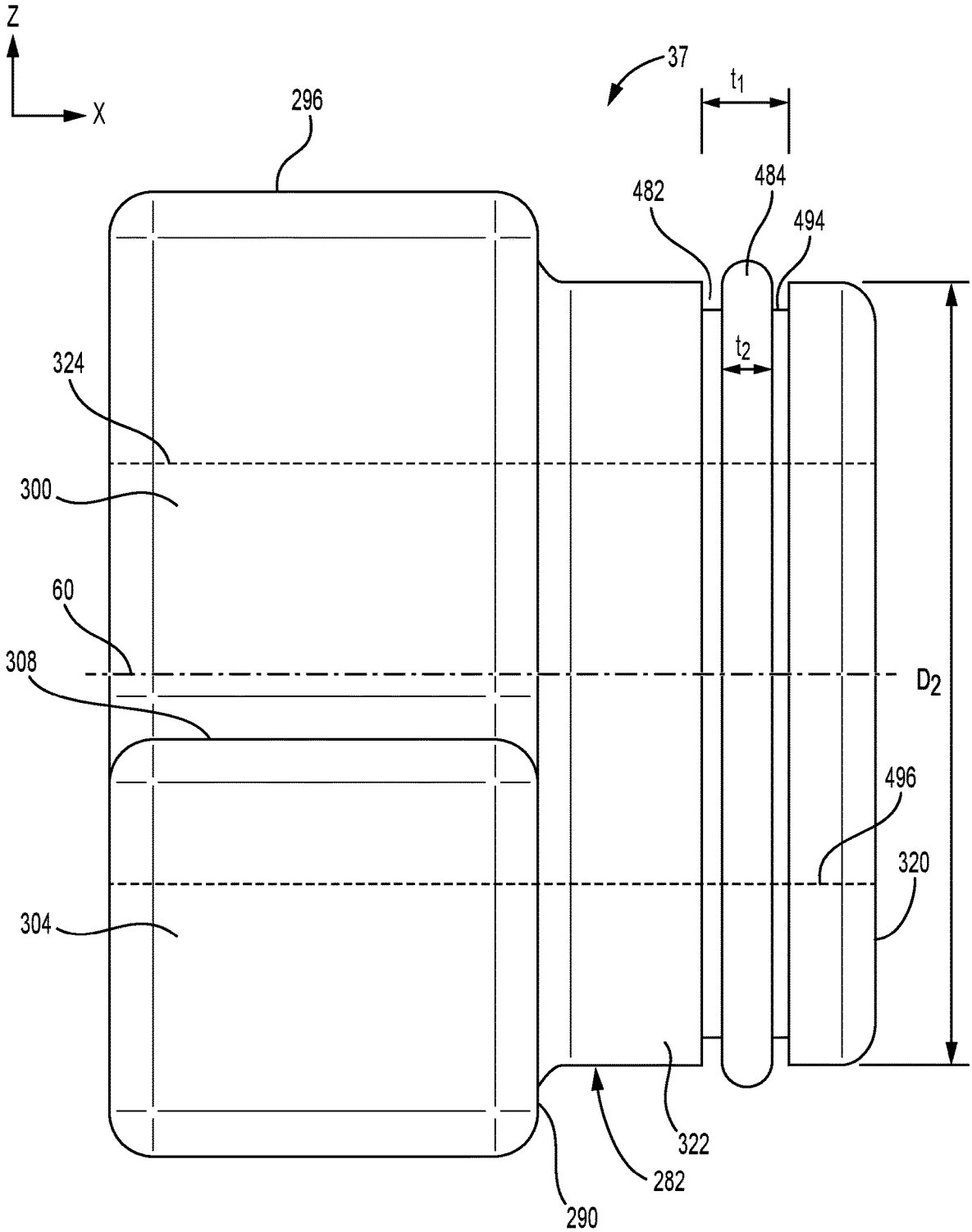
FIG. 33 is a side elevation view of the exemplary plunger block of FIG. 32.

FIG. 32 illustrates a perspective view of another exemplary plunger block 37 for shroud retention system 30. FIG. 33 illustrates a side elevation view of exemplary plunger block 37 of FIG. 32. Many of the features of plunger block 37 illustrated in FIGS. 32 and 33 are similar to the features of plunger block 36 as illustrated and described above with respect to FIGS. 12-14. Accordingly, a description of those features will not be repeated here, rather only features that are different in plunger block 37 of FIGS. 32 and 33 compared to plunger block 36 of FIGS. 12-14 are described below.

In some exemplary embodiments as illustrated in FIGS. 32 and 33, plunger 282 of plunger block 37 may include a channel 482 (or O-Ring groove 482) on outer surface 322 of plunger 282. Channel 482 may be positioned on outer surface 322 of plunger 282 anywhere between plunger front face 320 and plunger plate front face 290. Channel 482 may extend radially inward into a body of plunger 282 from outer surface 322 such that bottom surface 494 of channel 482 may be located between outer surface 322 of plunger 282 and inner surface 496 of plunger thru hole 324. As illustrated in FIGS. 32 and 33, channel 482 may form a circumferential recess configured to receive a sealing member 484. In some exemplary embodiments, sealing member 484 may be in the form of an O-Ring 484. As also illustrated in FIG. 31, a width "$t_1$" of channel 482 may be about equal to or slightly larger than width "$t_2$" of sealing member 484 to allow sealing member 484 to be snugly received in channel 482. As will be explained below, in the assembled configuration, sealing member 484 may come into contact with counterbore 264 in retention block 34. In that configuration, sealing member 484 may be compressed allowing it to expand and partially or completely fill width $t_1$ of channel 482. In the exemplary embodiment illustrated in FIG. 31, channel 482 is shown as having a generally rectangular cross-section. It will be understood however, that this is exemplary and non-limiting, and channel 482 may be semi-circular or may have any other shape suitable for accommodating sealing member 484. Furthermore, although only one channel 482 and one sealing member 484 is illustrated in FIGS. 32 and 33, it will be understood that there may be more than one channel 482 and sealing member 484 disposed on outer surface 322 of plunger 282.

Figure 15:
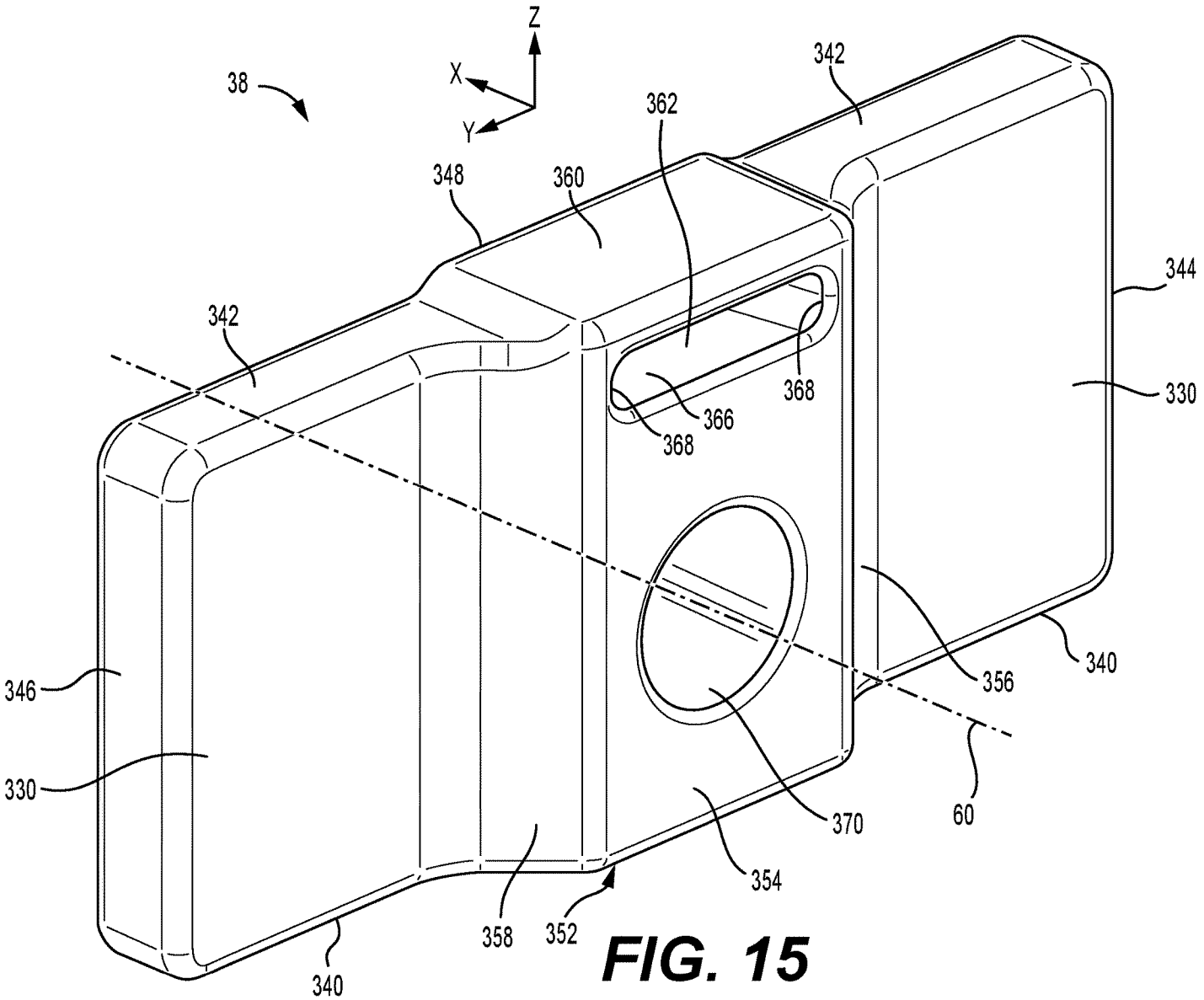
FIG. 15 is a perspective view of an exemplary retention plate for the shroud retention system of FIG. 2.
Figure 16:
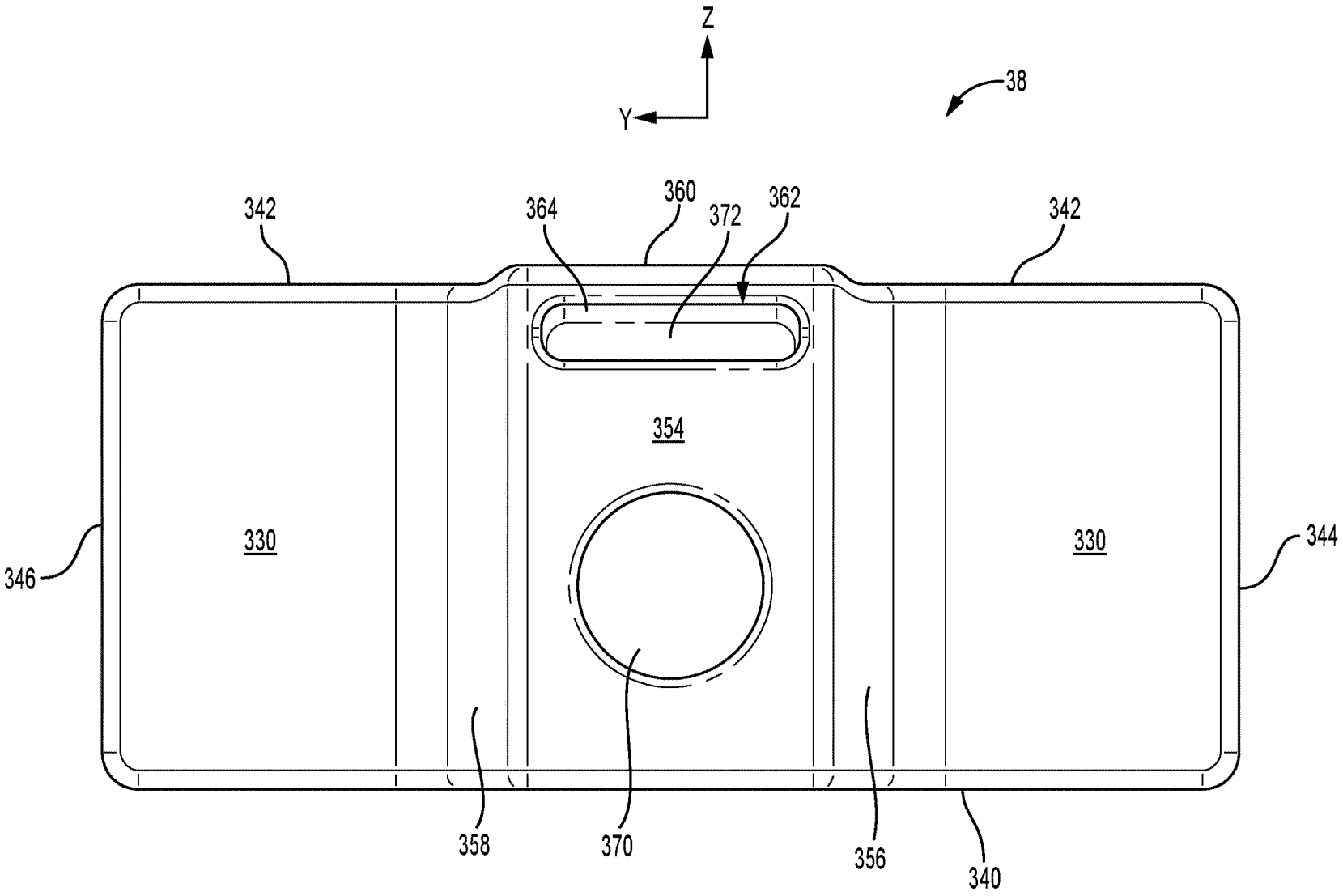
FIG. 16 is a front elevation view of the exemplary retention plate of FIG. 15.
Figure 17:
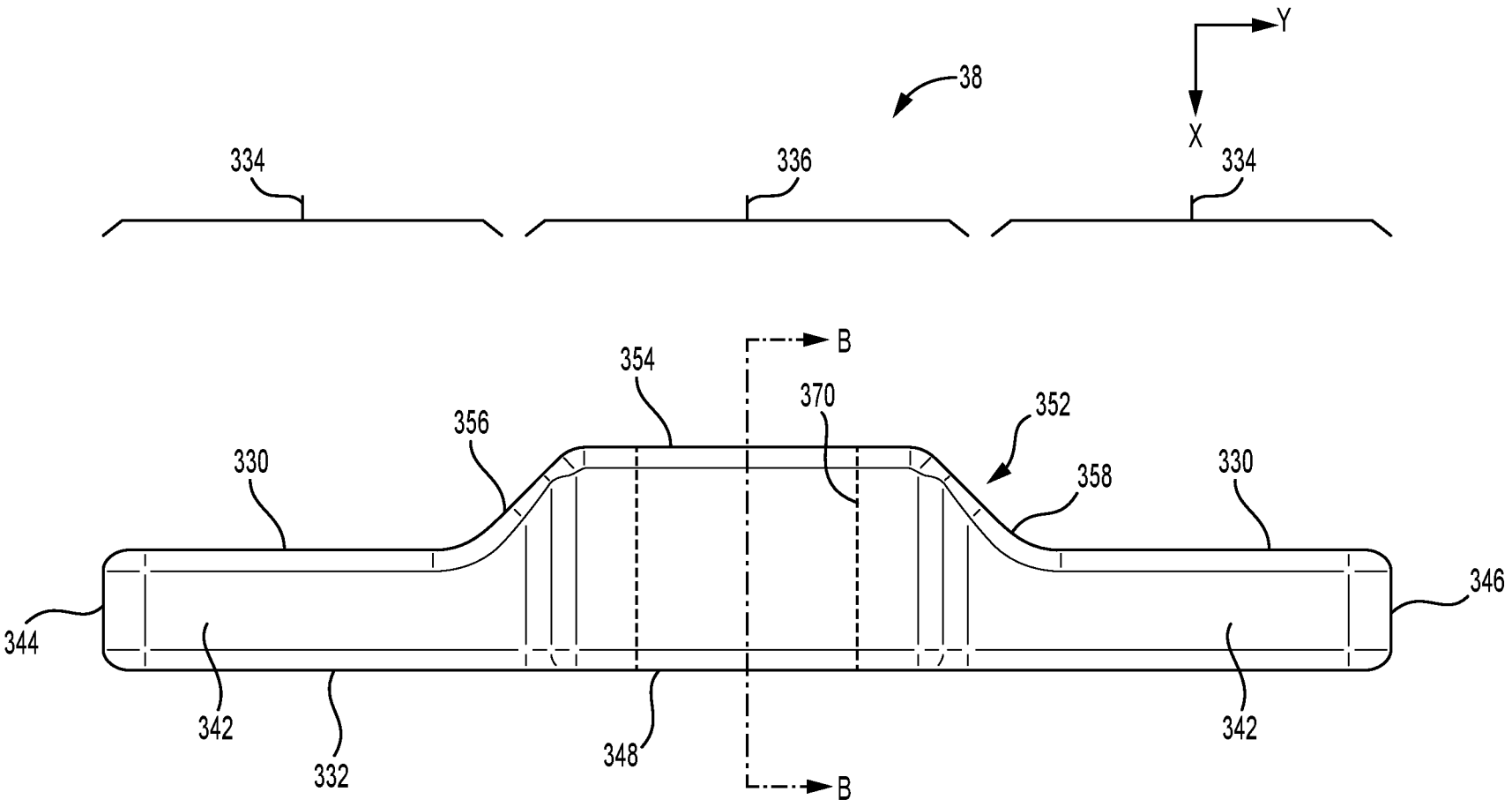
FIG. 17 is a top plan view of the exemplary retention plate of FIG. 15.

FIGS. 15-17 illustrate various views of an exemplary disclosed retainer plate 38. For example, FIG. 15 illustrates a perspective view, FIG. 16 front elevation view (looking in the +X direction), and FIG. 17 illustrates a top plan view (looking in the −Z direction) of retainer plate 38. Retainer plate 38 may have a retainer plate front face 330 disposed opposite retainer plate rear face 332 (see FIG. 17). Retainer plate front and rear faces 330 and 332 may be disposed generally parallel to and spaced apart from each other. Retainer plate front and rear faces 330 and 332 may also be disposed generally perpendicular to longitudinal axis 60.

As illustrated in FIG. 17, retainer plate 38 may include retainer portion 334 and pull out portion 336. Retainer portion 334 may include retainer plate bottom face 340 (see FIG. 15), retainer plate top face 342, and retainer plate side faces 344 and 346. Retainer plate bottom face 340 may extend from retainer plate front face 330 to retainer plate rear face 332. Retainer plate bottom face 340 may be disposed generally orthogonal to and may be connected to retainer plate front and rear faces 330 and 332. Retainer plate top face 342 may extend from retainer plate front face 330 to retainer plate rear face 332. Retainer plate top face 342 may be disposed generally orthogonal to and may be connected to retainer plate front and rear faces 330 and 332. Retainer plate side faces 344 and 346 may each extend from retainer plate front face 330 to retainer plate rear face 332 and between retainer plate bottom face 340 and retainer plate top face 342. In one exemplary embodiment as illustrated in FIGS. 15-17, retainer plate side faces 344 and 346 may be disposed generally orthogonal to and may be connected to retainer plate front and rear faces 330 and 332, and retainer plate bottom and top faces 340 and 342.

Pull out portion 336 may be disposed symmetrically about longitudinal axis 60. That is, widths of pull out portion 336 disposed on either side of longitudinal axis 60 (e.g., along the +Y and −Y directions) may be about equal. Pull out portion 336 may include pull out portion rear face 348 that may be generally coplanar with retainer plate rear face 332. Pull out portion 336 may include projection 352 that may protrude outward from retainer plate front face 330 along the longitudinal axis 60 (e.g., in the −X direction). Projection 352 may include projection front face 354 that may be disposed generally parallel to and spaced apart from retainer plate front face 330. In one exemplary embodiment as illustrated in FIGS. 15-17, projection front face 354 may be disposed generally perpendicular to longitudinal axis 60. Projection 352 may also include projection side faces 356 and 358 that may each extend between retainer plate front face 330 and projection front face 354. Projection side faces 356 and 358 may each be inclined relative to retainer plate front face 330, projection front face 354, and longitudinal axis 60. The angles of inclination of projection side faces 356 and 358 relative to, for example, longitudinal axis 60 may be equal or unequal. Pull out portion 336 may include pull out portion top face 360 that may be disposed generally parallel to and spaced apart from retainer plate top face 342 in the +Z direction. Pull out portion 336 may have a thickness between retainer plate rear face 332 and projection front face 354 that may be larger than a thickness of retainer portion 334 between retainer plate rear face 332 and retainer plate front face 330. Projection 352 of retainer plate 38 may be configured to be received in plunger plate channel 310 (see FIGS. 13 and 14) such that projection front face 354 may abut on plunger plate channel base 312 (see FIGS. 13 and 14) and retainer plate front face 330 may abut on plunger plate rear face 292 (see FIGS. 13 and 14). An angle of inclination of plunger plate channel sidewall 314 (see FIGS. 13 and 14) relative to, for example, longitudinal axis 60 may be different from an angle of inclination of projection side face 356 relative to longitudinal axis 60. Similarly, an angle of inclination of plunger plate channel sidewall 316 (see FIGS. 13 and 14) relative to, for example, longitudinal axis 60 may be different from an angle of inclination of projection side face 358 relative to longitudinal axis 60. Retainer plate 38 may be configured to engage with and abut on plunger block 36. For example, projection front face 354 may abut on plunger plate channel base 312 (see FIGS. 13 and 14) and retainer plate front face 330 may abut on plunger plate rear face 292. In an assembled configuration, when projection front face 354 abuts on plunger plate channel base 312 (see FIGS. 13 and 14) and retainer plate front face 330 abuts on plunger plate rear face 292 (see FIGS. 13 and 14), there may be a gap 472 (see FIG. 28) between plunger plate channel sidewall 314 and projection side face 356 (see FIG. 28). Similarly, in an assembled configuration, when projection front face 354 abuts on plunger plate channel base 312 and retainer plate front face 330 abuts on plunger plate rear face 292, there may be a gap 472 (see FIG. 28) between plunger plate channel sidewall 316 and projection side face 358 (see FIG. 28).

Pull out portion 236 may include pry bar recess 362 that may extend from projection front face 354 part way through a thickness of projection 352 towards pull out portion rear face 348. A depth of pry bar recess 362 (e.g., in the +X direction) may be smaller than a thickness of pull out portion 336 (see FIG. 17) between projection front face 354 and pull out portion rear face 348. As also illustrated in FIG. 16, pry bar recess 362 may include slot end wall 372 that may extend between slot upper face 364 and slot lower face 366 (see FIG. 15) and between slot side faces 368 (see FIG. 15). Slot end wall 372 may be disposed between projection front face 354 and pull out portion rear face 348 (see FIG. 15). Pry bar recess 362 may have a generally rectangular shape and may be disposed symmetrically about longitudinal axis 60. That is, widths of pry bar recess 362 disposed on either side of longitudinal axis 60 (e.g., along the +Y and −Y directions) may be about equal. In some exemplary embodiments, pry bar recess 362 may have a square, elliptical, and/or any other shape. Pry bar recess 362 may include slot upper face 364 (see FIG. 16), slot lower face 366 (see FIG. 15), and slot side faces 368 (see FIG. 15). Pry bar recess 362 may be generally inclined relative to retainer plate bottom face 340, pull out portion top face 360, and longitudinal axis 60 such that slot upper face 364 and slot lower face 366 may also be inclined relative to retainer plate bottom face 340, pull out portion top face 360, and longitudinal axis 60.

Retainer plate 38 may also include retainer plate thru hole 370 that may extend through pull out portion 336 from pull out portion rear face 348 to projection front face 354 through an entire thickness of pull out portion 336. Retainer plate thru hole 370 may be concentric with plunger thru hole 324 of plunger block 36, and may be configured to slidingly receive retention bolt 44.

Figure 34:
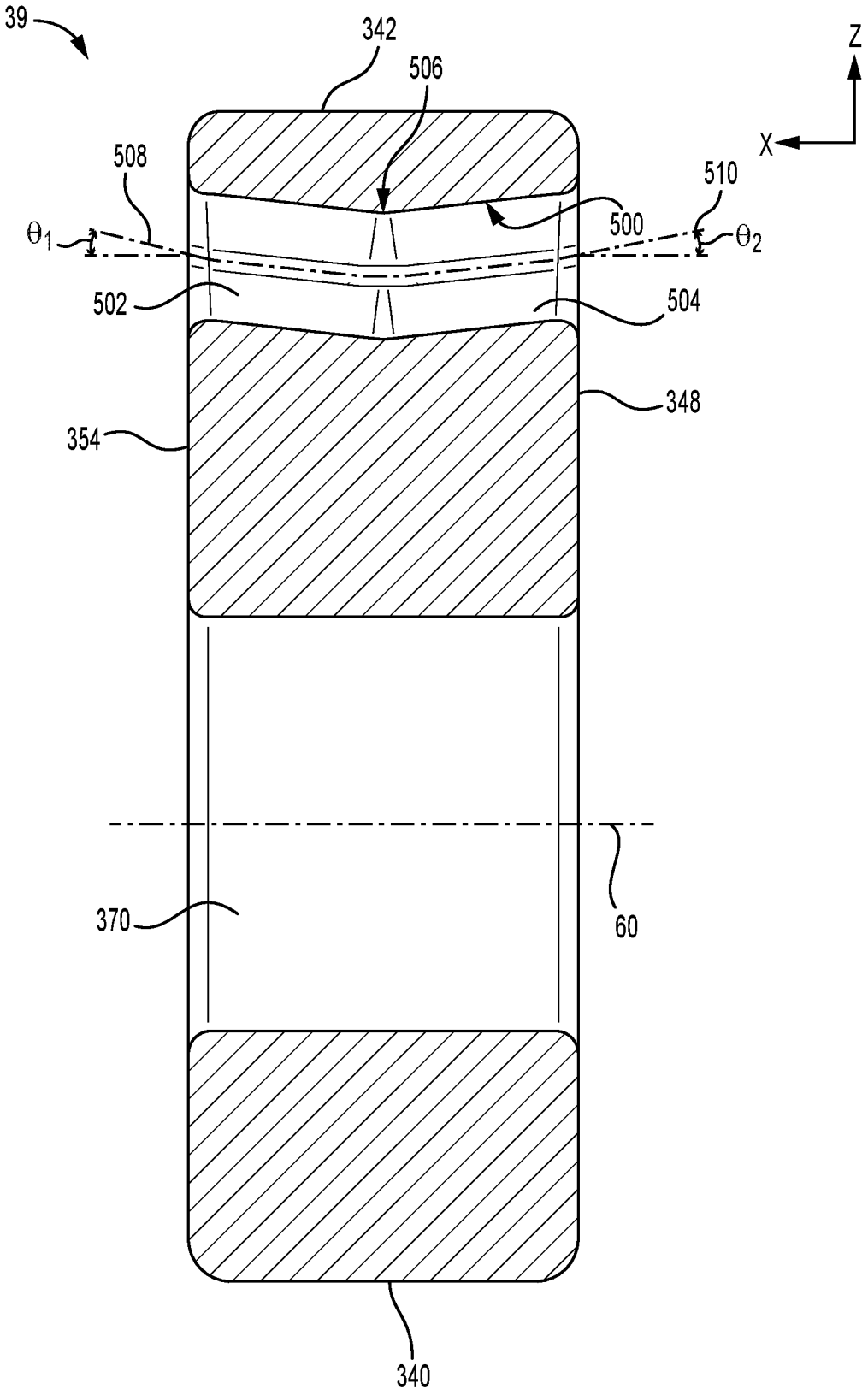
FIG. 34 is a vertical cross-sectional view taken along line B-B in FIG. 17 showing another exemplary embodiment of a retention plate for the shroud retention system of FIG. 2.

FIG. 34 illustrates a vertical cross-sectional view taken along line B-B in FIG. 17, showing an exemplary retainer plate 39 for shroud retention system 30. Many of the features of retainer plate 39 illustrated in FIG. 34 are similar to the features of retainer plate 38 as illustrated and described above with respect to FIGS. 15-17. Accordingly, a description of those features will not be repeated here, rather only features that are different in retainer plate 39 of FIG. 34 as compared to retainer plate 38 of FIGS. 15-17 are described below.

As illustrated in FIG. 34, unlike pry bar recess 362 of retainer plate 38 of FIGS. 15-17, retainer plate 39 may include pry bar recess 500 that may form a thru hole through a thickness of projection 352. For example, as illustrated in FIG. 34, pry bar recess 500 may extend through a thickness of pull out portion 336. As also illustrated in FIG. 34, pry bar recess 500 may include slot portion 502 and slot portion 504 that may each be inclined in a vertical (e.g., −Z direction) relative to direction X or longitudinal axis 60 as pry bar recess 500 extends inwards from pull out portion rear face 348 and projection front face 354. Slot portion 502 and slot portion 504 may intersect at intermediate slot location 506. Slot portion 502 may extend from projection front face 354 to intermediate slot location 506 that may be disposed between projection front face 354 and pull out portion rear face 348. Similarly, slot portion 504 may extend from pull out portion rear face 348 to intermediate slot location 506. In one exemplary embodiment as illustrated in FIG. 34, intermediate slot location 506 may be disposed midway between projection front face 354 and pull out portion rear face 348. It will be understood, however, that intermediate slot location 506 may be disposed anywhere between projection front face 354 and pull out portion rear face 348 such that slot portions 502 and 504 may have unequal lengths. As also illustrated in FIG. 34, slot portion 502 may have a longitudinal axis 508 that may be inclined relative to direction +X and longitudinal axis 60 by an acute angle "$\theta_1$" measured in a counterclockwise direction relative to direction +X. Similarly, slot portion 504 may have a longitudinal axis 510 that may be inclined relative to direction-X and longitudinal axis 60 by an acute angle "$\theta_2$" measured in a clockwise direction relative to direction-X. Angles $\theta_1$ and $\theta_2$ may be equal or unequal and longitudinal axis 508 and 510 of slot portions 502 an 504 may be inclined relative to each other at an obtuse angle In some exemplary embodiments, slot portions 502 and 504 may not be inclined relative to the +X or −X directions or longitudinal axis 60 so that angles $\theta_1$ and $\theta_2$ may be about equal to zero. Pry bar recess 500 may allow an operator to insert a pry bar or other tool from either side (front or rear) of retainer plate 39 during disassembly of shroud 22 from base edge 20 of work tool 10.

Figure 18:
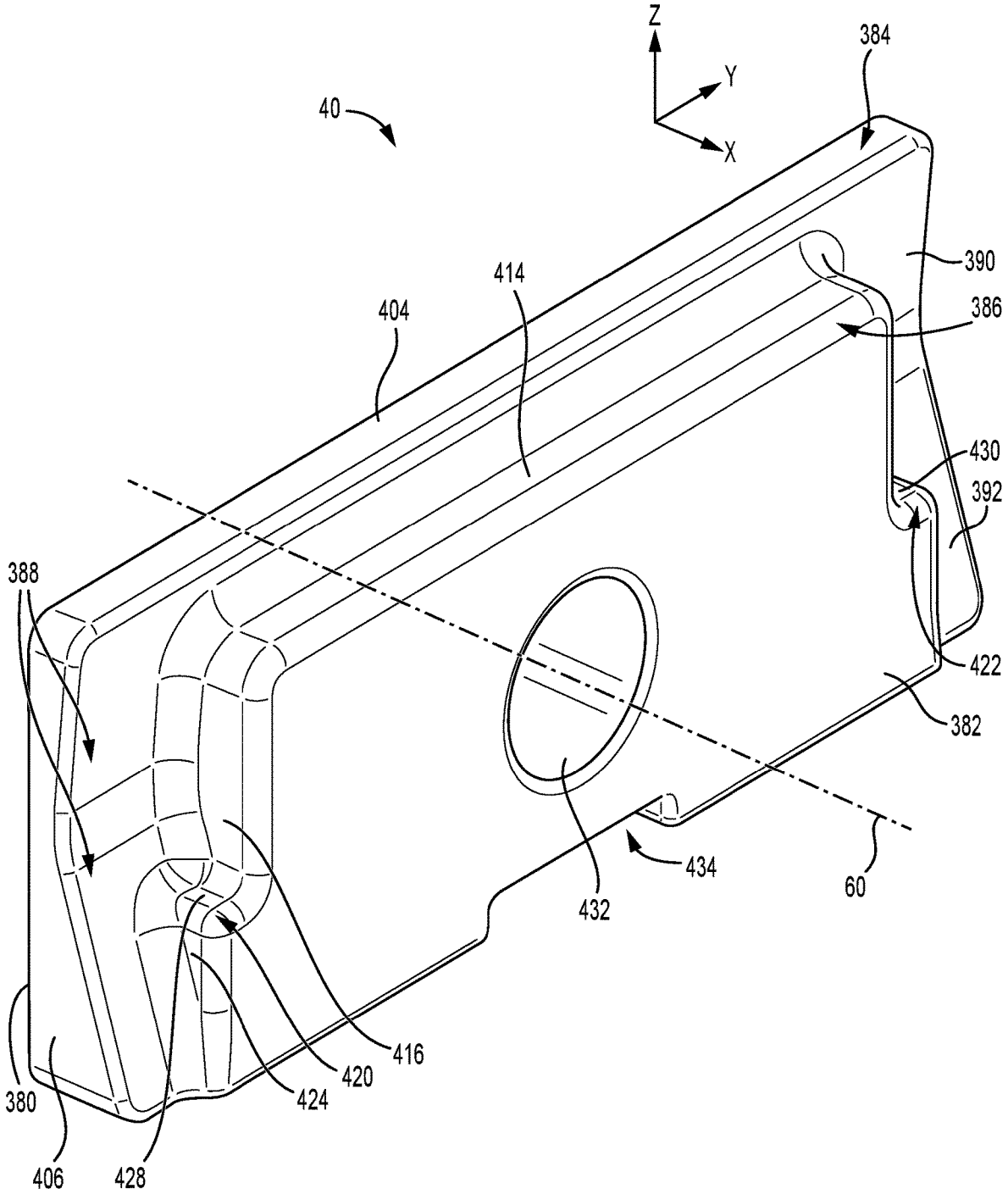
FIG. 18 is a perspective view of an exemplary shim for the shroud retention system of FIG. 2.
Figure 19:
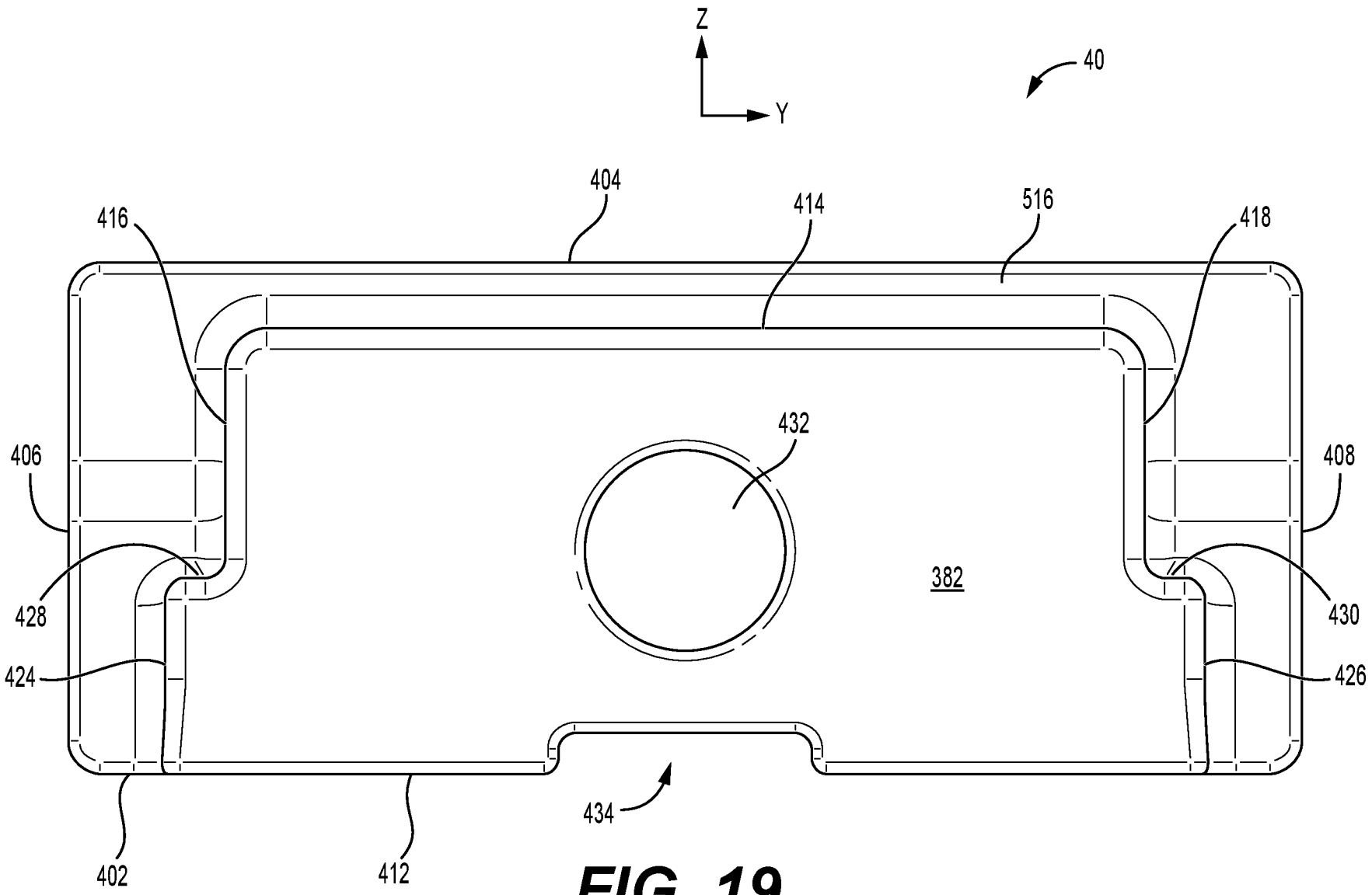
FIG. 19 is a rear elevation view of the exemplary shim of FIG. 18.
Figure 20:
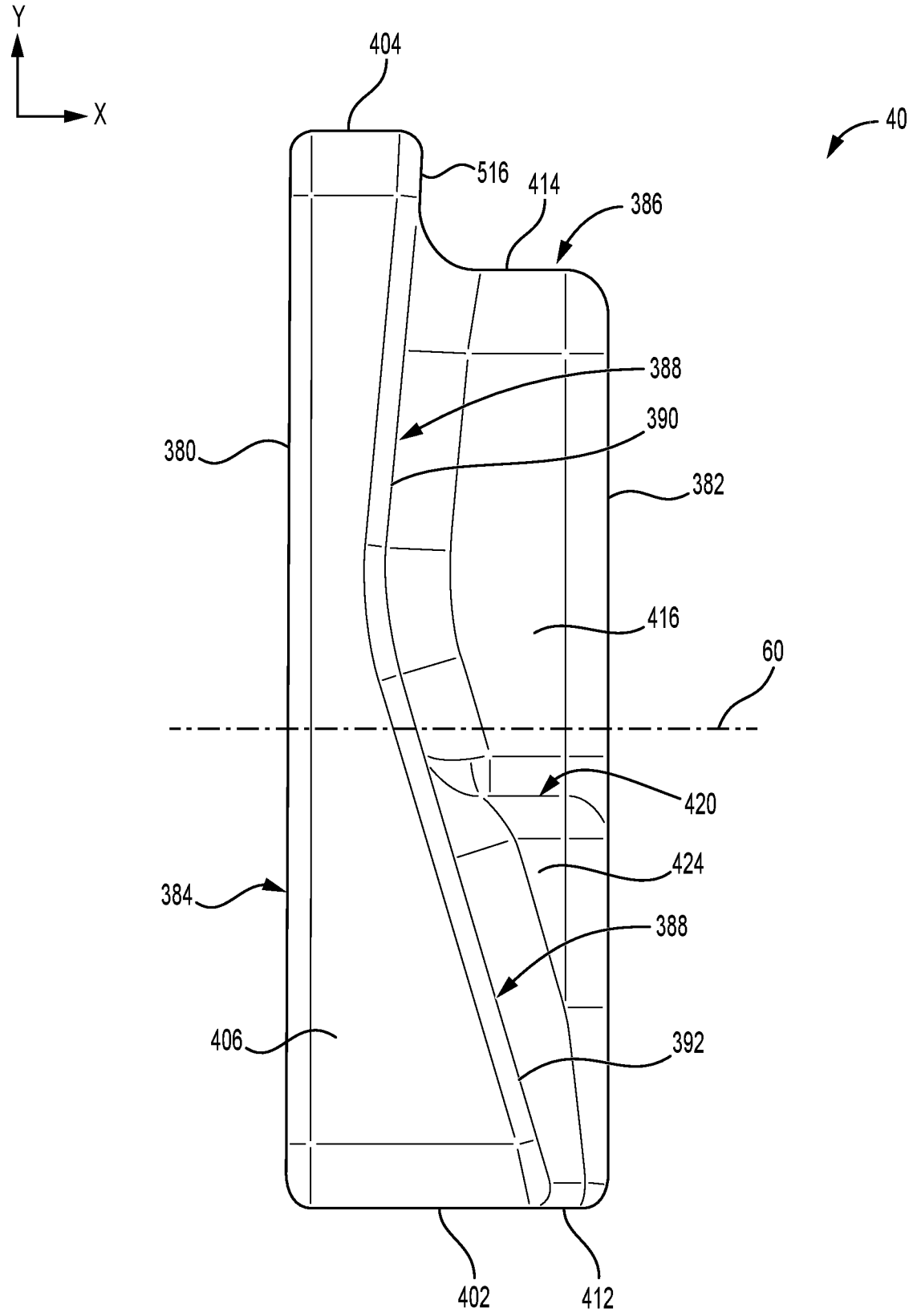
FIG. 20 is a side elevation view of the exemplary shim of FIG. 19.

FIGS. 18-20 illustrate various views of an exemplary disclosed shim 40. For example, FIG. 18 illustrates a perspective view, FIG. 19 illustrates a rear elevation view (e.g., looking in the −X direction), and FIG. 20 illustrates a side elevation view (looking in the +Y direction) of shim 40. Shim 40 may include shim front face 380 configured to engage with retention block 34 and shim rear face 382 configured to engage with one or more inner faces of shroud 22. Shim rear face 382 may be disposed generally parallel to and spaced apart from shim front face 380. Shim 40 may include shim front portion 384 and shim rear portion 386. Shim front portion 384 may be configured to abut on retainer plate rear face 332 (see FIG. 17) and pull out portion rear face 348 (see FIG. 17). Shim rear portion 386 may be configured to engage with one or more shroud inner walls 106, 108 (see FIG. 3) of shroud 22. Shim front portion 384 of shim 40 may include shim front face 380 and shroud contact rear face 388 that may be disposed spaced apart from shim front face 380. Shroud contact rear face 388 may be disposed between shim front face 380 and shim rear face 382. Shim front face 380 may be disposed generally perpendicular to longitudinal axis 60 and may be disposed generally parallel to retainer plate rear face 332 (see FIG. 17) and pull out portion rear face 348 (see FIG. 17). Shroud contact rear face 388 of shim 40 may include one or more inclined faces 390, 392 that may be inclined relative to shim front face 380 and longitudinal axis 60. The angles of inclination of the one or more faces 390, 392 of shroud contact rear face 388 of shim 40 may be selected such that the one or more faces 390 and 392 may abut on corresponding one or more shroud inner walls 106, 108 of shroud 22.

Shim front portion 384 may include shim front portion bottom face 402 (see FIG. 19), shim front portion top face 404, and shim front portion side faces 406 and 408 (see FIG. 19). Shim front portion bottom face 402 may be disposed generally orthogonal to shim front face 380 and may extend from shim front face 380 to shroud contact rear face 388. Shim front portion bottom face 402 may be connected to shim front face 380 and shroud contact rear face 388. Shim front portion top face 404 may be disposed generally orthogonal to shim front face 380 and may extend from shim front face 380 to shroud contact rear face 388. Shim front portion top face 404 may be connected to shim front face 380 and shroud contact rear face 388. Shim front portion side faces 406 and 408 may each extend from shim front face 380 to shroud contact rear face 388. Shim front portion side faces 406 and 408 may be disposed generally orthogonal to shim front face 380 and to shim front bottom and top faces 402 and 404. Shim front portion side faces 406 and 406 may be connected to shim front face 380, shroud contact rear face 388, shim front portion bottom face 402, and shim front portion top face 404.

Shim rear portion 386 may extend from shroud contact rear face 388 of shim front portion 384 in a direction from shim front face 380 towards shim rear face 382 (e.g., in a +X direction). Shim rear portion 386 may include shim rear portion bottom face 412 (see FIG. 19), shim rear portion top face 414, and shim rear portion side faces 416 and 418. Shim rear portion bottom face 412 may be disposed generally orthogonal to shim front face 380 and generally parallel to shim front portion top face 404 and may extend from shroud contact rear face 388 to shim rear face 382. Shim rear portion top face 414 may be disposed generally orthogonal to shim front face 380 and generally parallel to shim front portion bottom face 402 and may extend from shroud contact rear face 388 to shim rear face 382. Shim rear portion side faces 416 and 418 may each extend from shroud contact rear face 388 to shim rear face 382. Shim rear portion side faces 416 and 418 may be disposed generally orthogonal to shim front face 380, shim rear face 382 and to shim rear portion bottom and top faces 412 and 414. Shim rear portion side faces 416 and 418 may extend from shim rear portion top face 414 to shim rear portion rails 420 and 422, respectively.

Shim rear portion rail 420 may extend outward from shim rear portion side face 416 in a direction orthogonal to shim rear portion side face 416 (e.g., in −Y direction) to shim rear portion rail side face 424 that may be generally parallel to and spaced apart from shim rear portion side face 416. Similarly, shim rear portion rail 422 may extend outward from shim rear portion side face 418 in a direction orthogonal to plunger plate side wall 300 (e.g., in +Y direction) to shim rear portion rail side face 426 (see FIG. 19) that may be generally parallel to and spaced apart from shim rear portion side face 418. Shim rear portion rails 420 and 422 may be configured to be slidingly received in lower recess 96 of shroud 22 (see FIG. 5) such that top faces 428 and 430 of shim rear portion rails 420 and 422, respectively, may engage with, abut on, or be disposed adjacent to lower recess upper wall 100 (see FIG. 5) and shim rear portion rail side faces 424 and 426 may engage with, abut on, or be disposed adjacent to lower recess side walls 102 (see FIG. 5).

Shim 40 may include shim thru hole 432 that may extend through shim 40 from shim front face 380 to shim rear face 382 through an entire thickness of shim 40. Shim thru hole 432 may be concentric with plunger thru hole 324 of plunger block 36 and retainer plate thru hole 370, and may be configured to slidingly receive retention fastener 44. Shim 40 may also include pry bar slot 434 disposed on shim front portion bottom face 402 and shim rear portion bottom face 412. Pry bar slot 434 may extend through shim 40 from shim front face 380 to shim rear face 382 through an entire thickness of shim 40. Pry bar slot 434 may extend from shim front portion bottom face 402 and shim rear portion bottom face 412 into shim 40 in a direction from shim front portion bottom face 402 and shim rear portion bottom face 412 towards shim front portion top face 404 and shim rear portion top face 414, respectively (e.g., in +Z direction). In one exemplary embodiment as illustrated in FIGS. 18 and 19, pry bar slot 434 may be disposed symmetrically about longitudinal axis 60. That is, widths of pry bar slot 434 disposed on either side of longitudinal axis 60 (e.g., in the +Y and −Y directions) may be about equal. In some exemplary embodiments, pry bar slot 434 may have a square, elliptical, and/or any other shape.

Figure 35:
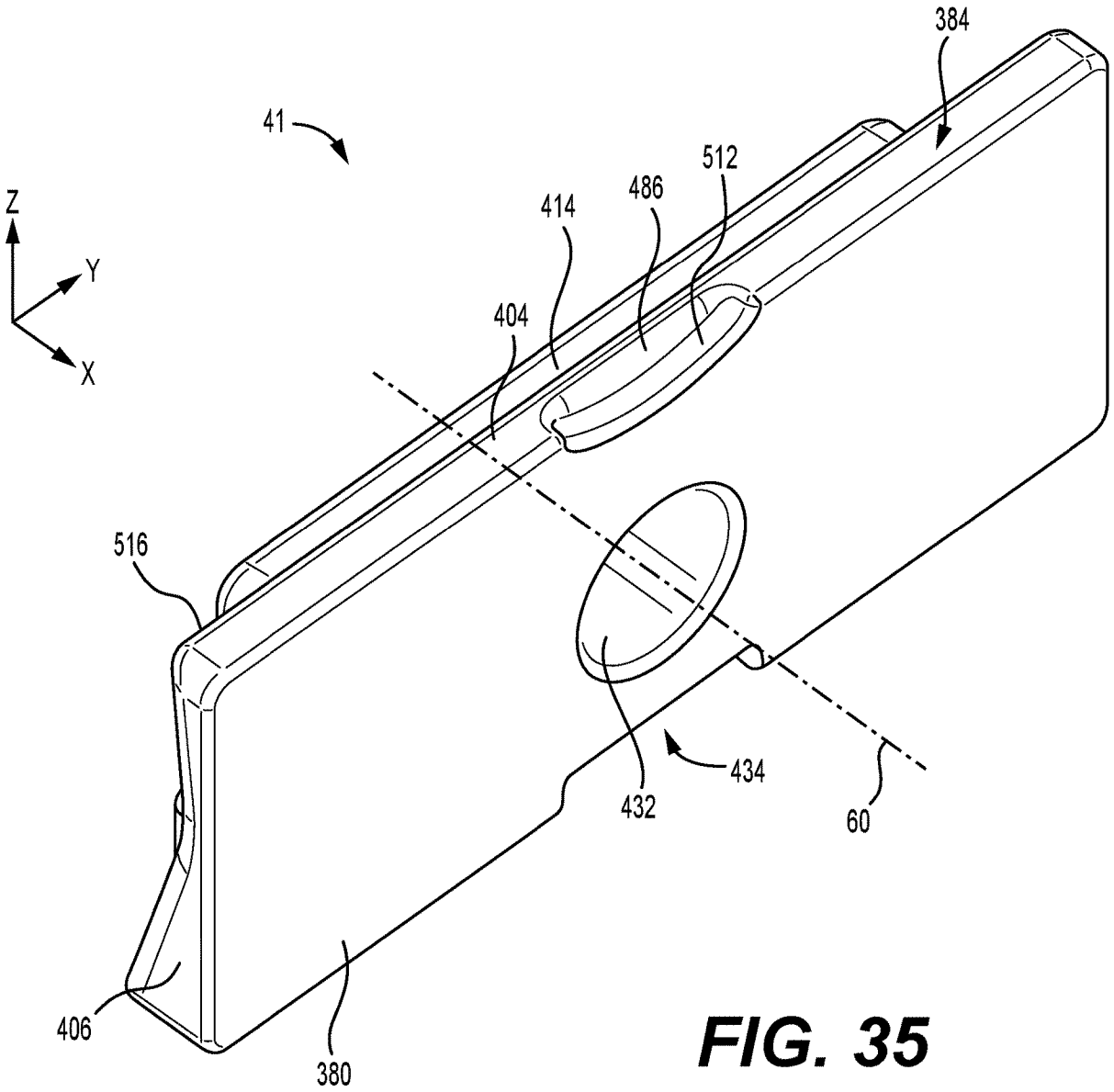
FIG. 35 is a perspective view of another exemplary shim for the shroud retention system of FIG. 2.
Figure 36:
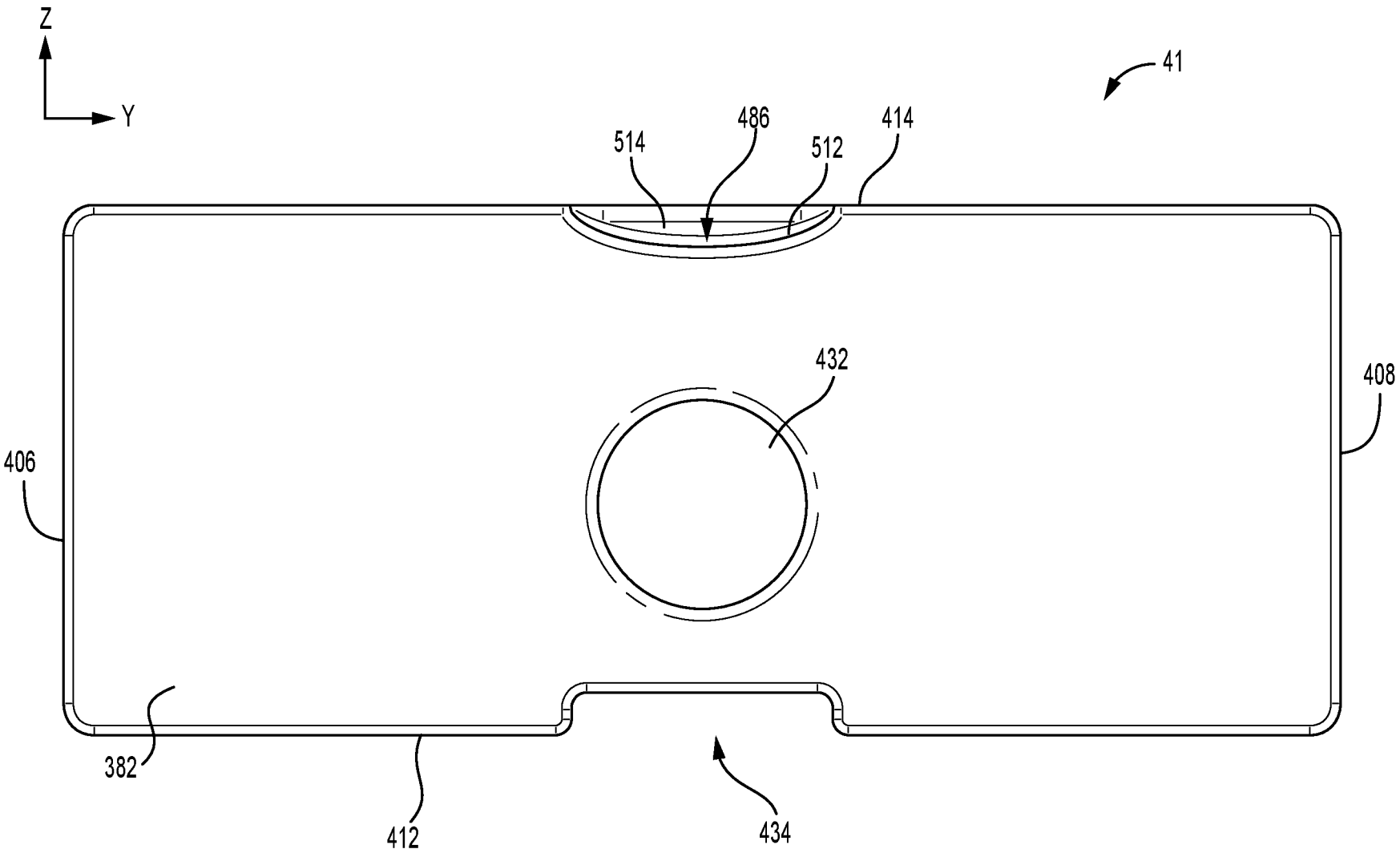
FIG. 36 is a front elevation view of the exemplary shim of FIG. 35.

FIG. 35 illustrates a perspective view of an exemplary shim 41 for the shroud retention system. FIG. 36 illustrates a front elevation view of shim 41. Many of the features of shim 41 illustrated in FIGS. 35 and 36 are similar to the features of shim 40 as illustrated and described above with respect to FIGS. 18-20. Accordingly, a description of those features will not be repeated here, rather only features that are different in shim 41 of FIGS. 35 and 36 compared to shim 40 of FIGS. 18-20 are described below.

As illustrated in FIGS. 35 and 36, shim front portion 384 may include cutout 486 that may extend into shim front portion 384 from shim front portion top face 404. As illustrated in FIG. 35, cutout 486 may extend to a cutout bottom wall 512 that may be positioned between shim front portion top face 404 and shim thru hole 432. In some exemplary embodiments cutout 486 may extend over an entire thickness of shim front portion 384. In other exemplary embodiments as illustrated in FIG. 35, cutout 486 may have a thickness smaller than a thickness of shim front portion 384 such that cutout 486 may have a cutout rear wall 514 disposed between shim front face 380 and shim front portion rear face 516. In one exemplary embodiment as illustrated in FIGS. 35 and 36, cutout bottom wall 512 may have a curvilinear shape (e.g., concave shape). It is contemplated, however, that cutout bottom wall 512 may have any other shape, for example, cutout bottom wall 512 may be a flat surface. Additionally, cutout 486 may be a square, rectangular, elliptical, or polygonal cutout, or may have any other shape. Cutout 486 may ensure easy access to the retainer pry bar recess 362 of retainer plate 38 (see FIG. 15, 16) or 500 of retainer plate 39 (see FIG. 34) from the rear of shroud retention system 30.

Figure 21:
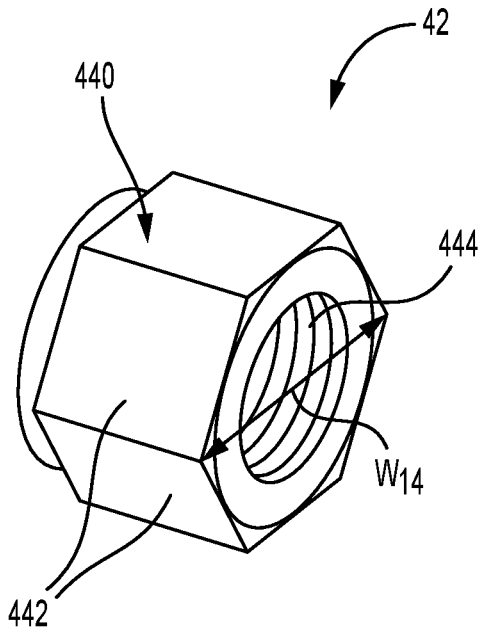
FIG. 21 is a perspective view of an exemplary lock nut for the shroud retention system of FIG. 2.

FIG. 21 illustrates an exemplary embodiment of lock nut 42. Lock nut 42 may have a generally polygonal outer surface. For example, as illustrated in FIG. 21, lock nut 42 may have a generally hexagonal outer surface 440 having a plurality of generally planar faces 442 (e.g., 6 planar faces 442). A maximum outer diametrical dimension "$W_{14}$" of lock nut 42 may be slightly smaller than maximum width "$W_{13}$" (see FIG. 10) between diametrically opposing vertices of nut retention portion 266 of blind hole 260 of retention block 34. Thus, for example, lock nut 42 may be slidingly receivable in nut retention portion 266 (see FIG. 10) of blind hole 260 such that planar faces 442 of lock nut 42 may be disposed adjacent to or may abut on planar faces 274 (see FIG. 10) of nut retention portion 266 of blind hole 260 when lock nut 42 is inserted into the nut retention portion 266 of blind hole 260 of retention block 34. Returning to FIG. 21, lock nut 42 may include thru hole 444 that may include internal threads.

Figure 22:
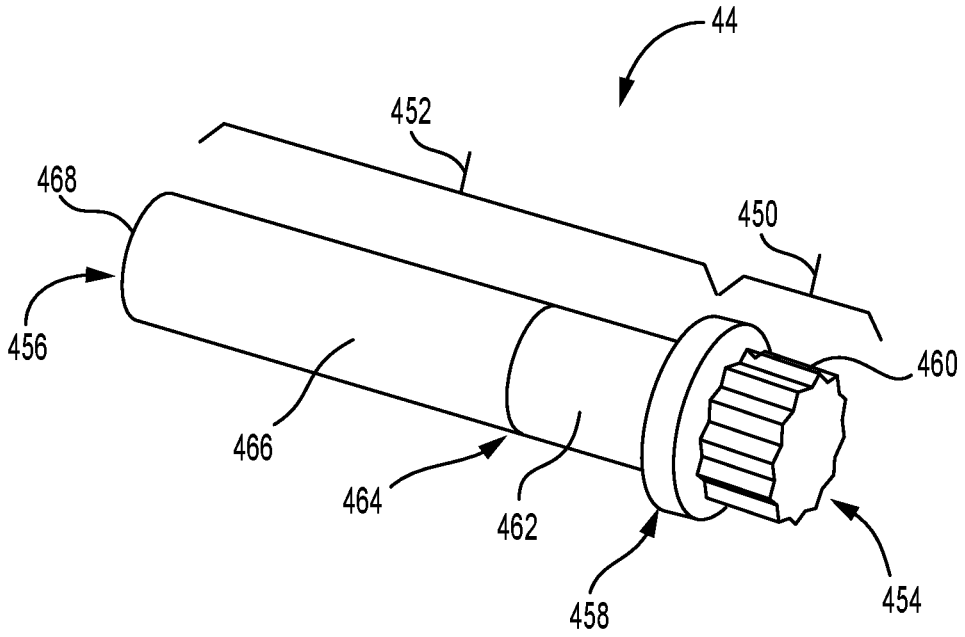
FIG. 22 is a perspective view of an exemplary retention fastener for the shroud retention system of FIG. 2.

FIG. 22 illustrates an exemplary embodiment of retention fastener 44. In one exemplary embodiment as illustrated in FIG. 22, retention fastener 44 may take the form of a bolt (e.g., retention bolt 44). Retention bolt 44 may include bolt head 450 and shank 452. Retention bolt may extend from bolt proximal end 454 to bolt distal end 456. Bolt head 450 may extend from bolt proximal end 454 to bolt head end 458. In some exemplary embodiments, bolt head 450 may have an outer surface 460 that may be shaped to be received in a correspondingly shaped bolt driver that may be used to turn retention bolt 44 in a clockwise or counterclockwise direction. For example, bolt head 450 may have a hexagonal shape so that it may be driven by a hexagonal socket wrench or other bolt turning tool. Shank 452 may extend from bolt head end 458 to bolt distal end 456. In some exemplary embodiments, some or all of shank 452 may include external threads that may be configured to threadingly engage with internal threads in thru hole 444 of lock nut 42 (see FIG. 21). For example, as illustrated in the exemplary embodiment of FIG. 22, shank 452 may include unthreaded portion 462 extending from bolt head end 458 to threaded portion proximal end 464 that may be disposed between bolt head end 458 and bolt distal end 456. Shank 452 may also include a threaded portion 466 extending from threaded portion proximal end 464 to end face 468 of retention bolt 44 located at bolt distal end 456. In one exemplary embodiment as illustrated in FIG. 22, end face 468 may be generally planar or flat. In an assembled configuration of shroud retention system 30, unthreaded portion 462 of retention bolt 44 may slidingly pass through shim thru hole 432 in shim 40, retainer plate thru hole 370 in retainer plate 38, and plunger thru hole 324 in plunger block 36. Further, threaded portion 466 of retention bolt 44 may threadingly engage with internal threads in thru hole 444 of lock nut 42 (see FIG. 21) that may be disposed in nut retention portion 266 (see FIG. 10) of blind hole 260 in retention block 34. A method of assembly of shroud 22 onto work tool 10 and disassembly of shroud 22 from work tool 10 using shroud retention system 30 will be described below.

INDUSTRIAL APPLICABILITY

The disclosed shroud retention system may be used with various earth-working machines, such as hydraulic excavators, cable shovels, wheel loaders, front shovels, draglines, and bulldozers. Specifically, the shroud retention system may be used to connect shrouds to work tools of these machines to help protect the work tool edges against wear. A method of retaining shroud 22 on work tool 10 will be described next.

Figure 23:
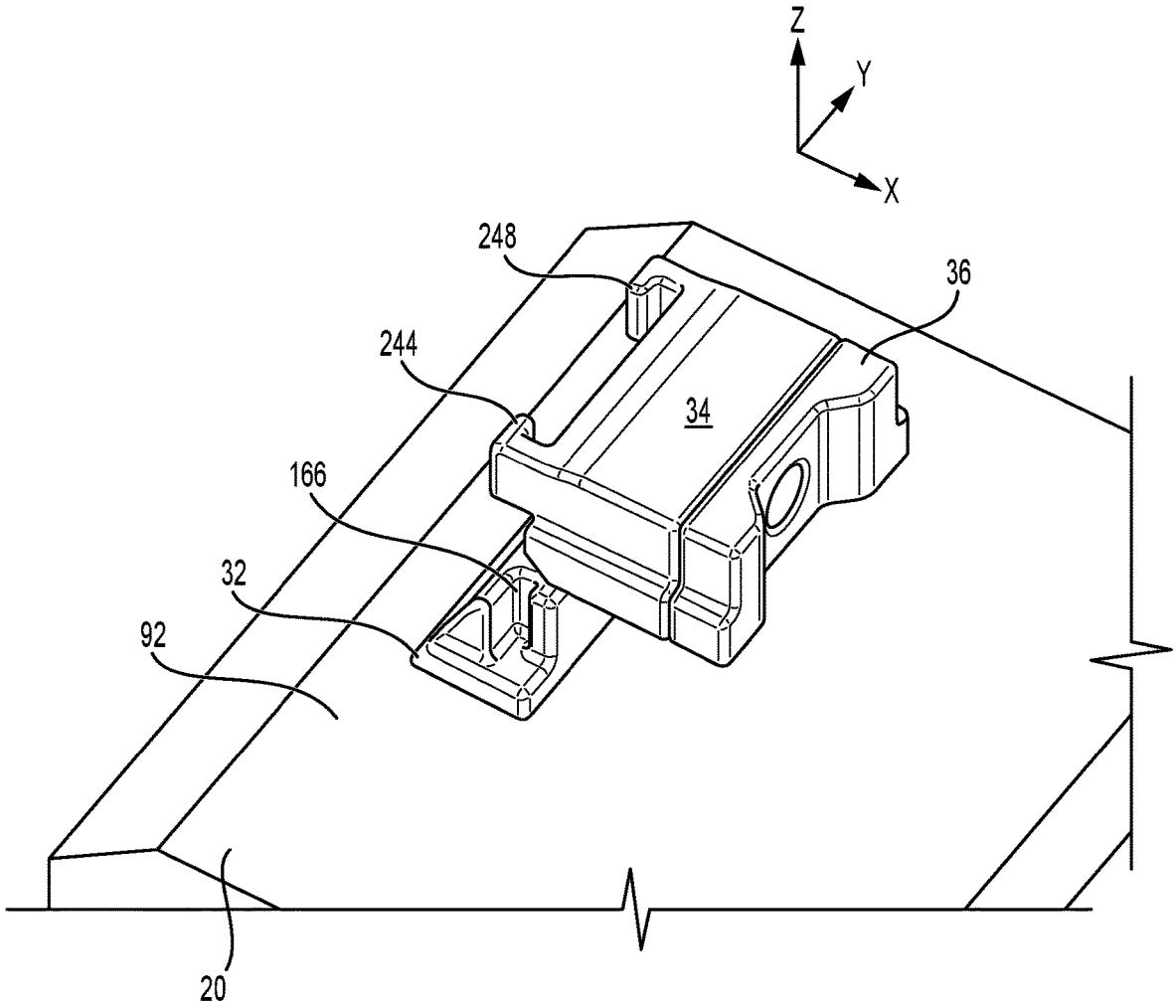
FIG. 23 is an exploded perspective view of the shroud retention system of FIG. 2, showing a subassembly of the lock nut and plunger assembled to the retention block of FIG. 9.

FIGS. 23-27 display various stages of assembly of shroud 22 onto base edge 20 of work tool 10 using shroud retention system 30. As illustrated in FIG. 23, boss 32 of shroud retention system 30 may be attached to upper surface 92 of base edge 20 of work tool 10. In one exemplary embodiment, boss 32 may be welded to upper surface 92 of base edge 20 of work tool 10. For example, weld groove 126 disposed around a perimeter of bottom face 114 of boss base plate 110 (see FIG. 7) may allow boss 32 to be welded to upper surface 92 of base edge 20 using a groove weld. Thus weld groove 126 may help improve weldability and weld quality to ensure that boss 32 may be firmly affixed to base edge 20. Although boss 32 has been described as being welded to upper surface 92 of base edge 20 of work tool 10, it is contemplated that boss 32 may be attached to upper surface 92 of base edge 20 using fasteners, brazing, adhesives, or any other means of attachment.

To begin assembly, lock nut 42 may be inserted into nut retention portion 266 (see FIGS. 9 and 10) of blind hole 260 in retention block 34. For example, lock nut 42 may be inserted into blind hole 260 such that planar faces 442 of hexagonal outer surface 440 of lock nut 42 (see FIG. 21) may be disposed adjacent to or abutting on corresponding planar faces 274 of inner face 276 of nut retention portion 266 (see FIG. 10) of blind hole 260 in retention block 34. It will be understood that in this configuration, interaction between planar faces 274 (see FIG. 10) and planar faces 442 (see FIG. 21) may prevent rotation of lock nut 42 about longitudinal axis 60. As further illustrated in FIG. 23, plunger 282 (see FIGS. 12-14) may be slidingly inserted into counterbore 264 of blind hole 260 (see FIGS. 9 and 10) such that plunger outer surface 322 (see FIGS. 13 and 14) may be disposed adjacent to or may abut on some or all portions of inner surface 276 of counterbore 264 (see FIG. 9). Further, plunger 282 may be inserted into counterbore 264 until plunger front face 320 (see FIGS. 13 and 14) may abut on counterbore base 268 (see FIG. 9).

As illustrated in FIG. 23, the subassembly including retention block 34, lock nut 42 disposed in blind hole 260 of retention block 34, and plunger block 36 with plunger 282 inserted into blind hole 260 may be slidingly mated with boss 32. For example, rails 244 and 248 of legs 210 and 212 of retention block 34 may be slidingly inserted (e.g., in a −Z direction) into channels 166 and 168 (see FIG. 6), respectively, of boss 32 such that bottom face 178 of retention block 34 (see FIGS. 10 and 11) and plunger plate bottom face 294 of plunger block 36 (see FIGS. 12 and 13) abut on upper surface 92 of base edge 20 of work tool 10. In this configuration, rails 170 and 172 of boss 32 (see FIG. 6) may be slidingly received in channels 240 and 242, respectively of retention block 34 (see FIG. 9). Further, in this configuration, blind hole 260 and plunger thru hole 324 may be aligned concentrically about longitudinal axis 60.

Figure 24:
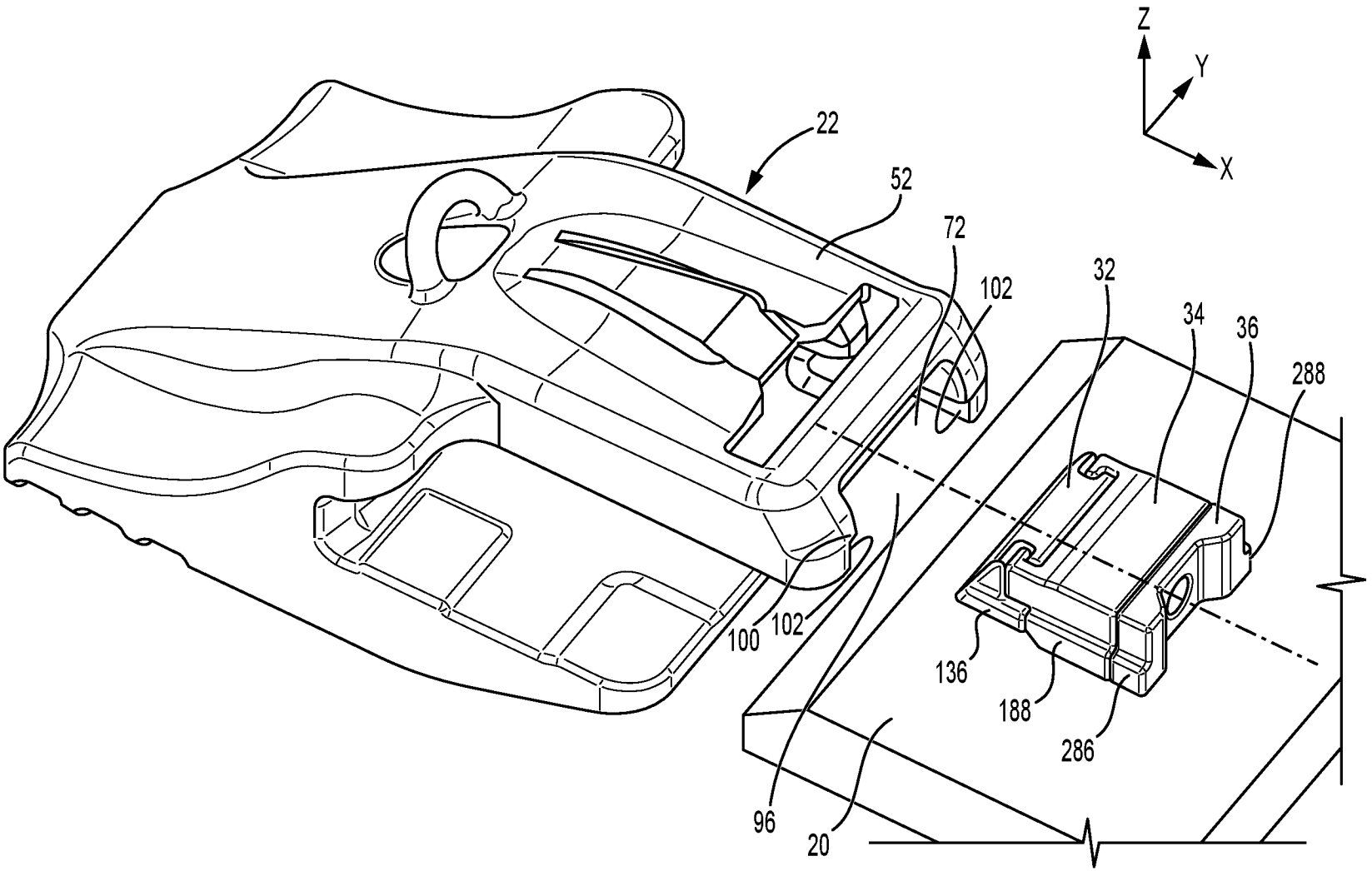
FIG. 24 is an exploded perspective view of the shroud retention system of FIG. 2 with the subassembly of FIG. 23 attached to the boss of FIG. 6.

In the next step of the assembly, as illustrated in FIG. 24, shroud 22 may be attached to work tool 10 by sliding shroud 22 onto work tool 10. For example, shroud 22 may be attached to work tool 10 by positioning attachment portion 52 of shroud 22 and pushing or sliding shroud 22 toward base edge 20 (e.g., in the +X direction) so that boss 32, retention block 34, and plunger block 36 may be slidably received in longitudinal channel 72 of attachment portion 52 of shroud 22. In particular, boss rails 136, retention block rails 192 and plunger rails 286 and 288 may be slidably received in lower recess 96 of longitudinal channel 72 while boss body 112 (see FIG. 6), retention block body 176 (see FIG. 9), and plunger plate body 284 (see FIG. 12) are received in upper recess 98 (see FIG. 5) of longitudinal channel 72. In this configuration, boss rails 136 may be slidingly received in lower recess 96 of shroud 22 (see FIG. 5) such that top face 116 of boss base plate 110 (see FIG. 6) may engage with, abut on, or be disposed adjacent to lower recess upper wall 100 and side faces 122 and 124 may engage with, abut on, or be disposed adjacent to lower recess side walls 102 (see FIG. 5). Similarly, retention block rails 192 (see FIG. 10) may be slidingly received in lower recess 96 of shroud 22 (see FIG. 5) such that top face 180 of retention block base plate 174 (see FIG. 10) may engage with, abut on, or be disposed adjacent to lower recess upper wall 100 (see FIG. 5) and side faces 182 and 184 (see FIG. 10) may engage with, abut on, or be disposed adjacent to lower recess side walls 102 (see FIG. 5). Additionally, plunger rails 286 and 288 (see FIG. 12) may be slidingly received in lower recess 96 of shroud 22 (see FIG. 5) such that top faces 306 and 308 of plunger rails 286 and 288 (see FIG. 12), respectively, may engage with, abut on, or be disposed adjacent to lower recess upper wall 100 (see FIG. 5) and plunger rail side faces 302 and 304 (see FIG. 12) may engage with, abut on, or be disposed adjacent to lower recess side walls 102 (see FIG. 5). Shroud 22 may be pushed in the +X direction until front faces 118 and 140 of boss 32 abut on an internal surface of longitudinal channel 72 of shroud 22. In this configuration, slot 74 of shroud 22 may be disposed rearward of plunger block 36. That is, slot 74 of shroud 22 may be positioned between plunger block 36 and shroud distal end 64. Thus slot 74 may be positioned at a distance relative to boss 32 in the +X direction that may be greater than a distance of plunger plate rear face 292 from boss 32 in the +X direction along longitudinal axis 60.

Figure 25:
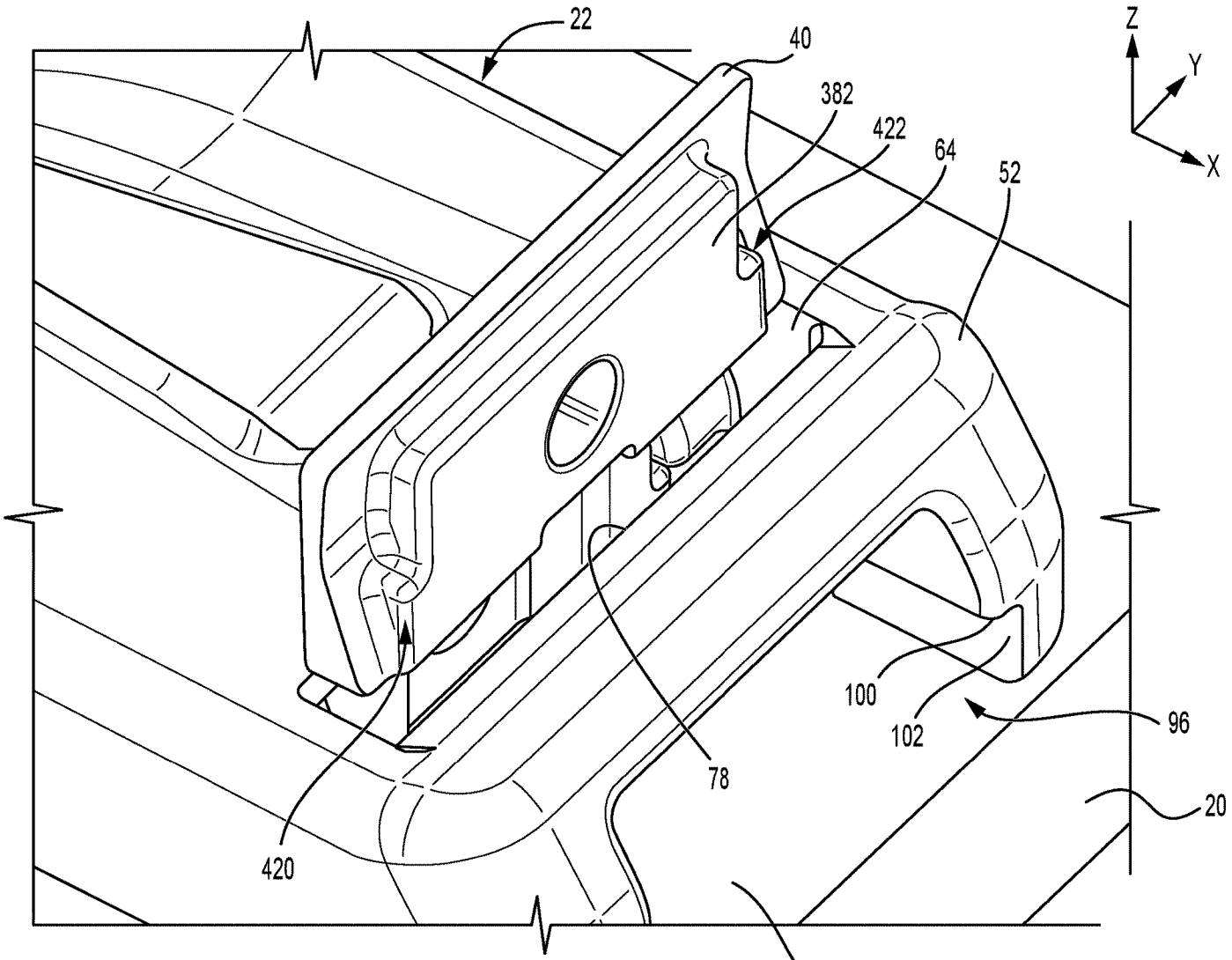
FIG. 25 is an exploded perspective view of the shroud of FIG. 4 assembled to the boss, retention block, and plunger of the shroud retention system of FIG. 2, and illustrating insertion of the shim of FIG. 18.

In the next step of the assembly, as illustrated in FIG. 25, shim 40 may be inserted through slot 74 in shroud 22 vertically (e.g., in a −Z direction). Once shim front portion bottom face 402 and shim rear portion bottom face 412 are in contact with upper surface 92 of base edge 20 of work tool 10, shim 40 may be pushed rearward in a direction away from plunger plate rear face 292 (e.g., in the +X direction) such that shim rear portion 386 (see FIG. 18) may be received in upper recess 98 of longitudinal channel 72 of shroud 22 (see FIG. 5). Pushing shim 40 rearward may cause shim 40 to be separated from plunger block 36 by gap 470 (see FIG. 26) within longitudinal channel 72. Pushing shim 40 rearward may also allow shim rear portion rails 420 and 422 (see FIGS. 18-20) to be slidingly received in lower recess 96 of longitudinal channel 72 (see FIG. 5) such that top faces 428 and 430 of shim rear portion rails 420 and 422 (see FIGS. 18-20), respectively, may engage with, abut on, or be disposed adjacent to lower recess upper wall 100 (see FIG. 5) and shim rear portion rail side faces 424 and 426 (see FIGS. 18-20) may engage with, abut on, or be disposed adjacent to lower recess side walls 102 (see FIG. 5). Further, in this configuration, inclined faces 390 and 392 of shroud contact rear face 388 (see FIGS. 18 and 20) of shim 40 may abut on corresponding inclined shroud inner walls 106 and 108, respectively of shroud 22 (see FIG. 3).

Figure 26:
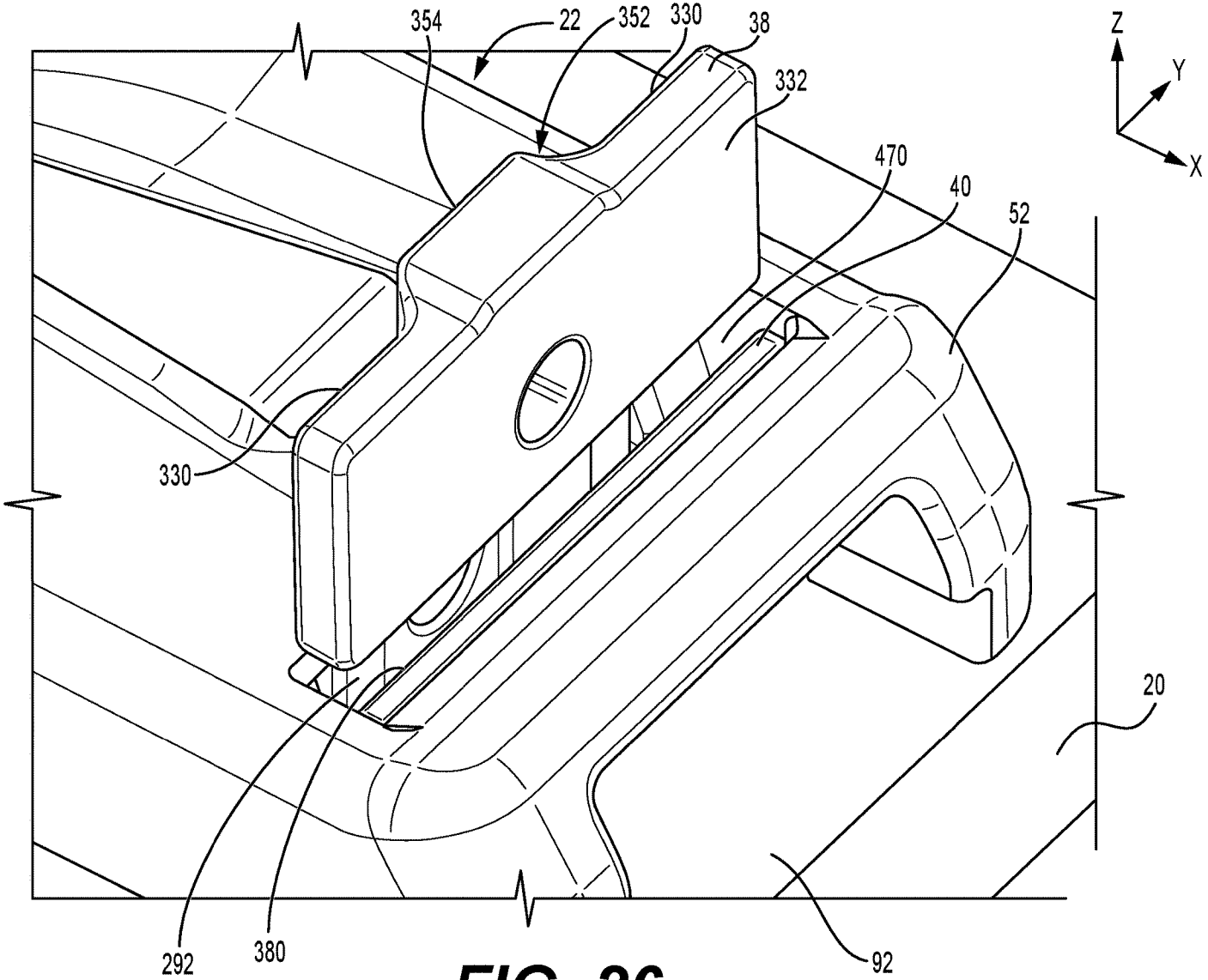
FIG. 26 is an exploded perspective view of the shroud of FIG. 4 assembled to the boss, retention block, plunger, and shim of the shroud retention system of FIG. 2, and illustrating insertion of the retention plate of FIG. 15.

In the next step of the assembly, as illustrated in FIG. 26, retainer plate 38 may be inserted into slot 74 in shroud 22 vertically (e.g., in a −Z direction) into gap 470 until retainer plate bottom face 340 (see FIG. 16) rests on upper surface 92 of base edge 20 of work tool 10. In this configuration, retainer plate rear face 332 may be disposed opposite shim front face 380, retainer plate front face 330 may be disposed opposite plunger plate rear face 292, and projection front face 354 of retainer plate 38 may be disposed opposite plunger plate channel base 312 (see FIGS. 12-14). Further, in this configuration, blind hole 260, plunger thru hole 324, retainer plate thru hole 370, and shim thru hole 432 may be aligned concentrically about longitudinal axis 60. As also illustrated in FIG. 26, in this configuration, there may be a smaller gap 470 between plunger plate rear face 292 and shim front face 380.

Figure 27:
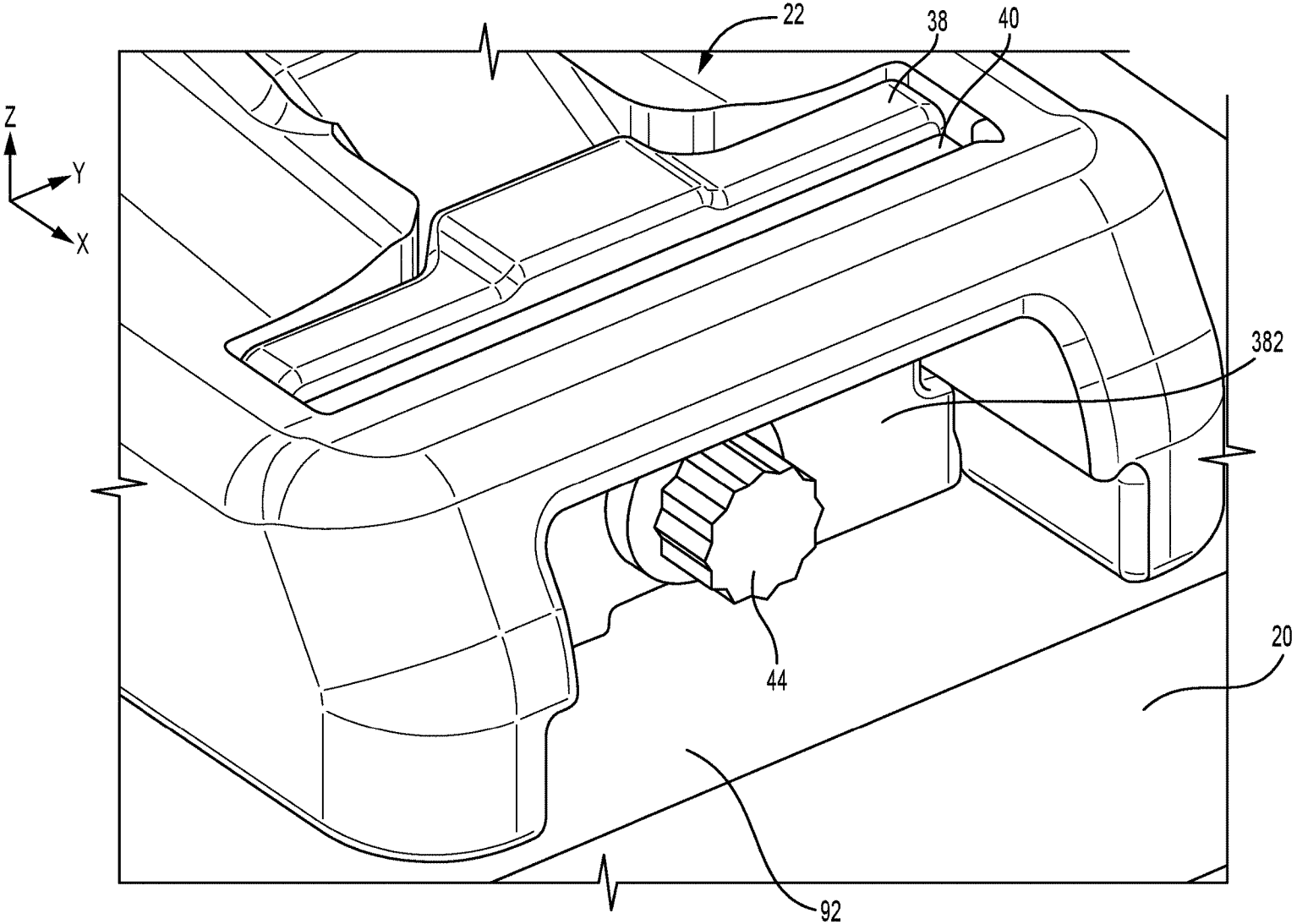
FIG. 27 is perspective view of an exemplary assembly of shroud of FIG. 4 to the work tool of FIG. 1, using the shroud retention system of FIG. 2 with the retention fastener of FIG. 22 in its fully tightened position.
Figure 28:
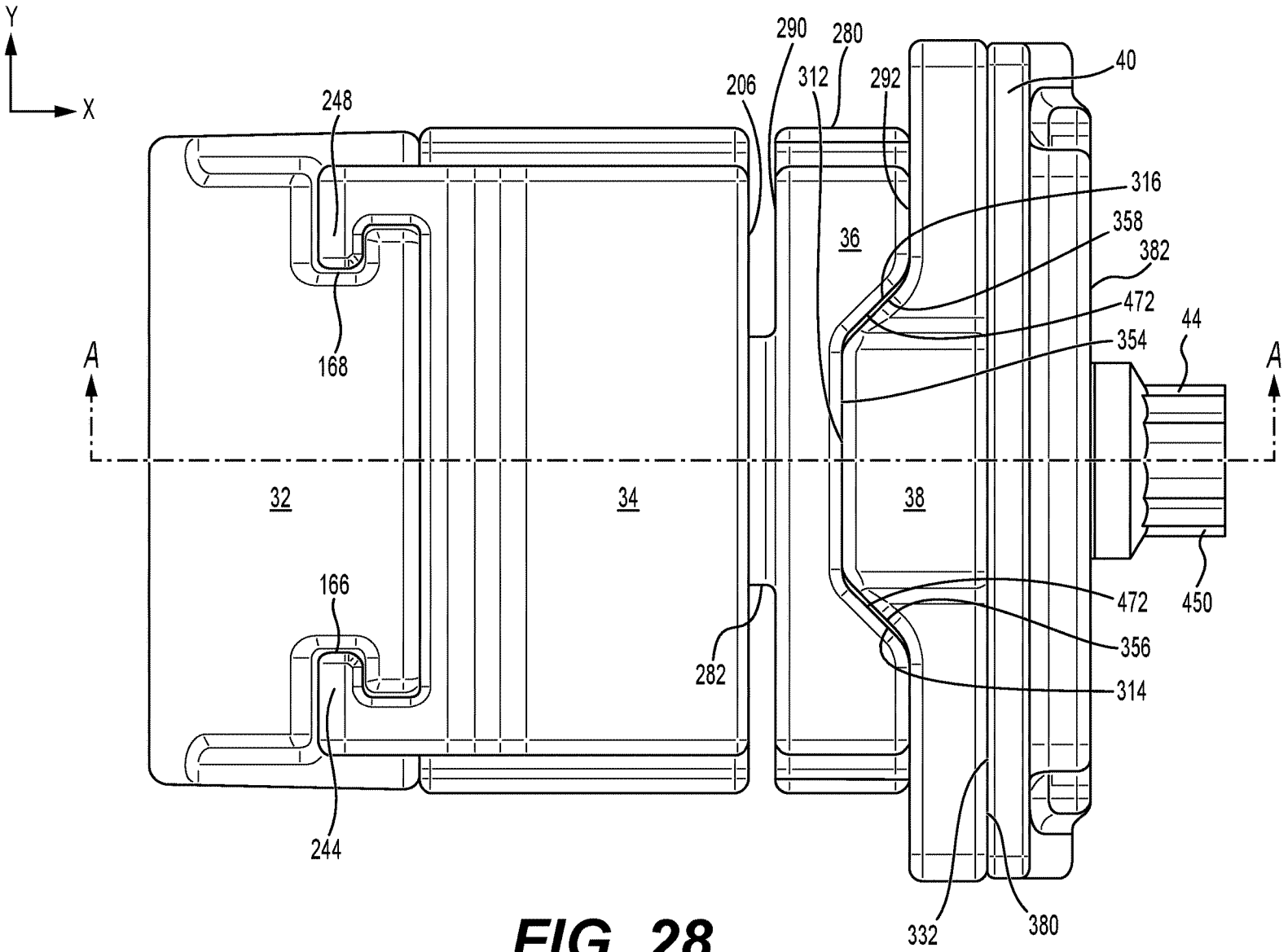
FIG. 28 is a top plan view of the shroud retention system in the assembly of FIG. 27.

In the next step of the assembly, as illustrated in FIG. 27, retention bolt 44 may be inserted through shim thru hole 432 (see FIGS. 18 and 19), retainer plate thru hole 370 (see FIGS. 15-17), and plunger thru hole 324 (see FIGS. 12-14)

until threaded portion 466 (see FIG. 22) engages with threads in thru hole 444 in lock nut 42 (see FIG. 21). In one exemplary embodiment, rotation of retention bolt 44 in, for example, a clockwise direction may cause threaded portion 466 to engage with threads in thru hole 444 in lock nut 42 (see FIG. 21). As retention bolt 44 is rotated, bolt head 450 (see FIG. 22) may abut on shim rear face 382. FIG. 28 illustrates a top plan view of shroud retention system 30 in its assembled form. Shroud 22 is omitted from FIG. 28 for clarity. As illustrated in FIG. 28, rails 244 and 248 of retention block 34 may be positioned within channels 166 and 168, respectively of boss 32. Retention block rear face 206 of retention block 34 may be spaced apart (e.g., in the +X direction) from plunger plate front face 290. Plunger plate rear face 292 may abut on retainer plate front face 330 and plunger plate channel base 312 may abut on projection front face 354 of retainer plate 38. Retainer plate rear face 332 may abut on shim front face 380 and bolt head 450 may abut on shim rear face 382. As also illustrated in FIG. 28, projection side faces 356 and 358 may be separated from plunger plate channel side walls 314 and 316, respectively, by gaps 472.

Figure 29:
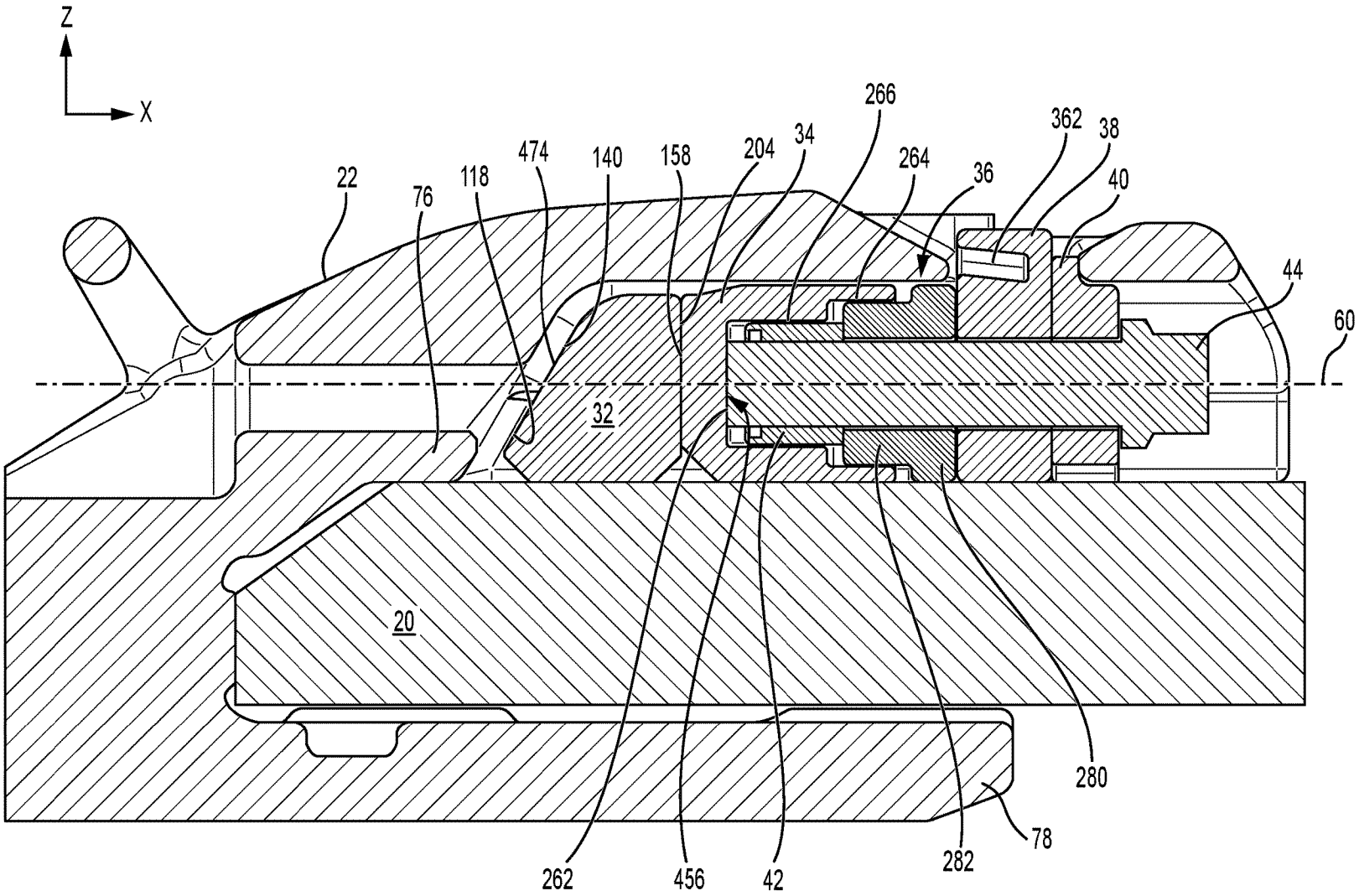
FIG. 29 is a vertical cross-sectional view taken along line A-A of shroud retention system of FIG. 28, including the shroud of FIG. 4 fully assembled to the work tool of FIG. 1, using the shroud retention system of FIG. 2.

FIG. 29 illustrates a vertical cross-sectional view in the X-Z plane taken along line A-A of FIG. 28. As illustrated in FIG. 29, shroud 22 is included in this view. As discussed above, and as illustrated in FIG. 29, front faces 118 and 140 of boss base plate 110 and boss body 112, respectively, may abut on internal surface 474 of shroud 22. Retention block front face 204 of retention block 34 may abut on rear face 158 of boss 32. As also illustrated in FIG. 29, lock nut 42 may be disposed in nut retention portion 266 of blind hole 260 in retention block 34, and a portion of plunger 282 may be disposed within counterbore 264 of blind hole 260 in retention block 34. Retention block 34, retainer plate 38, and shim 40 may be positioned as described above with respect to FIG. 28. Rotation of retention bolt 44 may cause retention bolt 44 to progress through lock nut 42 in a −X direction until end face 468 at bolt distal end 456 may come into contact with blind hole base 262 of retention block 34. Once end face 468 of retention bolt 44 is in contact with blind hole base 262, further rotation of retention bolt 44 cannot allow retention bolt 44 to move in the −X direction. Instead, lock nut 42 may begin traveling along longitudinal axis 60 in the +X direction as retention bolt is continued to be tightened. Lock nut 42 may in turn push plunger 282 and plunger plate 280 to move in the +X direction. Plunger plate 280 in turn may push against retainer plate 38 and shim 40, which in turn may push against shroud inner walls 106 and 108. Thus rotation of retention bolt 44 may cause plunger block 36, retainer plate 38, and shim 40 to move away (e.g., in the +X direction) from retention block 34. Rotation of retention bolt 44 may also cause retention block front face 204 of retention block 34 to push against rear face 158 of boss 32, while simultaneously causing inclined faces 390 and 392 of shroud contact rear face 388 of shim 40 (see FIGS. 18 and 20) to push against shroud inner walls 104 and 106 (see FIG. 3), locking shroud 22 in place on base edge 20 of work tool 10. Such an arrangement may help reduce a likelihood of shroud 22 moving in a sideways direction (e.g., in a +Y or −Y direction) or transverse direction (e.g., in a +Z or −Z direction) during operations of work tool 10. Moreover, because Shim front face 380 is generally perpendicular to longitudinal axis 60 and shroud contact rear face 388 of shim 40 (see FIGS. 18 and 20) is inclined to match the inclination of shroud inner walls 104 and 106 (see FIG. 3), shim 40 may help to react the contact forces between shim 40 and shroud inner walls 104 and 106 (see FIG. 3) in a direction generally parallel to longitudinal axis 60, allowing retention bolt 44 to be primarily subjected to tensile forces. By helping to reduce forces in the transverse direction on retention bolt 44, shim 40 may help reduce wear and tear of retention bolt 44 and of the inner surfaces of shim thru hole 432 (see FIGS. 18 and 19), retainer plate thru hole 370 (see FIGS. 15-17), and plunger thru hole 324 (see FIGS. 12-14). Minimizing forces in the transverse direction may also help in reducing the likelihood of rotation of retention bolt 44 during use, which in turn may reduce the likelihood of any loosening of retention bolt 44. This in turn may prevent any sideways (e.g., in a +Y or −Y direction) and/or transverse (e.g., in a +Z or −Z direction) movement of shroud 22 during operations of work tool 10.

Disassembly of shroud 22 from work tool 10 may be accomplished by reversing the above-identified steps. For example, to disassemble shroud 22, retention bolt 44 may first be rotated in a counterclockwise direction until threaded portion 466 of retention bolt 44 disengages from the internal threads in thru hole 444 of lock nut 42. Retention bolt 44 may then be removed out of blind hole 260, plunger thru hole 324, retainer plate thru hole 370, and shim thru hole 432. A pry bar or other tool may be inserted in pry bar recess 362 of retainer plate 38 to extract retainer plate 38 from slot 74. A pry bar or other tool may be inserted into pry bar slot 434 of shim 40 to help push shim 40 away from shroud inner walls 106 and 108. Shim 40 may now be pulled out of slot 74. After extracting shim 40, shroud 22 may be slidably disengaged from boss 32, retention block 34, and plunger block 36 by pulling shroud 22 towards the −X direction away from base edge 20 of work tool 10. To further disassemble shroud retention system 30, retention block 34 may be slidingly extracted from boss 32, plunger block 36 may be extracted from blind hole 260 and lock nut 42 may be removed from blind hole 260.

Figure 37:
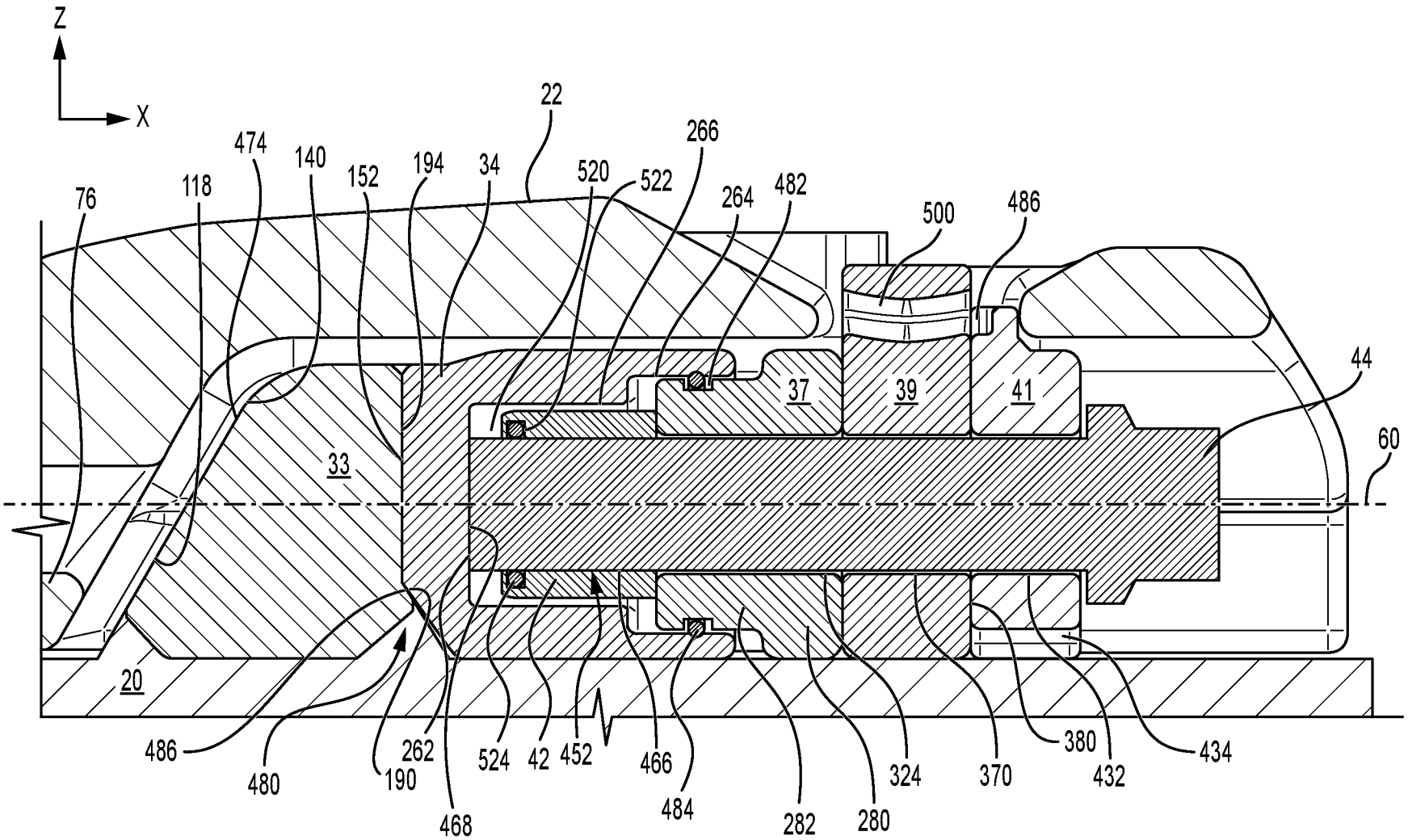
FIG. 37 is a vertical cross-sectional view taken along line A-A of shroud retention system of FIG. 28, including the shroud of FIG. 4 fully assembled to the work tool of FIG. 1, and using the boss of FIGS. 30 and 31, plunger block of FIGS. 32 and 33, retention plate of FIG. 34, and shim of FIGS. 35 and 36 in the shroud retention system of FIG. 2.

FIG. 37 illustrates a vertical cross-sectional view in the X-Z plane taken along line A-A of FIG. 28. Unlike FIG. 29, however, the assembly of FIG. 37 includes boss 33 of FIGS. 30 and 31, plunger block 37 of FIGS. 32 and 33, retainer plate 39 of FIG. 34, and shim 41 of FIGS. 35 and 36. The method of assembly of shroud 22 onto base edge 20 of work tool 10 using shroud retention system having boss 33, plunger block 37, retainer plate 39, and shim 41 may be similar to that described above with reference to FIGS. 23-27. Certain features of the assembly using boss 33, plunger block 37, retainer plate 39, and shim 41 that may be different from an assembly using boss 32, plunger block 36, retainer plate 38, and shim 40 are described below with reference to FIG. 37.

As discussed above, and as illustrated in FIG. 37, front faces 118 and 140 of boss 33 abut on internal surface 474 of shroud 22. Front face 194 of retention block 34 may abut on rear face 152 of boss 33, whereas cutout face 190 may be configured to abut on surface 488 of extension 480 of boss 33. As also illustrated in FIG. 37, lock nut 42 may be disposed in nut retention portion 266 in retention block 34, and a portion of plunger 282 of plunger block 37 may be disposed within counterbore 264 in retention block 34. Further, as illustrated in FIG. 37, sealing member 484 positioned in channel 482 of plunger 282 may be disposed between bottom surface 494 (see FIG. 33) of channel 482 and an inner surface of counterbore 264. Sealing member 484 may help prevent debris from outside shroud retention system 30 from entering in space 520 between lock nut 42 and blind hole base 262 of retention block 34. As also illustrated in FIG. 37, lock nut 42 may include channel 522 on an inner surface of lock nut 42. Sealing member 524 may be disposed in channel 522 between lock nut 42 and shank 452 of retention bolt 44. Like sealing member 484, sealing member 524 may also help prevent debris from entering between lock nut 42 and threaded portion 466 of retention bolt 44. Retention block 34, retainer plate 39, and shim 41 may be positioned as described above for retainer plate 38 and shim 40 with respect to FIG. 28. Rotation of retention bolt 44 may cause retention bolt 44 to progress through lock nut 42 in a −X direction until end face 468 of bolt 44 may come into contact with blind hole base 262 of retention block 34. Once end face 468 of retention bolt 44 is in contact with blind hole base 262, further rotation of retention bolt 44 cannot allow retention bolt 44 to move in the −X direction. Instead, lock nut 42 may begin traveling along longitudinal axis 60 in the +X direction as retention bolt is continued to be tightened. Lock nut 42 may in turn push plunger 282 and plunger plate 280 to move in the +X direction. Plunger plate 280 in turn may push against retainer plate 39 and shim 41, which in turn may push against shroud inner walls 106 and 108 (see FIG. 3). Thus rotation of retention bolt 44 may cause plunger block 37, retainer plate 39, and shim 41 to move away (e.g., in the +X direction) from retention block 34. Rotation of retention bolt 44 may also cause retention block front face 204 to push against rear face 152 of boss 33, while simultaneously causing inclined faces 390 and 392 of shroud contact rear face 388 of shim 41 (see FIGS. 18 and 20) to push against shroud inner walls 104 and 106 (see FIG. 3), locking shroud 22 in place on base edge 20 of work tool 10. Such an arrangement may help reduce a likelihood of shroud 22 moving in a sideways direction (e.g., in a +Y or −Y direction) or transverse direction (e.g., in a +Z or −Z direction) during operations of work tool 10. Moreover, because Shim front face 380 is generally perpendicular to longitudinal axis 60 and shroud contact rear face 388 of shim 41 (see FIGS. 18 and 20) is inclined to match the inclination of shroud inner walls 104 and 106 (see FIG. 3), shim 41 may help to react the contact forces between shim 41 and shroud inner walls 104 and 106 (see FIG. 3) in a direction generally parallel to longitudinal axis 60, allowing retention bolt 44 to be primarily subjected to tensile forces. By helping to reduce forces in the transverse direction on retention bolt 44, shim 41 may help reduce wear and tear of retention bolt 44 and of the inner surfaces of shim thru hole 432 (see FIGS. 18 and 19), retainer plate thru hole 370 (see FIGS. 15-17), and plunger thru hole 324 (see FIGS. 12-14). Minimizing forces in the transverse direction may also help in reducing the likelihood of rotation of retention bolt 44 during use, which in turn may reduce the likelihood of any loosening of retention bolt 44. This in turn may prevent any sideways (e.g., in a +Y or −Y direction) and/or transverse (e.g., in a +Z or −Z direction) movement of shroud 22 during operations of work tool 10.

Disassembly of shroud 22 from work tool 10 when using shroud retention system 30 with boss 33, plunger block 37, retainer plate 39, and/or shim 41 may be accomplished by reversing the assembly steps described above. For example, to disassemble shroud 22, retention bolt 44 may first be rotated in a counterclockwise direction until threaded portion 466 of retention bolt 44 disengages from the internal threads of lock nut 42. Retention bolt 44 may then be removed out of blind hole 260 (see FIGS. 9, 10), plunger thru hole 324, retainer plate thru hole 370, and shim thru hole 432. A pry bar or other tool may be inserted in pry bar recess 500 of retainer plate 39 to extract retainer plate 39 from slot 74. Cutout 486 in shim 41 may make it easier for an operator to insert the pry bar into pry bar recess 500. After removal of retainer plate 39, the pry bar or other tool may be inserted into pry bar slot 434 of shim 41 to help push shim 41 away from shroud inner walls 106 and 108. Shim 41 may now be pulled out of slot 74. After extracting shim 41, shroud 22 may be slidably disengaged from boss 33, retention block 34, and plunger block 37 by pulling shroud 22 towards the −X direction away from base edge 20 of work tool 10. To further disassemble shroud retention system 30, retention block 34 may be slidingly extracted from boss 33, plunger block 37 may be extracted from blind hole 260 (see FIGS. 9, 10) and lock nut 42 may be removed from blind hole 260 (see FIGS. 9, 10). Although shroud retention system 30 with boss 32, plunger block 36, retainer plate 38, and shim 40 has been described above as being different from shroud retention system 30 with boss 33, plunger block 37, retainer plate 39, and shim 41, it should be understood that these parts may be interchangeable. For example, boss 33 may be used with plunger block 36, retainer plate 38, and shim 40 in shroud retention system 30 or retainer plate 39 and shim 41 may be used with boss 32 and plunger block 36 and so on.

It will be apparent to those skilled in the art that various modifications and variations can be made to the disclosed shroud retention system. Other embodiments will be apparent to those skilled in the art from consideration of the specification and practice of the disclosed shroud retention system. It is intended that the specification and examples be considered as exemplary only, with a true scope being indicated by the following claims and their equivalents.

What is claimed is:

1. A shroud retention system for a work tool, comprising:
- a boss attached to the work tool;
- a retention block attached to the boss, the retention block including a lock nut; and
- a plunger block connected to the retention block and configured to slidably move relative to the retention block,
  - wherein the boss, the retention block, and the plunger block are slidably receivable in a shroud including a retainer slot;
- a retainer plate disposed in the retainer slot and configured to engage with the plunger block;
- a shim front face configured to engage with the retainer plate and a shim rear face configured to engage with a shroud inner wall,
  - wherein each of the plunger block, the retainer plate, and the shim includes a thru hole; and
- a retention fastener configured to pass through the thru hole in each of the plunger block, the retainer plate, and the shim and engage with the lock nut to attach the shroud to the work tool.

2. The shroud retention system of claim 1, wherein rotation of the retention fastener is configured to slidably move the plunger block relative to the retention block.

3. The shroud retention system of claim 2, wherein the retention fastener is a retention bolt, including:
- a retention bolt head; and
- a shank extending from the retention bolt head, the shank including a generally flat end surface and a threaded portion,
  - wherein the end surface of the retention bolt is configured to abut on the retention block.

4. The shroud retention system of claim 1, wherein the boss includes:
- a boss base plate attached to the work tool;
- a boss body projecting from the boss base plate in a height direction transverse to a top face of the boss base plate; and a pair of channels extending vertically from a top face of the boss body to the top face of the boss base plate.

5. The shroud retention system of claim 4, wherein the boss includes:

a front face disposed generally inclined relative to a longitudinal axis of the shroud retention system; and a rear face disposed generally perpendicular to the longitudinal axis.

6. The shroud retention system of claim 5, wherein the retention block includes:

a retention block base plate;

a retention block body projecting from the retention block base plate in the height direction;

a retention block front face configured to abut on a boss rear face;

a retention block rear face; and a pair of legs projecting from the retention block front face generally parallel to the longitudinal axis in a direction from the retention block rear face towards the retention block front face.

7. The shroud retention system of claim 6, wherein each of the pair of legs includes a vertically extending channel defining a pair of rails.

8. The shroud retention system of claim 7, wherein the pair of rails of the retention block are configured to slidably engage with the pair of channels of the boss.

9. The shroud retention system of claim 6, wherein the retention block includes a blind hole extending from the retention block rear face to a blind hole base disposed between the retention block front face and the retention block rear face.

10. The shroud retention system of claim 9, wherein the blind hole includes:

a nut retention portion configured to slidably receive a lock nut; and a generally cylindrical counterbore.

11. The shroud retention system of claim 10, wherein an end face of the retention bolt is configured to abut on the blind hole base.

12. The shroud retention system of claim 10, wherein the plunger includes:

a plunger plate having a plunger plate front face; and a plunger extending from plunger plate front face and configured to be slidingly received in the counterbore of the retention block.

13. The shroud retention system of claim 12, wherein the plunger plate includes:

a plunger plate rear face disposed opposite the plunger plate front face;

a plunger plate top face extending between the plunger plate front face and the plunger plate rear face;

a plunger plate bottom face extending between the plunger plate front face and the plunger plate rear face and configured to abut on the work tool; and a plunger plate channel extending from the plunger plate top face to the plunger plate bottom face.

14. The shroud retention system of claim 13, wherein the retainer plate includes:

a retainer portion including a retainer plate front face; and a pull out portion including a projection protruding from the retainer plate front face, the projection being configured to be received in the plunger plate channel.

15. The shroud retention system of claim 14, wherein the plunger plate channel includes:

a plunger plate channel base disposed generally perpendicular to the longitudinal axis; and a plunger plate channel sidewall disposed generally inclined relative to the longitudinal axis at a first angle; and the projection includes:

a projection front face disposed generally perpendicular to the longitudinal axis; and a projection side face disposed at a second angle relative to the longitudinal axis.

16. The shroud retention system of claim 15, wherein the second angle is different from the first angle such that when the projection front face abuts on the plunger plate channel base and the retainer plate front face abuts on the plunger plate rear face, the plunger plate channel sidewall is spaced apart from the projection side face by a gap.

17. The shroud retention system of claim 1, wherein the shim includes:

a shim front portion; and a shim rear portion extending from the shim front portion.

18. The shroud retention system of claim 17, wherein the shim rear portion includes a pair of shim rear portion rails extending outward from respective shim rear portion side faces; and the shim rear portion rails are configured to be slidably receivable in the shroud.

19. A shroud assembly, including:

a work tool including a base edge;

a shroud configured to be attached to the base edge, the shroud including a tip and an attachment portion extending from the tip, the attachment portion including a longitudinal channel and a slot extending transverse to the longitudinal channel;

a boss attached to the base edge;

a retention block attached to the boss, the retention block including a lock nut; and a plunger block connected to the retention block and configured to slidably move relative to the retention block, wherein the boss, the retention block, and the plunger block are slidably receivable in the longitudinal channel of the shroud;

a retainer plate disposed in the slot and configured to abut on the plunger block;

a shim having a front face configured to abut the retainer plate and a shroud contact rear face configured to engage with a shroud inner wall of the shroud, wherein each of the plunger block, the retainer plate, and the shim includes a thru hole; and a retention bolt configured to pass through the thru hole in each of the plunger block, the retainer plate, and the shim, the retention bolt further configured to threadingly engage with the lock nut to attach the shroud to the work tool.

20. A method of attaching a shroud to a work tool, including:

attaching a boss to an upper surface of the work tool;

slidably attaching a retention block to the boss, the retention block including a blind hole configured to retain a lock nut;

slidably inserting a plunger of a plunger block into a portion of the blind hole of the retainer, the plunger block including a plunger thru hole;

sliding the shroud on to the work tool, the shroud including a longitudinal channel configured to slidingly receive the boss, the retention block, and the plunger block, the shroud including a slot extending transverse to the longitudinal channel;

positioning the shroud on the work tool such that the slot is disposed between the plunger block and a shroud distal end;

inserting a shim into the longitudinal channel via the slot, the shim including a shim thru hole;

pushing the shim such that the shim is separated from the plunger block by a gap;

inserting a retainer plate into the gap within the longitudinal channel via the slot, the retainer plate including a retainer plate thru hole;

inserting a retention bolt through the shim thru hole, the retainer plate thru hole, and the plunger thru hole such that a threaded portion of the retention bolt engages with the lock nut in the retention block;

rotating the retention bolt such that an end face of the retention bolt abuts on a blind hole base of the blind hole in the retention block; and continuing to rotate the retention bolt, causing the plunger block, the retainer plate, and the shim to slidably move away from the retention block and further causing a shroud contact rear face of the shim to engage with a shroud internal wall.

* * * * *